US011351796B2

(12) United States Patent
Eto

(10) Patent No.: US 11,351,796 B2
(45) Date of Patent: Jun. 7, 2022

(54) LIQUID EJECTION DEVICE

(71) Applicant: KYOCERA Document Solutions Inc., Osaka (JP)

(72) Inventor: Daisuke Eto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/276,121

(22) PCT Filed: Sep. 13, 2019

(86) PCT No.: PCT/JP2019/036097
§ 371 (c)(1),
(2) Date: Mar. 12, 2021

(87) PCT Pub. No.: WO2020/059658
PCT Pub. Date: Mar. 26, 2020

(65) Prior Publication Data

US 2022/0032643 A1 Feb. 3, 2022

(30) Foreign Application Priority Data

Sep. 19, 2018 (JP) ..... JP2018-175069

(51) Int. Cl.
*B41J 2/175* (2006.01)
*B41J 2/18* (2006.01)

(52) U.S. Cl.
CPC ..... *B41J 2/17596* (2013.01); *B41J 2/18* (2013.01)

(58) Field of Classification Search
CPC . B41J 2/17596; B41J 2/175; B41J 2/18; B41J 29/38; B41J 29/02; B41J 29/13; B41J 2/16517
See application file for complete search history.

(56) References Cited

U.S. PATENT DOCUMENTS 10,618,298 B2 * 4/2020 Tamura ..... B41J 2/17523
10,926,562 B2 * 2/2021 Eto ..... B41J 2/17596
(Continued)

FOREIGN PATENT DOCUMENTS

JP 2017-61091 3/2017
WO 03/041964 5/2003

OTHER PUBLICATIONS

International Search Report dated Dec. 10, 2019.

*Primary Examiner* — An H Do
(74) *Attorney, Agent, or Firm* — Gerald E. Hespos; Matthew T. Hespos; Michael J. Porco

(57) ABSTRACT

A liquid ejection device includes a liquid ejection head which ejects a first liquid, and a liquid supply unit. The liquid ejection head includes a plurality of liquid discharge holes with individual passages and a common passage for supplying the first liquid to the individual passages. The liquid supply unit includes a pressure chamber, a first supply passage communicating with the pressure chamber, and a second supply passage that makes an upstream side of a common passage communicate with the pressure chamber, a liquid drain path that makes a downstream side of the common passage communicate with the second supply passage, and a pump mechanism. The pump mechanism supplies the first liquid to the upstream side and the downstream side of the common passage through the second supply passage and the liquid drain path, and discharges the second liquid, which is filled in advance, from the liquid discharge hole.

8 Claims, 35 Drawing Sheets

(56) References Cited

U.S. PATENT DOCUMENTS

| | | | |
|---|---|---|---|
| 2005/0073559 | A1 | 4/2005 | Aruga et al. |
| 2007/0115333 | A1 | 5/2007 | Aruga et al. |
| 2010/0271447 | A1 | 10/2010 | Aruga et al. |
| 2012/0212549 | A1 | 8/2012 | Aruga et al. |
| 2013/0222494 | A1 | 8/2013 | Levi |
| 2013/0235127 | A1 | 9/2013 | Aruga et al. |
| 2013/0265372 | A1 | 10/2013 | Aruga et al. |
| 2014/0210909 | A1 | 7/2014 | Aruga et al. |
| 2015/0022596 | A1 | 1/2015 | Aruga et al. |
| 2016/0009101 | A1 | 1/2016 | Aruga et al. |
| 2016/0121616 | A1 | 5/2016 | Aruga et al. |
| 2017/0087867 | A1 | 3/2017 | Sato et al. |
| 2017/0157946 | A1 | 6/2017 | Aruga et al. |
| 2017/0341409 | A1 | 11/2017 | Aruga et al. |
| 2018/0099509 | A1 | 4/2018 | Sato et al. |
| 2018/0201023 | A1 | 7/2018 | Sato et al. |
| 2018/0257385 | A1 | 9/2018 | Aruga et al. |
| 2019/0224983 | A1 | 7/2019 | Aruga et al. |
| 2020/0108625 | A1 | 4/2020 | Aruga et al. |

* cited by examiner

LIQUID EJECTION DEVICE

TECHNICAL FIELD

The present invention relates to a liquid ejection device which includes a liquid ejection head and a liquid supply unit which supplies a liquid stored in a liquid storage container to the liquid ejection head.

BACKGROUND ART

For example, in an inkjet printer (liquid ejection device), a liquid ejection head which ejects a trace amount of ink (liquid) onto a printing target is used. Ink is supplied to the liquid ejection head from an ink cartridge (liquid storage container) which stores ink through a predetermined supply passage. WO 2003/041964 discloses a liquid ejection device where a liquid supply unit (valve unit) is disposed in the supply passage. The liquid supply unit (valve unit) has a pressure chamber which generates a negative pressure in the discharge holes of the liquid ejection head when ink is supplied from the ink cartridge to a liquid ejection head due to a water head difference. Due to the provision of the liquid supply unit which generates a negative pressure, dropping of ink in an unlimited manner from the discharge holes is suppressed even when the ink is supplied by making use of the water head difference.

The liquid ejection head includes: a plurality of ink discharge holes, individual passages which individually guide ink to these ink discharge holes, and a common passage which supplies the ink to these individual passages. Then, the individual passages and the common passage are filled with a predetermined preservation solution until the liquid ejection head is put into actual use. Such a preservation solution is used for preventing air from being trapped into the passages in the liquid ejection head, particularly in the individual passages when the liquid ejection head is put into actual use.

When the liquid ejection head is actually used, it is necessary to discharge the preservation solution from the liquid ejection head. In this preservation solution discharge operation, it is necessary to discharge with certainty the preservation solution stored in the liquid ejection head and piping around the liquid ejection head. If the preservation solution remains, the ink will be diluted by the preservation solution. It is also important that the operability of a discharge operation is favorable. For example, in a case where an operation is necessary to connect a dedicated pipe exclusively used for discharging the preservation solution to the liquid ejection head, it is not reasonable to admit that the operability of the discharge operation is favorable.

SUMMARY OF INVENTION

It is an object of the present invention is to provide a liquid ejection device capable of reliably discharging the liquid from a liquid ejection head prefilled with a liquid such as a preservation solution with favorable operability.

A liquid ejection device according to one aspect of the present invention includes: a liquid ejection head which ejects a predetermined first liquid; and a liquid supply unit which supplies the first liquid from a liquid storage container for storing the first liquid to the liquid ejection head. The liquid ejection head includes: a plurality of liquid discharge holes; individual passages for individually supplying the first liquid to each of the liquid discharge holes, and a common passage for supplying the first liquid to the individual passages. The individual passages and the common passage are filled with a second liquid different from the first liquid prior to an actual use of the liquid ejection head.

The liquid supply unit includes: a pressure chamber capable of storing the first liquid; a first supply passage which makes the liquid storage container communicate with the pressure chamber; a second supply passage which makes an upstream side of the common passage communicate with the pressure chamber; a liquid drain path which makes a downstream side of the common passage communicate with the second supply passage; and a pump mechanism capable of delivering the first liquid from the liquid storage container to the liquid ejection head through the first supply passage and the second supply passage. The pump mechanism is capable of, prior to the actual use of the liquid ejection head, supplying the first liquid to the upstream side and the downstream side of the common passage through the second supply passage and the liquid drain path, and discharging the second liquid from the liquid discharge holes.

BRIEF DESCRIPTION OF DRAWINGS

FIGS. 6A and 6B are diagrams schematically showing a cross section of the head unit in the front-rear direction, wherein FIG. 6A shows a state where a print mode is being performed, and FIG. 6B shows a state where a circulation mode is being performed.

FIGS. 10A and 10B are perspective views of a liquid supply unit, wherein FIG. 10A is a perspective view as viewed from a first chamber side, and FIG. 10B is a perspective view as viewed from a second chamber side.

DESCRIPTION OF EMBODIMENTS [Overall Configuration of Printer]

Figure 1:
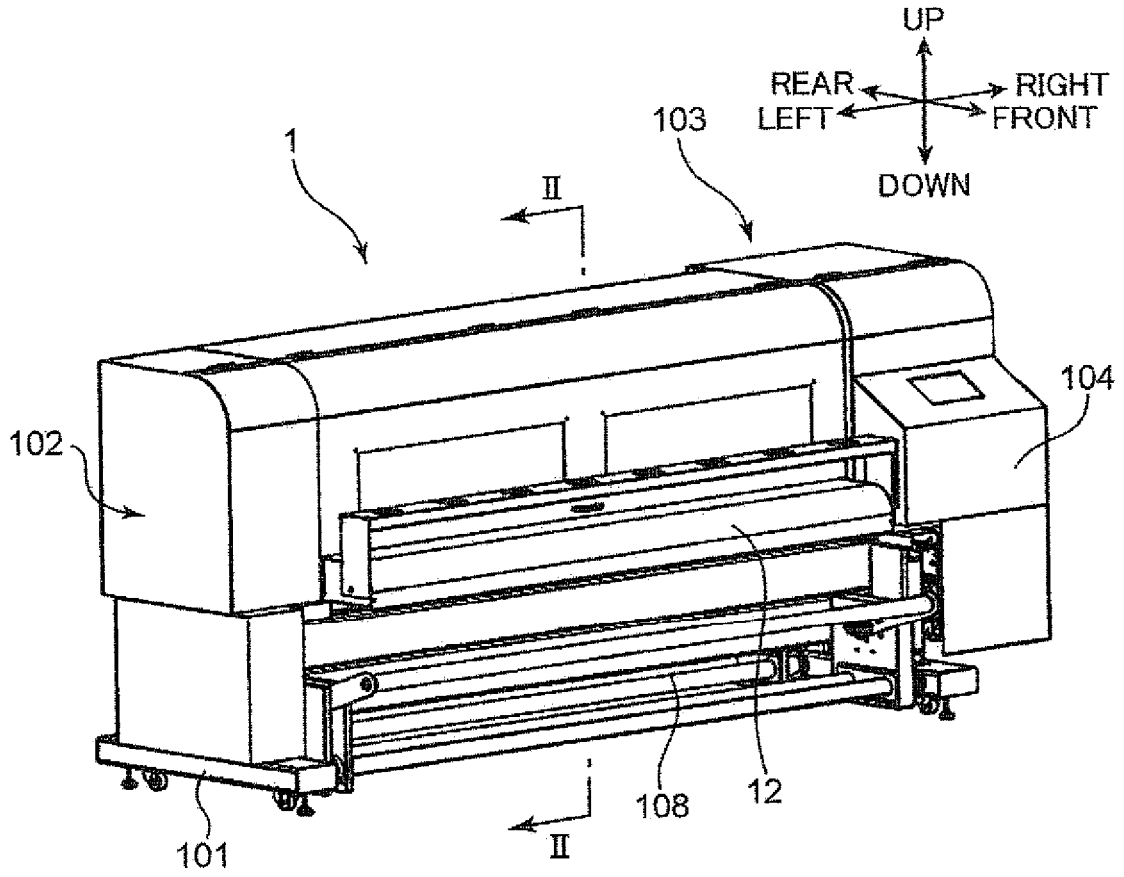
FIG. 1 is a perspective view showing the external appearance of an inkjet printer to which the present invention is applied.
Figure 2:
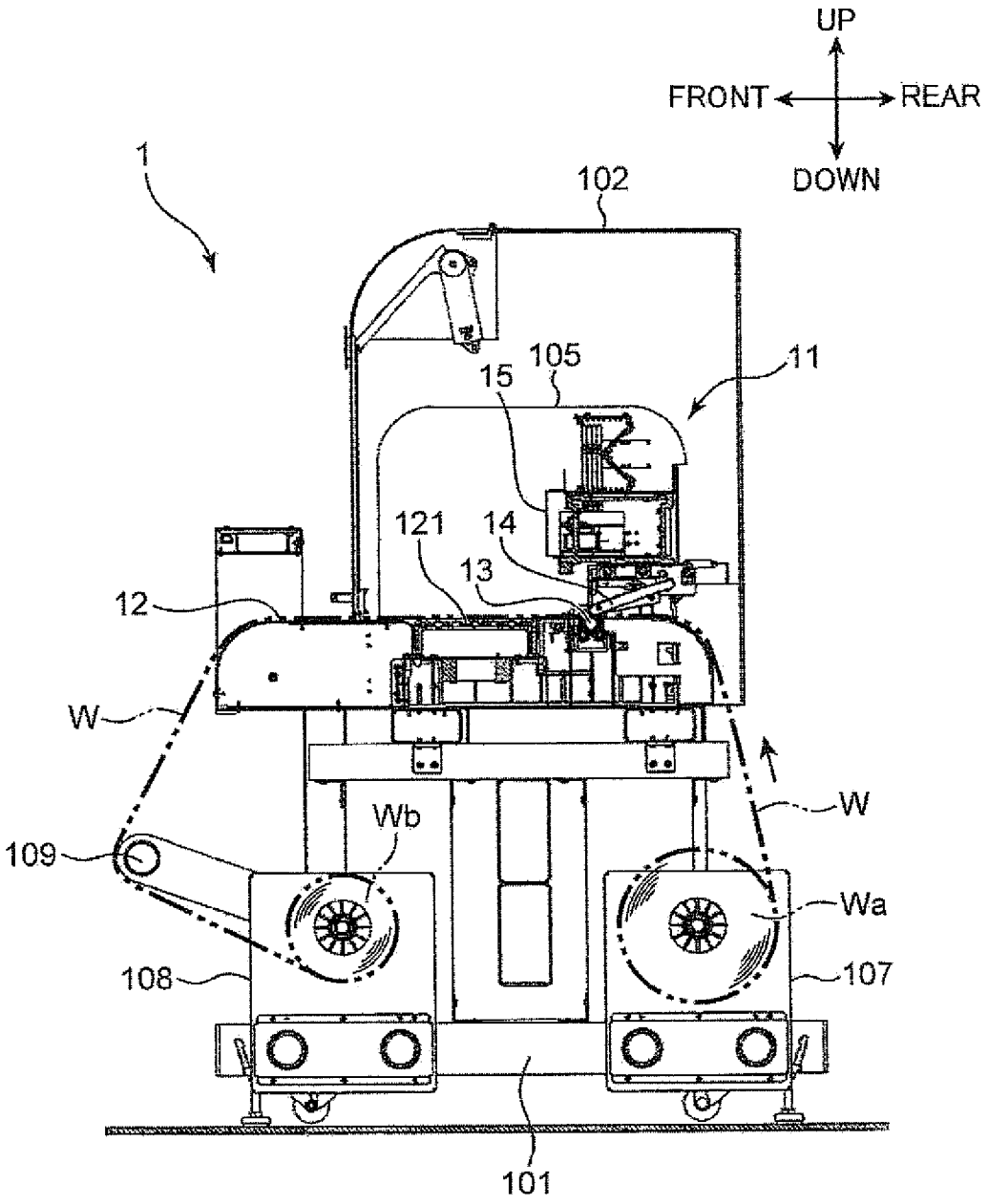
FIG. 2 is a cross-sectional view taken along line II-II in FIG. 1.
Figure 3:
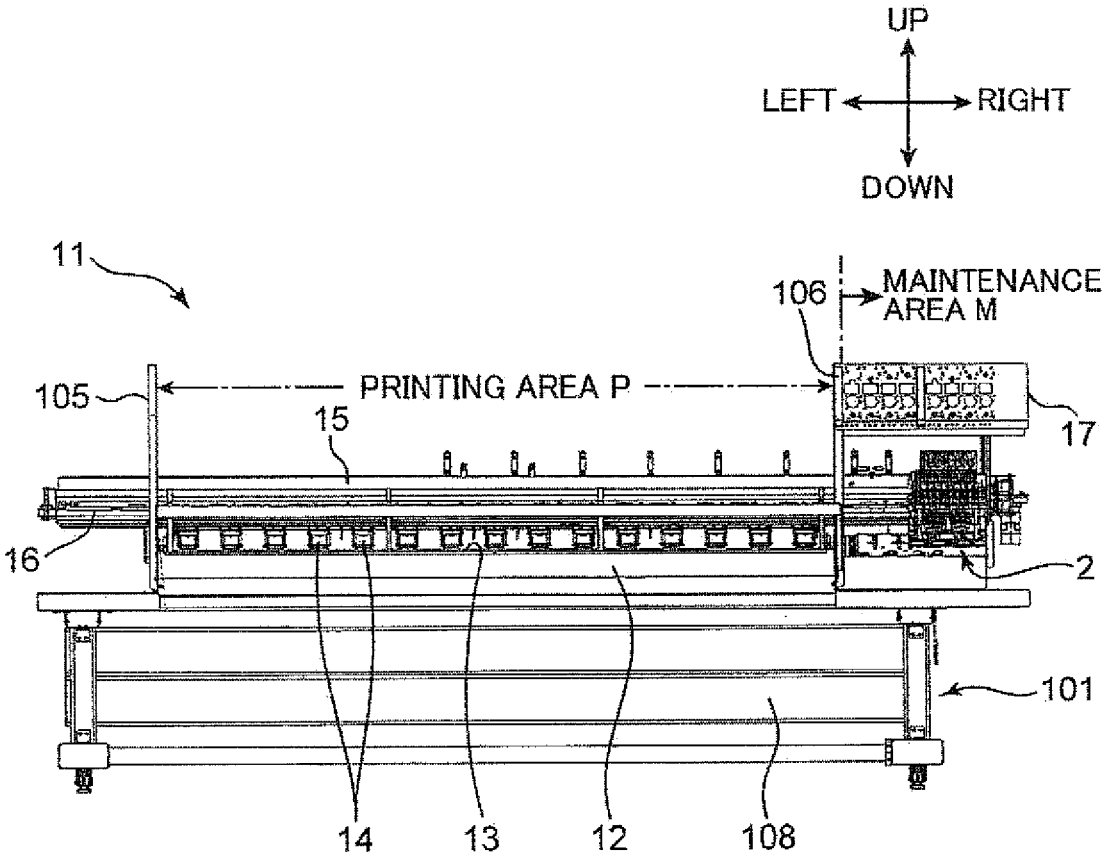
FIG. 3 is a front view of the inkjet printer with an outer cover removed.

Hereinafter, one embodiment of the present invention is described with reference to the drawings. First, an inkjet printer to which a liquid supply unit or a liquid ejection device according to the present invention is applied will be described. FIG. 1 is a perspective view showing the external appearance of an inkjet printer 1 according to the embodiment, FIG. 2 is a cross-sectional view taken along line II-II of FIG. 1, and FIG. 3 is a front view of the printer 1 with an outer cover 102 removed. Note that, although the indication of directions "front", "rear", "left", "right", "up" and "down" are used in FIGS. 1 to 3 and figures described later, such indication is used only for the convenience of the description and is not intended to limit directions at all.

The printer 1 (liquid ejection device) is a printer for performing a printing process such as printing characters or printing images on various works W such as paper sheets, resin sheets or cloth fabrics of various sizes by an inkjet method. The printer 1 is a printer particularly suitable for performing a printing process on large-sized and long works. The printer 1 includes: a base frame 101 having casters; and an apparatus body 11 placed on the base frame 101 and configured to perform the printing process.

The apparatus body 11 includes a work conveyance path 12, a conveyor roller 13, a pinch roller unit 14 and a carriage 2. The work conveyance path 12 is a conveyance path extending in a front-rear direction for loading a work W, to which the printing process is to be applied, into the apparatus body 11 from a rear side and unloading the work W from a front side. The conveyor roller 13 is a roller extending in a lateral direction and is configured to generate a drive force for intermittently feeding the work W along the work conveyance path 12. The pinch roller unit 14 is disposed to face the conveyor roller 13 from above. The pinch roller unit 14 includes a pinch roller which forms conveyance nips together with the conveyor roller 13. A plurality of the pinch roller units 14 are disposed at a predetermined interval in the lateral direction.

The carriage 2 is a movable body on which units for performing the printing process on the work W are mounted. The carriage 2 is movable in a reciprocating manner on the base frame 101 in the lateral direction. A carriage guide 15 with a guide rail which guides reciprocating movement of the carriage 2 is mounted on a rear side of the base frame 101 in an upright manner. The carriage guide 15 extends in the lateral direction. A timing belt 16 is assembled to the carriage guide 15 such that the timing belt 16 can perform a circulating movement in the lateral direction. The carriage 2 includes a fixing portion by which the carriage 2 is fixed to the timing belt 16. The carriage 2 moves in the lateral direction while being guided by the guide rail as the timing belt 16 circulates in a forward or reverse direction.

The printing process is performed in the following mode. The conveyor roller 13 and the pinch roller units 14 intermittently feed the work W. The carriage 2 moves in the lateral direction while the work W is stopped, and performs printing by scanning on the work W (ejecting ink to the work W). Note that, in the work conveyance path 12, a platen 121 (see FIG. 2) additionally provided with a function of sucking the work W is disposed below a passage path of the carriage 2. During the printing process, the carriage 2 performs printing by scanning on the work W in a state where the work W is sucked to the platen 121.

The apparatus body 11 is covered by an outer cover 102. A side station 103 is disposed in a region on a right side of the outer cover 102. An immovable ink cartridge shelf 17 is accommodated in the side station 103. The ink cartridge shelf 17 holds ink cartridges IC (FIG. 5) for storing inks (predetermined first liquid) for a printing process.

A front part of the side station 103 is a carriage retraction area 104 serving as a retraction space for the carriage 2. As shown in FIG. 3, a left frame 105 and a right frame 106 are mounted on the base frame 101 in an upright manner. The left frame 105 and the right frame 106 are spaced apart from each other in the lateral direction by a distance which corresponds to the work conveyance path 12. In terms of work regions formed by division, a region formed between these left and right frames 105, 106 serves as a printing area P (processing area) where the printing process can be performed. The carriage guide 15 has a lateral width longer than the printing area P, and the carriage 2 is movable to an outer side of the printing area P on a right side. A right end side of the carriage guide 15, that is, a region disposed on the right side of and adjacent to the printing area P is a maintenance area M. When the printing process is not performed, the carriage 2 is retracted to the maintenance area M (carriage retraction area 104). Further, a pressurized purge process which will be described later is also performed in this carriage retraction area 104.

A feeding unit 107 which accommodates a feed roll Wa is disposed on a rear side of the base frame 101. The feed roll Wa is a winding body of the work W to be subjected to a printing process. Further, a winding unit 108 is provided on a front side of the base frame 101. The winding unit 108 accommodates a winding roll Wb, which is a winding body of the work W after the printing process. The winding unit 108 includes a drive source (not illustrated) which rotationally drives a winding shaft of the winding roll Wb. The winding unit 108 winds the work W while applying a predetermined tension to the work W by a tension roller 109.

[Configuration of Carriage]

Figure 4:
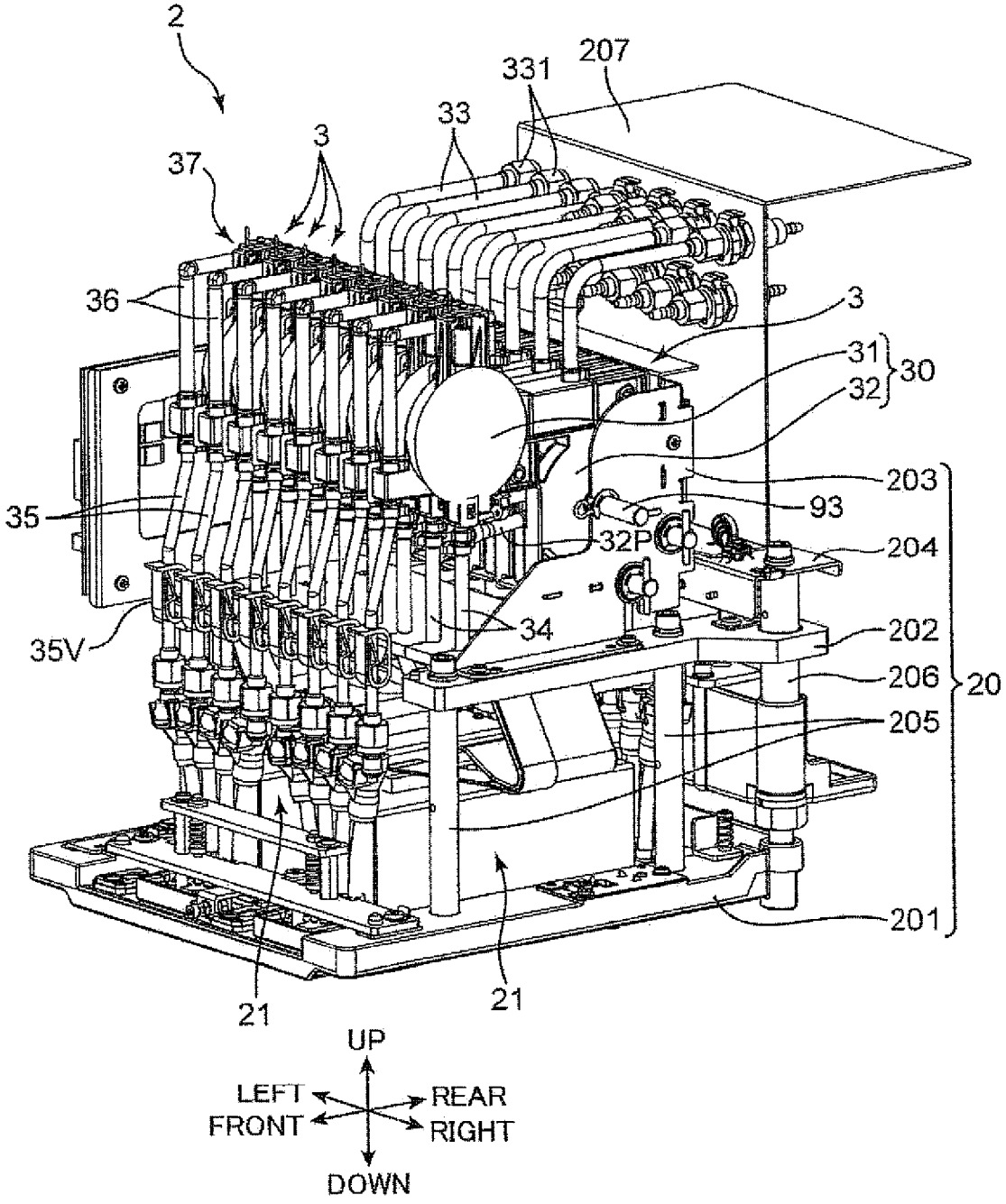
FIG. 4 is an overall perspective view of a carriage mounted in the inkjet printer.

FIG. 4 is an overall perspective view of the carriage 2. Head units 21 (liquid ejection heads) and liquid supply units 3 are mounted on the carriage 2. The head units 21 eject ink (first liquid) to the work W. The liquid supply units 3 supply the inks from the ink cartridges IC (FIG. 5) to the head units 21. FIG. 4 shows an example where two head units 21 and eight liquid supply units 3 are mounted on the carriage 2. Specifically, four liquid supply units 3 are mounted on each head unit 21 to supply respective inks of cyan, magenta, yellow and black per one head unit 21. Note that inks of different colors are filled into each liquid supply unit 3, and inks of at most eight colors may be ejected from the two head units 21.

The carriage 2 includes the head units 21, and a carriage frame 20 which holds the head units 21. The carriage frame 20 includes: a lower frame 201 positioned at a lowermost position; an upper frame 202 disposed above in a spaced apart manner from the lower frame 201; a rack 203 mounted on an upper surface of the upper frame 202; and a back surface frame 204 mounted on a rear surface of the upper frame 202. The lower frame 201 and the upper frame 202 are connected by connecting support columns 205 extending in the vertical direction. A ball screw mechanism (not illustrated) is mounted on the back surface frame 204, and a nut portion driven by the ball screw is mounted on the lower frame 201. Further, guiding support columns 206 which extend in the vertical direction are mounted on the back surface frame 204. When the ball screw mechanism is driven, a connected body formed of the lower frame 201 and the upper frame 202 can move in the vertical direction while being guided by the guiding support columns 206. That is, a body part of the carriage 2 is movable in the vertical direction with respect to the back surface frame 204. Further, a back surface plate 207 is mounted on the back surface frame 204 in an upright manner. Upstream ends 331 of upstream pipes 33 described later are mounted on the back surface plate 207.

The head units 21 are mounted on the lower frame 201. A body part of the carriage 2 is movable in the vertical direction as described above. Accordingly, height positions of the head units 21 in the vertical direction with respect to the work W are adjustable. The liquid supply units 3 are mounted on the upper frame 202. Eight liquid supply units 3 are supported on the upper frame 202 in a state where the liquid supply units 3 are disposed in a row in the left-and right direction in the rack 203. A guided portion to be guided by the guide rail of the carriage guide 15, a fixing portion fixed to the timing belt 16 and the like are disposed on the back surface frame 204.

Figure 5:
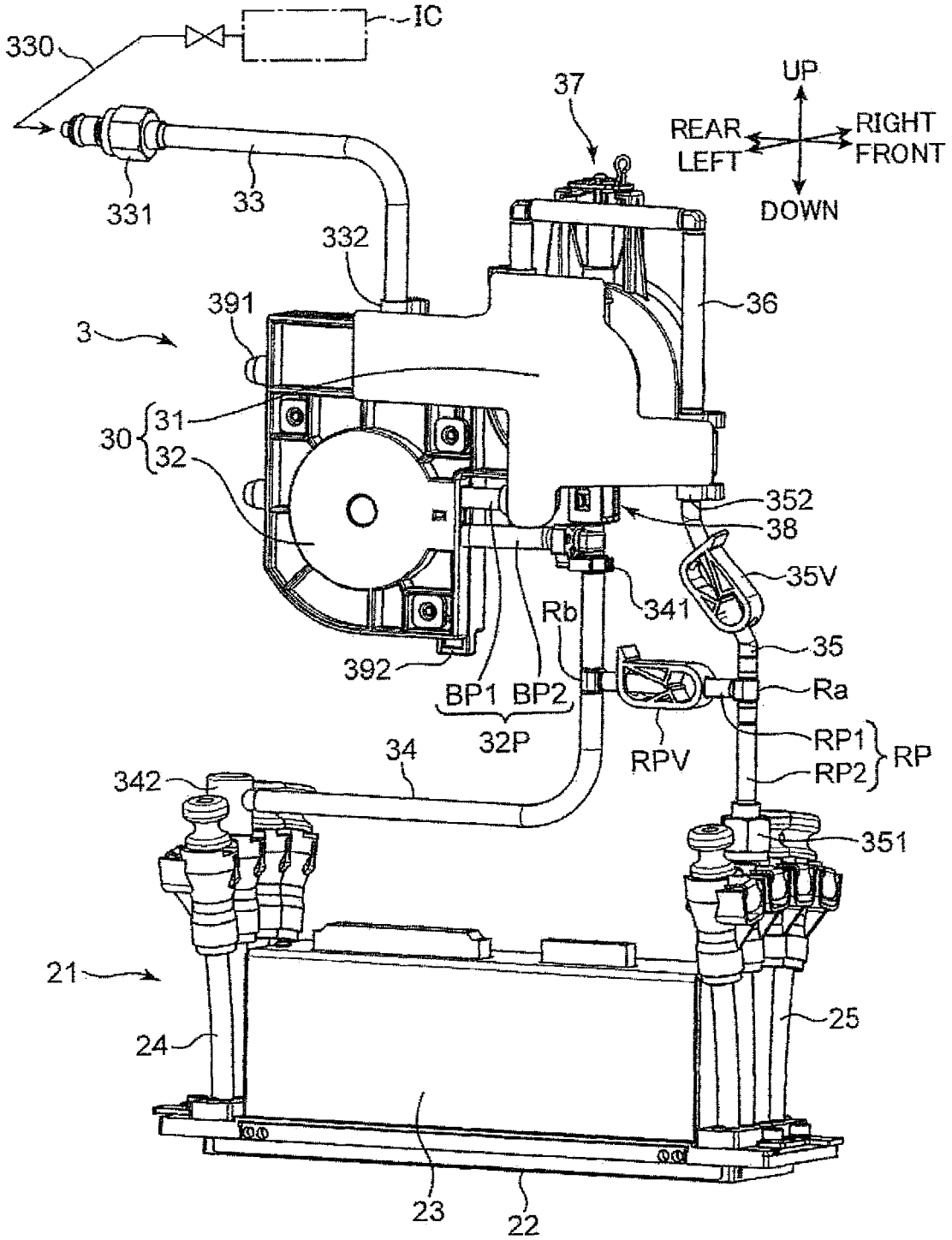
FIG. 5 is a perspective view showing one liquid supply unit and a head unit.

FIG. 5 is a perspective view showing one liquid supply unit 3 and one head unit 21. The liquid supply unit 3 includes: a body portion 30 with a tank portion 31 and a pump portion 32; an upstream pipe 33 (one of the first supply passages) disposed on an upstream side of the body portion 30 in the ink supply direction (liquid supply direction); a downstream pipe 34 (a part of the second supply passage) disposed on a downstream side of the body portion 30; a return pipe 35 (return path) serving as a path for returning ink from a head unit 21 side to a liquid supply unit 3 side; a liquid drain pipe RP (a liquid drain path) short-circuits the downstream pipe 34 and the return pipe 35 to each other; a monitor pipe 36, and a bypass pipe 32P (bypass supply passage).

The tank portion 31 is a region which forms a space for temporarily storing ink to be supplied to the head unit 21 under a negative pressure environment. The pump portion 32 is a region where a pump 9 (pump mechanism, FIG. 7 to FIG. 9B) which is operated at the time of performing the following processing is stored. Such processing includes: discharging a preservation solution (a second liquid different from a first liquid) filled in the head unit 21 at an initial use time; the depressurization processing for forming the negative pressure environment; the pressure purge processing for cleaning the head unit 21 (ink ejecting portion 22); and the circulation processing for circulating ink between the head unit 21 and the liquid supply unit 3.

The upstream pipe 33 is a supply pipe which makes the tank portion 31 (second chamber 42) communicate with an ink cartridge IC (liquid storage container). An upstream end 331 of the upstream pipe 33 is connected to a terminal end part of a tube 330 extending from the ink cartridge IC, and a downstream end 332 of the upstream pipe 33 is connected to an inlet part of the tank portion 31. A supply valve 33V (a first valve element) functioning to open and close the upstream pipe 33 is mounted in the tube 330. When the supply valve 33V is opened, ink can be supplied from the ink cartridge IC to the tank portion 31. When the supply valve 33V is closed, the supply cannot be made. The downstream pipe 34 is a supply pipe allowing communication between the tank portion 31 (second chamber 42) and the head unit 21. An upstream end 341 of the downstream pipe 34 is connected to an outlet part of the tank portion 31 via a backflow prevention mechanism portion 38, and a downstream end 342 is connected to the head unit 21.

The return pipe 35 is a pipe which makes the head unit 21 (a downstream side of a common passage 27 described later) communicate with the tank portion 31 (the second chamber 42). An upstream end 351 of the return pipe 35 is connected to the head unit 21, and a downstream end 352 is connected to the tank portion 31. A first clip 35V (a second valve element) for opening and closing the return pipe 35 is mounted on the return pipe 35. FIG. 5 shows a state where the first clip 35V collapses the return pipe 35 to close the return pipe 35.

The liquid drain pipe RP is a pipe which makes the head unit 21 communicate with the downstream pipe 34. The liquid drain pipe RP is a pipe which shares a part of a route in common with the return pipe 35, and is formed of a bridge portion RP1 and a common portion RP2. The bridge portion RP1 is a portion which makes the downstream pipe 34 communicate with the return pipe 35. One end side of the bridge portion RP1 is connected to the return pipe 35 so as to form a first T branch portion Ra. The other end side of the bridge portion RP1 is connected to the downstream pipe 34 so as to form a second T branch portion Rb. A common portion RP2 is a portion where a part of the return pipe 35 from the place where the bridge portion RP1 is connected to the head unit 21 (a downstream side of the common passage 27) is shared in common. A second clip RPV (a third valve element) for opening and closing the liquid drain pipe RP is mounted on the liquid drain pipe RP. FIG. 5 shows a state where the second clip 35V collapses the liquid drain pipe RP to close the liquid drain pipe RP.

The monitor pipe 36 is a pipe for indicating an ink level in the tank portion 31. A bypass pipe 32P is a conduit for feeding the ink to the downstream pipe 34 without via the negative pressure environment (the second chamber 42) of the tank portion 31. The bypass pipe 32P includes: an upstream bypass pipe BP1 disposed upstream of the pump portion 32; and a downstream bypass pipe BP2 disposed downstream of the pump portion 32.

The head unit 21 includes an ink ejecting portion 22, a control unit 23, an end tube 24 and a recovery tube 25. The ink ejecting portion 22 is a nozzle part for ejecting ink droplets toward the work W. A piezo method using a piezo element, a thermal method using a heating element or the like can be adopted as a method for ejecting ink droplets in the ink ejecting portion 22. The control unit 23 includes a control board for controlling the piezo element or the heating element provided in the ink ejecting portion 22, and controls an operation of ejecting ink droplets from the ink ejecting portion 22.

The end tube 24 is a tube connecting a downstream end 342 of the downstream pipe 34 and the ink ejecting portion 22 to each other. The downstream end 342 is a cap-type socket, and is attachable to an upper end fitting part of the end tube 24 in a single operation. The recovery tube 25 is a tube connecting the ink ejecting portion 22 and the upstream end 351 of the return pipe 35 to each other. Note that the recovery tube 25 is used also to discharge a preservation solution sealed in the liquid supply unit 3 at an initial use time. That is, the recovery tube 25 forms: a part of the return path for returning the ink from a head unit 21 side to a liquid supply unit 3 side; and a part of the liquid drain path for discharging a preservation solution through the liquid drain pipe RP.

Figure 6A:
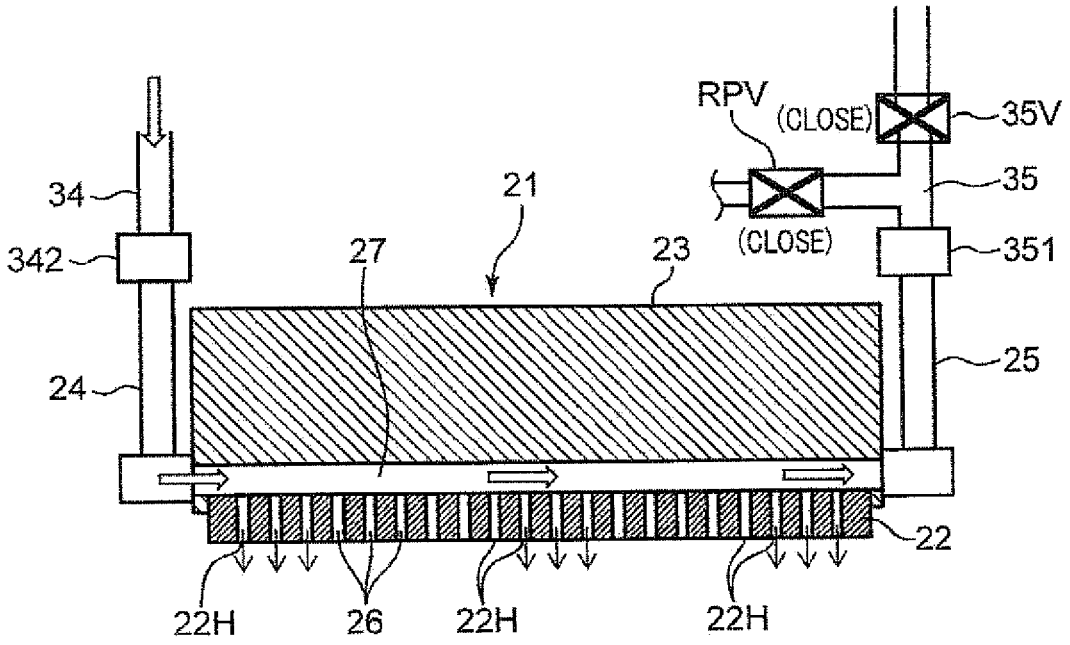
Figure 6B:
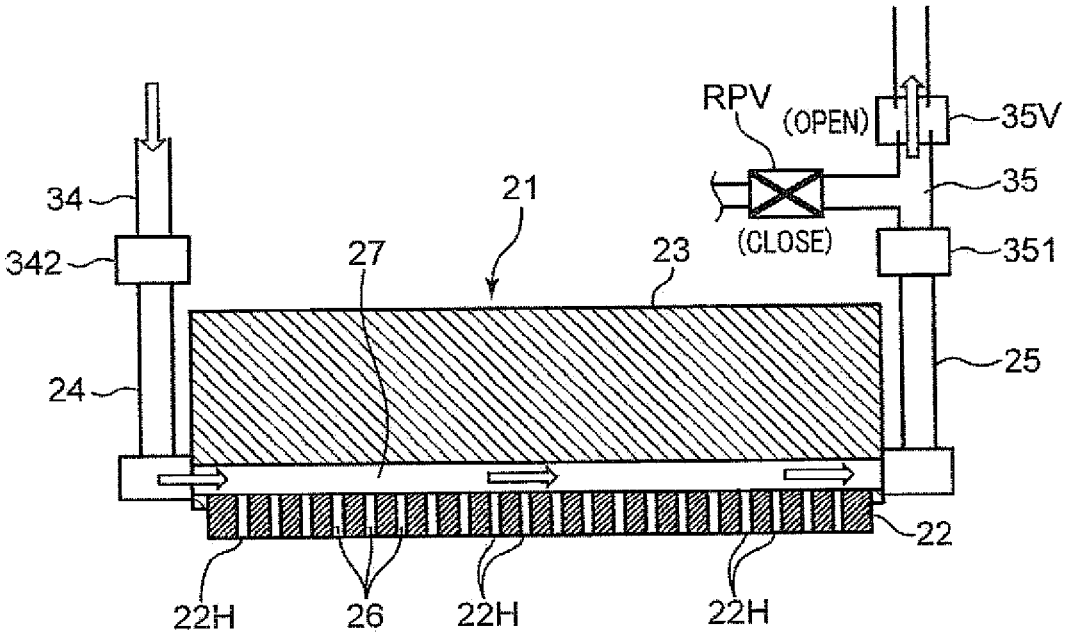

FIGS. 6A and 6B are views schematically showing a cross section of the head unit 21 in the front-rear direction, wherein FIG. 6A shows a state where the clip 35V is closed (a print mode described later) and FIG. 6B shows a state where the clip 35V is opened (a circulation mode). The ink ejecting portion 22 includes a plurality of ink discharge holes 22H (liquid discharge holes) for ejecting ink (first liquid) toward the work W. Individual passages 26 for individually supplying the ink to the ink discharge holes 22H and a common passage 27 for supplying the ink to these individual passages 26 are provided in the head unit 21. Before the head unit 21 is actually used, the individual passages 26 and the common passages 27 are filled with a preservation solution (second liquid) for preventing air from being trapped in these passages.

The common passage 27 is an ink passage extending in a horizontal direction. An upstream end of each individual passage 26 communicates with the common passage 27. A downstream end 342 of the downstream pipe 34 communicates with an upstream side of the common passage 27 via the end tube 24. The upstream end 351 of the return pipe 35 communicates with a downstream side of the common passage 27 via the recovery tube 25. In other words, the upstream side of the common passage 27 communicates with the tank portion 31 (second chamber 42) through the downstream pipe 34, and the downstream side of the common passage 27 communicates with the tank portion 31 (second chamber 42) through the return pipe 35. One end of the liquid drain pipe RP also communicates with the downstream side of the common passage 27 from the first T branch portion Ra via a part of the return pipe 35 (the common portion RP2) and the end tube 24.

As shown in FIG. 6A, when ink is supplied to the head unit 21 from the downstream pipe 34 with the return pipe 35 closed by the clip 35V, the ink passes through the common passage 27 and each individual passage 26, and is ejected from the ink discharge hole 22H. On the other hand, as shown in FIG. 6B, when ink is supplied to the head unit 21 from the downstream pipe 34 in a state where the clip 35V is released so that the return pipe 35 is opened, the ink returns to the tank portion 31 exclusively through the return pipe 35. In this case, if the return pipe 35 is set to a negative pressure, the ink does not leak from the ink discharge holes 22H.

[Overall Structure of Liquid Supply System]

In this embodiment, the device is configured such that the ink cartridge IC is disposed above the head unit 21 and ink is supplied to the head unit 21 by a water head difference. In the case of supplying the ink by the water head difference, when the ink is supplied at a normal pressure, the ink is constantly ejected from the ink ejecting portion 22 of the head unit 21. Accordingly, it is necessary to set a pressure in the ink ejecting portion 22 to a suitable negative pressure by providing a negative pressure generating portion for generating a negative pressure environment in the ink supply passage. The tank portion 31 of the liquid supply unit 3 functions as the above negative pressure generating portion.

Figure 7:
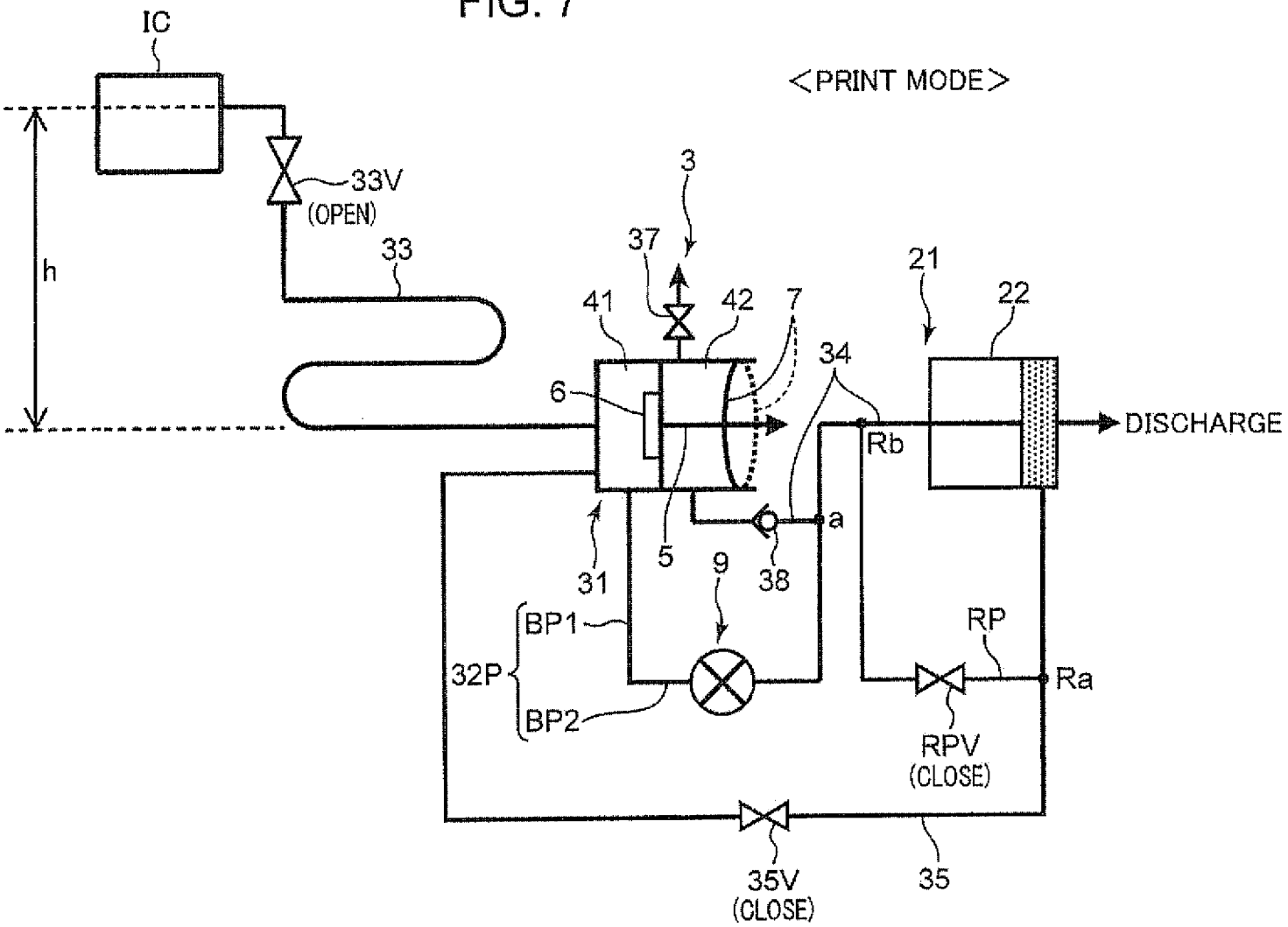
FIG. 7 is a block diagram of a liquid supply system in the embodiment showing the state where the print mode is being performed.

FIG. 7 is a block diagram schematically showing the liquid supply system adopted in the carriage 2 of this embodiment. The ink cartridge IC is disposed at a position higher than the ink ejecting portion 22 by a height h. This height h serves as the water head difference, and the ink in the ink cartridge IC is supplied to the head unit 21 by this water head difference. The liquid supply unit 3 is assembled to an intermediate portion of the ink supply passage between the ink cartridge IC and the head unit 21. The tank portion 31 of the liquid supply unit 3 includes a first chamber 41 (an upstream chamber/a part of the first supply passage) and a second chamber 42 (pressure chamber). In the first chamber 41, a pressure is set higher than an atmospheric pressure by receiving the water head difference. The second chamber 42 is disposed downstream of the first chamber 41 in the ink supply direction, and a pressure in the second chamber 42 is set to a negative pressure. The first chamber 41 is a chamber where a negative pressure operation is not performed and to which a pressure P by the water head difference is applied in addition to the atmospheric pressure. This pressure P is expressed by $P=\rho gh$ [Pa] when $\rho$ denotes water density (ink can be handled equivalent to water in density), g denotes a gravitational acceleration and h denotes the water head difference. The first chamber 41 communicates with the ink cartridge IC via the upstream pipe 33. The second chamber 42 communicates with the ink ejecting portion 22 via the downstream pipe 34.

An on-off valve 6 (open/close member) which is connected to a pressing member 5 is disposed on a wall portion partitioning between the first chamber 41 and the second chamber 42. Further, a portion of a wall portion defining the second chamber 42 is formed of an atmospheric pressure detection film 7 (flexible film member). When a pressure in the second chamber 42 reaches a negative pressure exceeding a predetermined threshold value, the atmospheric pressure detection film 7 detects the atmospheric pressure and is displaced. This displacement force is applied to the pressing member 5, a posture of the connected on-off valve 6 changes from a closing posture to an opening posture, and the first chamber 41 and the second chamber 42 are made to communicate with each other. An ink supply route during a normal printing processing is a route which passes through the upstream pipe 33, the first chamber 41, the second chamber 42 and the downstream pipe 34.

In addition to the above route, a bypass pipe 32P is provided for short-circuiting the first chamber 41 and the downstream pipe 34 without via the second chamber 42. An upstream end of the bypass pipe 32P is connected to the upstream pipe 33 via the first chamber 41 and a downstream end joins with the downstream pipe 34 (a joint part a). The pump 9 capable of rotating in forward and reverse directions is disposed on the bypass pipe 32P. In addition, the return pipe 35 and the liquid drain pipe RP are provided. The return pipe 35 makes the ink ejecting portion 22 communicate with the first chamber 41 (also makes the ink ejecting portion 22 communicate with the second chamber 42 via the on-off valve 6), and includes a first clip 35V. The liquid drain pipe RP makes the downstream pipe 34 communicate with the ink ejecting portion 22, and includes a second clip RPV.

FIG. 7 is also a diagram showing a state where the liquid supply system is performing a print mode for performing the printing processing. In this print mode, the supply valve 33V of the upstream pipe 33 is opened. On the other hand, the first clip 35V of the return pipe 35 and the second clip RPV of the liquid drain pipe RP are closed. Further, in the print mode, a predetermined amount of ink is filled in the first chamber 41 and the second chamber 42, and a pressure in the second chamber 42 is set to a predetermined negative pressure. The pressure in the first chamber 41 is an atmospheric pressure+ρgh [Pa] by the water head difference as described above so that the ink can be supplied from the ink cartridge IC by the water head difference any time. As the basic setting of the print mode, the on-off valve 6 is set in a closing posture to set the pressure in the second chamber 42 to a negative pressure, and the first chamber 41 and the second chamber 42 are isolated from each other. The pump 9 is set in a stopped state. The pump 9 is a tube pump, and the bypass pipe 32P is brought into a closed state when the pump 9 is stopped. Thus, the downstream pipe 34 and the ink ejecting portion 22 are also maintained at a negative pressure.

To smoothly fill the ink into the second chamber 42, an air vent mechanism portion 37 is attached to the second chamber 42. A predetermined amount of ink needs to be initially filled into the second chamber 42 at an initial use time, after maintenance or the like. The air vent mechanism portion 37 promotes the above initial filling by making the second chamber 42 set in the negative pressure environment temporarily communicate with the atmosphere (by venting air in the second chamber 42). Further, the ink stored in the second chamber 42 may generate air bubbles as a temperature of the ink becomes high. The air vent mechanism portion 37 is also used in removing air based on the air bubbles from the second chamber 42.

When the head unit 21 operates and the ink ejecting portion 22 ejects ink droplets, the ink in the second chamber 42 is consumed. Corresponding to such consumption of the ink, a degree of the negative pressure in the second chamber 42 progresses. That is, the ink ejecting portion 22 performs, every time ink droplets are ejected, an operation of sucking the ink from the second chamber 42 which is in a state separated from the atmosphere, and enhances a negative pressure degree of the second chamber 42. When the pressure in the second chamber 42 reaches a negative pressure exceeding a predetermined threshold value as the ink in the second chamber 42 decreases, the atmospheric pressure detection film 7 detects an atmospheric pressure as described above and is displaced. By this displacement force, the posture of the on-off valve 6 changes from the closing posture to the opening posture by way of the pressing member 5, and the first and second chambers 41, 42 communicate with each other. Thus, the ink flows from the first chamber 41 into the second chamber 42 due to a pressure difference between the pressures in both chambers.

As the ink flows into the second chamber 42, the negative pressure degree of the second chamber 42 is gradually alleviated and approaches the atmospheric pressure. Simultaneously, the displacement force applied to the pressing member 5 from the atmospheric pressure detection film 7 is also gradually decreased. When the pressure in the second chamber 42 reaches a negative pressure below the predetermined threshold value, the posture of the on-off valve 6 returns to the closing posture, and the first and second chambers 41, 42 are separated from each other again. At this time, the ink is replenished into the first chamber 41 from the ink cartridge IC by the water head difference by an amount of the ink which flows into the second chamber 42 from the first chamber 41. In the print mode, such an operation is repeated.

The liquid supply system of this embodiment is capable of performing a circulation mode, a liquid drain mode, a pressurized purge mode and a decompression mode in addition to the above print mode. The circulation mode is a mode for removing air trapped in the ink passage (individual passages 26, common passage 27) in the head unit 21 by circulating the ink using the return pipe 35. The liquid drain mode is a mode where the preservation solution filled in the ink passage in the head unit 21 is discharged from the head unit 21 at an initial use time of the head unit 21. The pressurized purge mode is a mode for supplying high-pressure ink to the ink ejecting portion 22 and making the ink ejecting portion 22 eject the ink in order to eliminate or prevent ink clogging in the ink ejecting portion 22. The decompression mode is a mode for setting the second chamber 42 at a normal pressure to the predetermined negative pressure at an initial use time or after maintenance or the like.

Figure 8A:
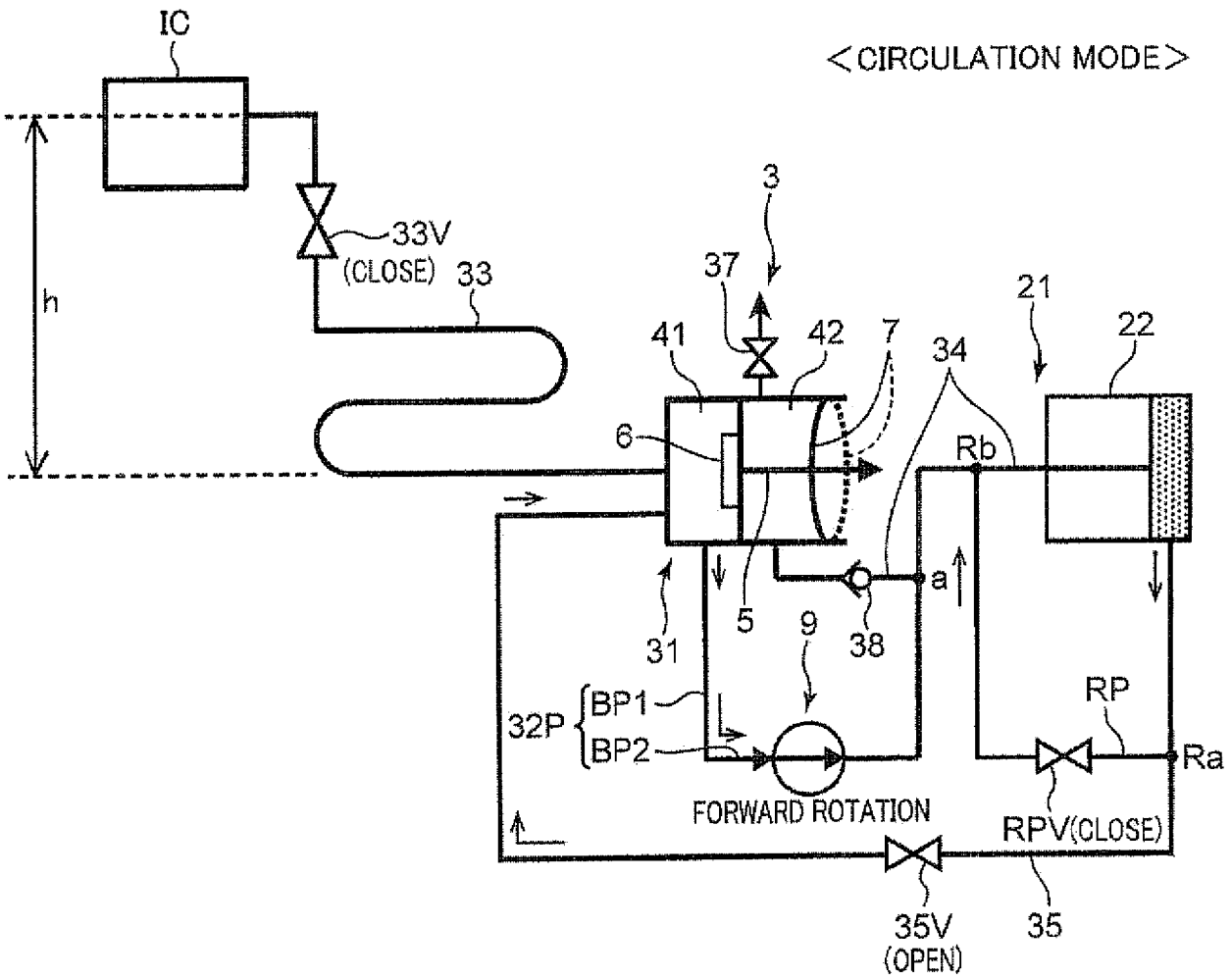
FIG. 8A is a block diagram showing the state where the circulation mode is being performed.

FIG. 8A is a block diagram showing the state where the circulation mode is performed. In this circulation mode, the supply valve 33V and the second clip RPV are closed so that a state is brought about where the upstream pipe 33 and the liquid drain pipe RP are closed. On the other hand, the first clip 35V is opened so that a state is brought about where the return pipe 35 is opened. Further, the pump 9 disposed on the bypass pipe 32P is driven in the forward rotation direction. As shown in FIG. 6, the upstream end 351 of the return pipe 35 communicates with the downstream end of the common passage 27 in the head unit 21. On the other hand, the downstream end 352 of the return pipe 35 communicates with the first chamber 41. Further, the downstream end 352 of the return pipe 35 directly communicates with the first chamber 41, and also communicates with the second chamber 42 via the on-off valve 6.

When the pump 9 is driven in the forward rotation direction in the circulation mode, the ink is circulated through a circulation path formed of the downstream bypass pipe BP2, the downstream pipe 34 downstream of the joint part a, the common passage 27 in the head unit 21, the return pipe 35 and an upstream bypass pipe BP1. At this stage of the operation, since the supply valve 33V is closed, the pressures in the return pipe 35 and the common passage 27 are set to a negative pressure by an ink sucking operation of the pump 9. Accordingly, the ink does not leak from the ink discharge holes 22H. By performing the circulation mode, air taken into the head unit 21 side can be recovered to the liquid supply unit 3 (first chamber 41). In this way, air can be prevented from staying in the individual passages 26 and the ink discharge holes 22H and hence, an ink ejection failure can be suppressed. Note that the air recovered to the first chamber 41 can be transferred to the second chamber 42 through the on-off valve 6. Then, this air is released to the outside by the air vent mechanism portion 37.

Figure 8B:
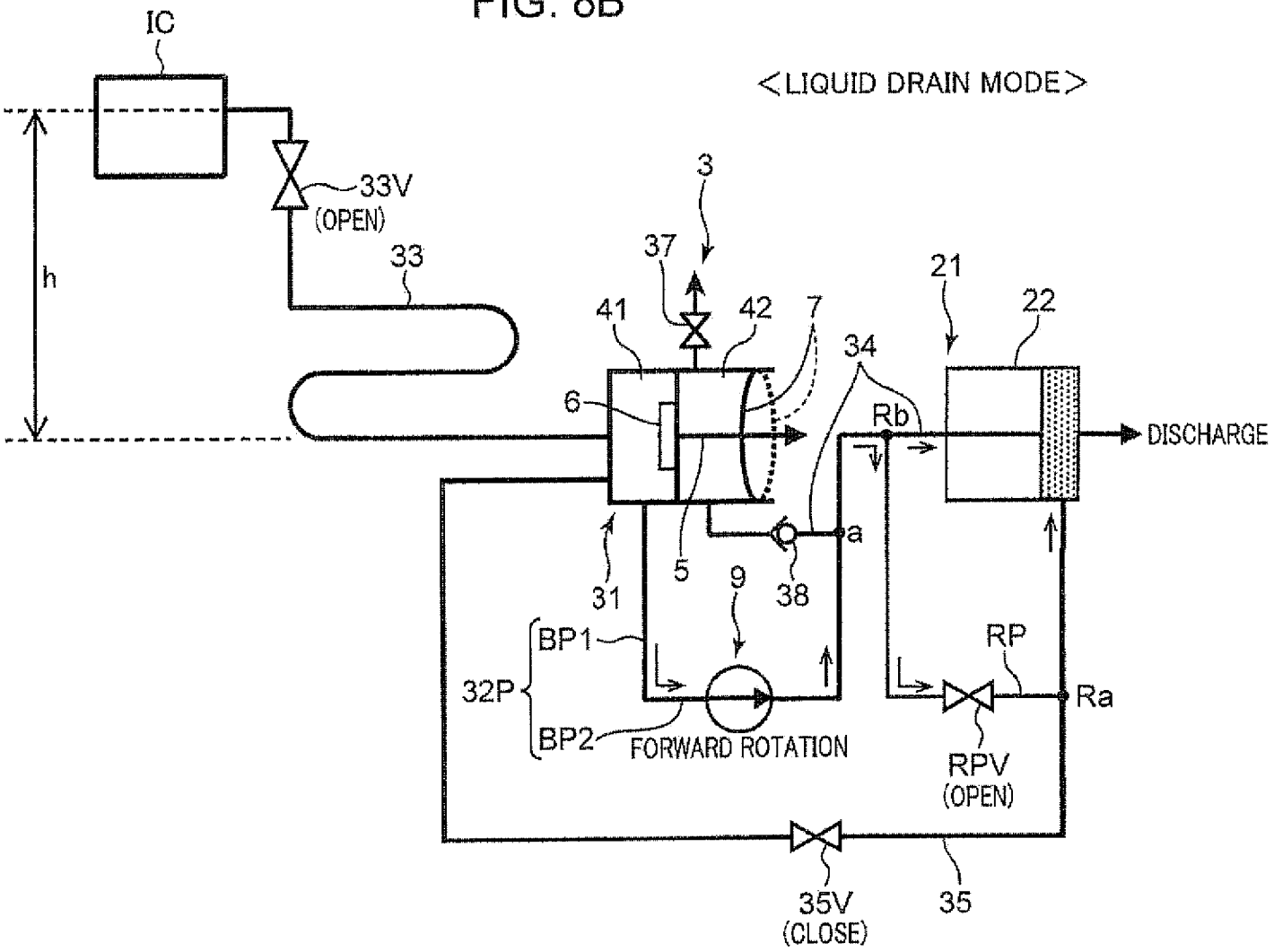
FIG. 8B is a block diagram showing a state where a liquid drain mode is being performed.

FIG. 8B is a block diagram showing the state where the liquid drain mode is being performed. In this liquid drain mode, the first clip 35V is closed so that a state is brought about where the return pipe 35 is closed. On the other hand, the supply valve 33V and the second clip RPV are opened so that a state is brought about where the upstream pipe 33 and the liquid drain pipe RP are opened. The pump 9 is driven in the forward rotation direction. One end side of the liquid drain pipe RP communicates with the downstream end of the common passage 27 in the head unit 21 via a part of the return pipe 35 (common portion RP2), and the other end side of the liquid drain pipe RP communicates with the downstream pipe 34. The downstream end 342 of the downstream pipe 34 communicates with the upstream end of the common passage 27.

When the pump 9 is driven in the forward rotation direction in the liquid drain mode, ink is sucked from the ink cartridge IC, and the ink enters the upstream bypass pipe BP1 of the bypass pipe 32P via the upstream pipe 33 and the first chamber 41. Subsequently, the ink is sent to the downstream bypass pipe BP2 by the pump 9, enters the downstream pipe 34 from the joint part a, and then branches at the second T branch portion Rb and enters the downstream pipe 34 and the liquid drain pipe RP. Then, the ink is supplied from the downstream pipe 34 to the upstream side of the common passage 27 of the head unit 21, and the ink is supplied from the liquid drain pipe RP to the downstream side of the common passage 27 respectively. In this way, by supplying ink from both the upstream side and the downstream side of the common passage 27, the preservation solution filled in the head unit 21 receives a pushing force and is discharged from the ink discharge holes 22H.

Figure 9A:
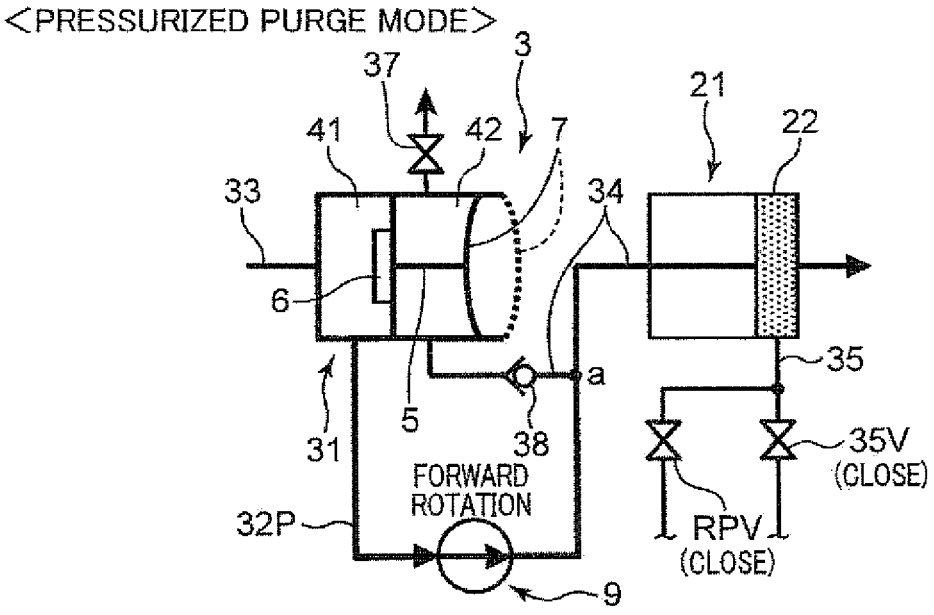
FIG. 9A is a block diagram showing a state where a pressurized purge mode is being performed.

FIG. 9A is a diagram showing a state where the pressurized purge mode is being performed. In the pressurized purge mode, the pump 9 is driven in the forward rotation direction. The first clip 35V and the second clip RPV are closed. By the forward rotation driving of the pump 9, the ink directly moves from the upstream pipe 33 toward the downstream pipe 34 via the first chamber 41 and the bypass pipe 32P while bypassing the second chamber 42. That is, the ink pressurized by the pump 9 is supplied to the ink ejecting portion 22. In this way, the ink is forcibly ejected from the ink ejecting portion 22 so that the ink ejecting portion 22 is cleaned. Note that an operation similar to the operation performed in the pressurized purge mode is also performed at the time of discharging a preservation solution sealed in the liquid supply unit 3 at an initial use time.

The backflow prevention mechanism portion 38 is provided to prevent the pressurized ink from flowing back to the second chamber 42 through the downstream pipe 34 when the pressurized purge mode is performed. The backflow prevention mechanism portion 38 is disposed on the downstream pipe 34 on a side upstream of the joint part a between the downstream pipe 34 and the downstream end of the bypass pipe 32P. The side of the downstream pipe 34 upstream of the joint part a is closed by the backflow prevention mechanism portion 38. Accordingly, all high-pressure ink generated in the bypass pipe 32P flows toward the ink ejecting portion 22. Thus, it is possible to prevent the atmospheric pressure detection film 7 partitioning the second chamber 42 from being broken.

Figure 9B:
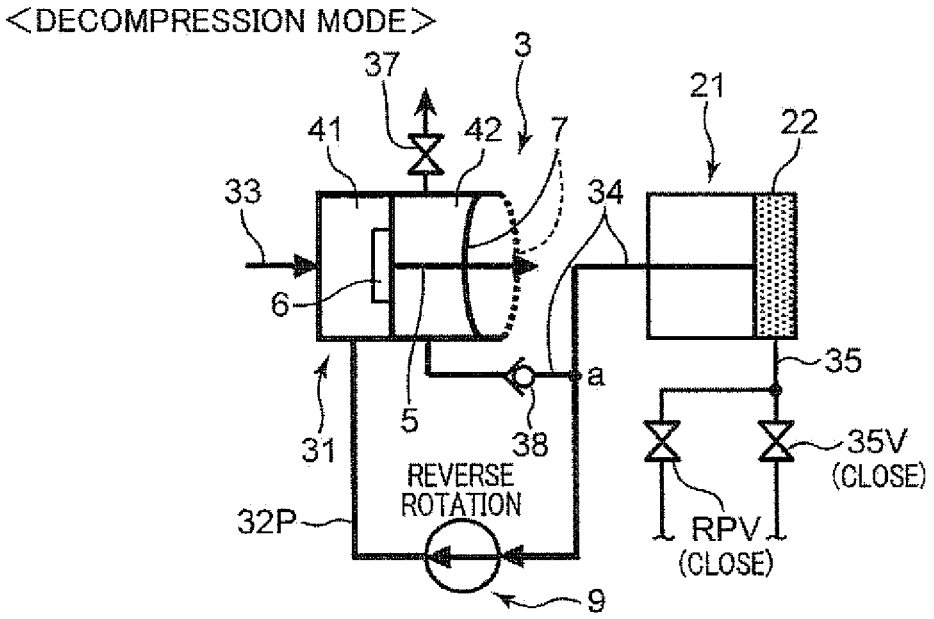
FIG. 9B is a block diagram showing a state where a decompression mode is being performed.

FIG. 9B is a diagram showing a state where the decompression mode is being performed. In the decompression mode, the pump 9 is driven in the reverse rotation direction. The first clip 35V and the second clip RPV are closed. When the pump 9 is driven in the reverse rotation direction, the ink ejecting portion 22 and the second chamber 42 are decompressed through the downstream pipe 34 and the bypass pipe 32P. The ink ejecting portion 22 and the second chamber 42 are set to a predetermined negative pressure by this decompression mode. That is, the ink ejecting portion 22 and the second chamber 42 are set to the negative pressure at which ink droplets do not leak from the ink ejecting portion 22 even when the ink is supplied by the water head difference. Note that when the pressure in the ink ejecting portion 22 is set to an excessive negative pressure, ink ejection generated by driving the piezo element or the like in the ink ejecting portion 22 may be impeded. Thus, the pressures in the ink ejecting portion 22 and the second chamber 42 are desirably set, for example, to a weak negative pressure of about −0.2 to −0.7 kPa.

[Overall Structure of Liquid Supply Unit]

Figure 10A:
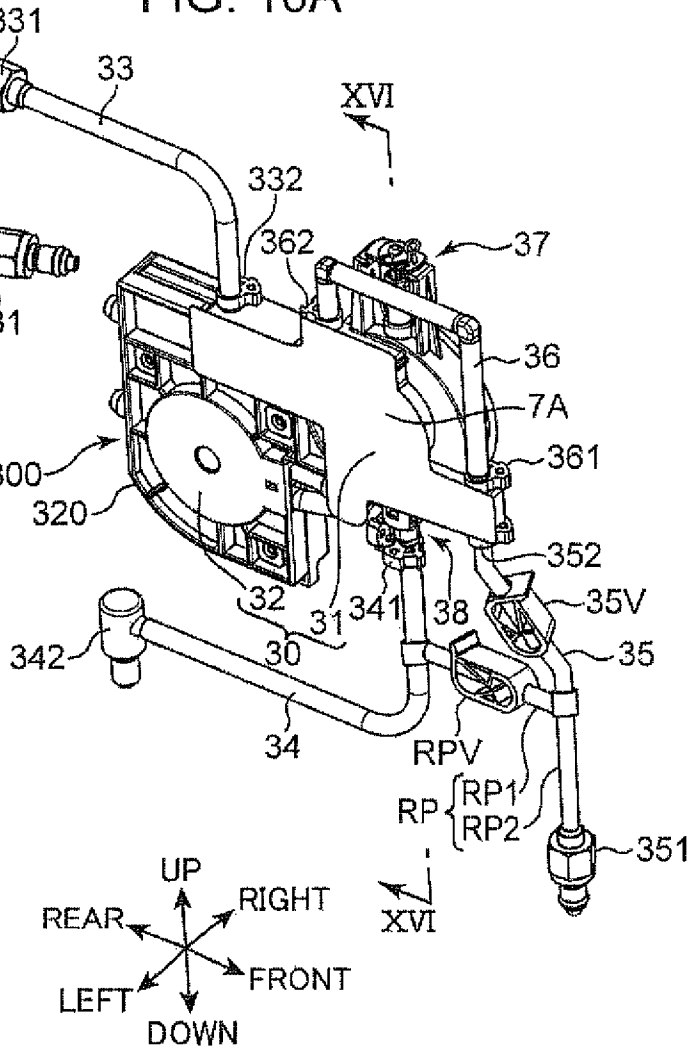
Figure 10B:
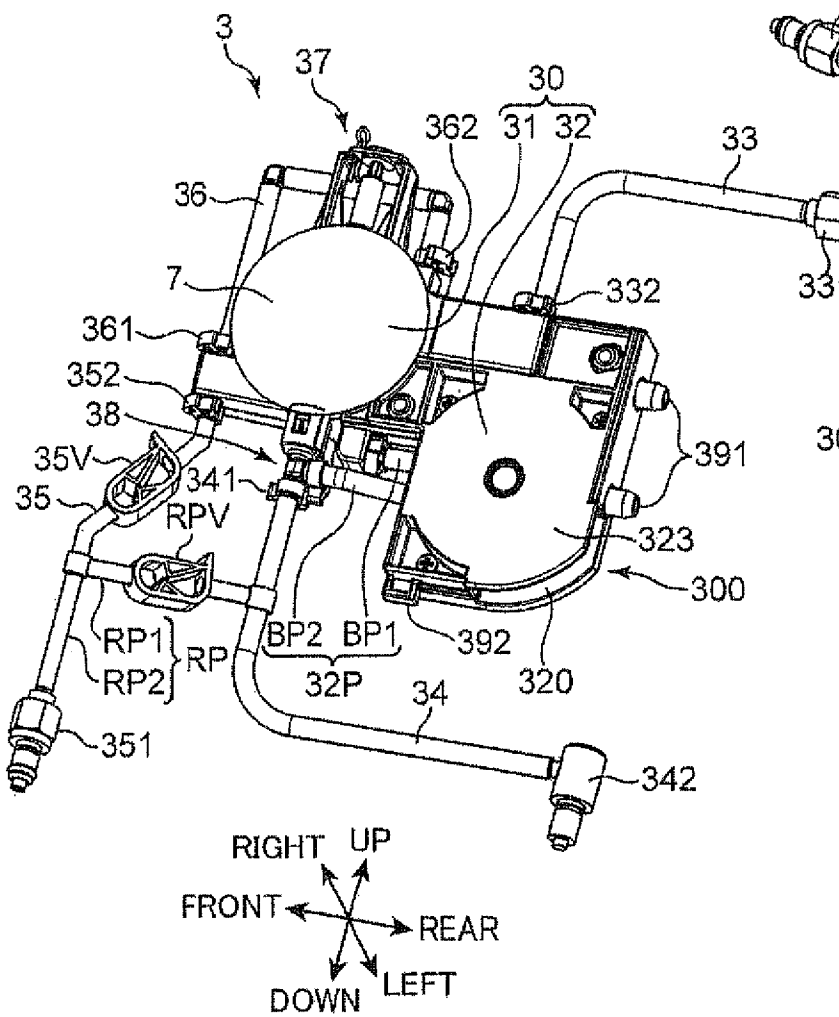
Figure 11:
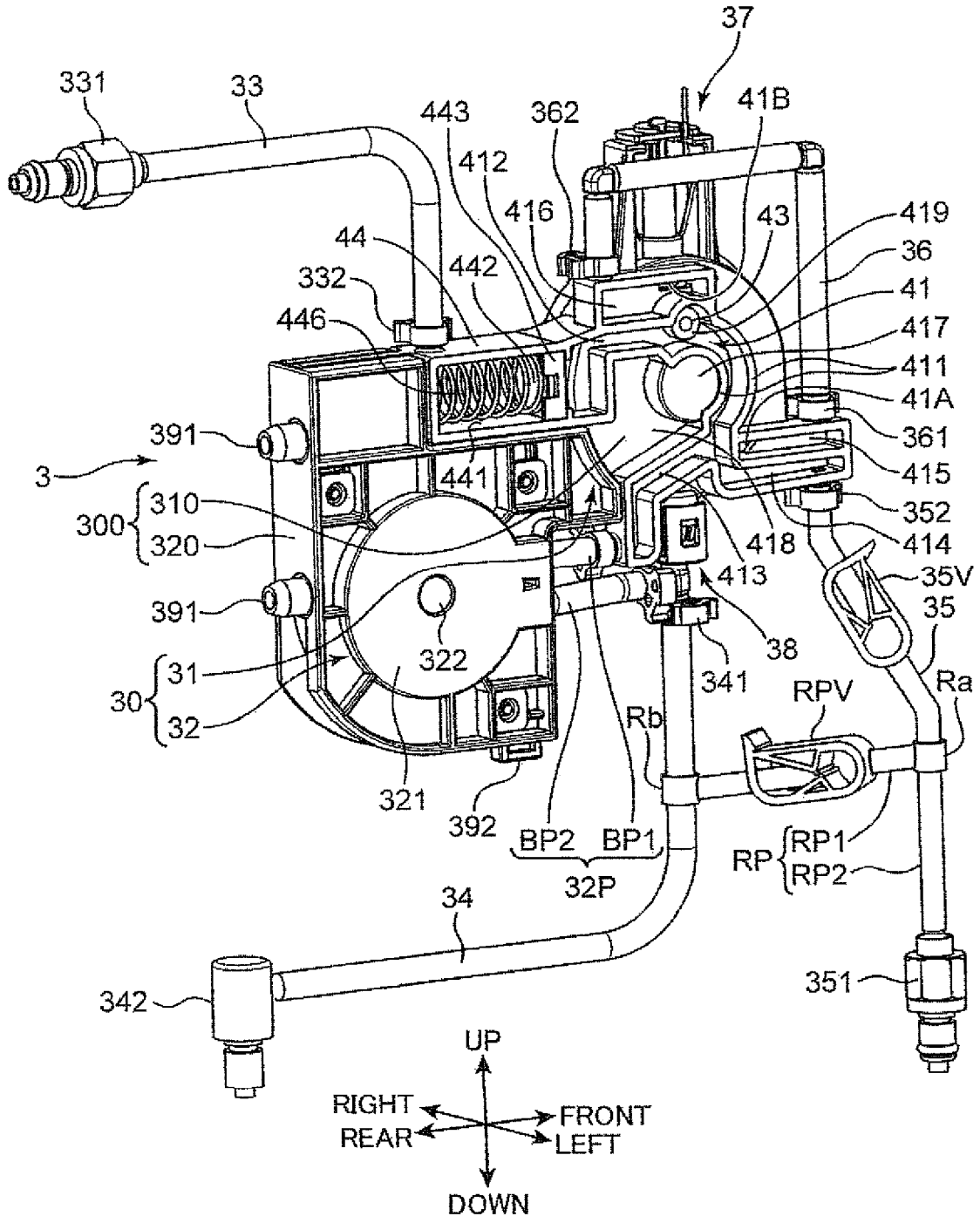
FIG. 11 is a perspective view of a liquid supply unit with a sealing film on the first chamber side removed.
Figure 12B:
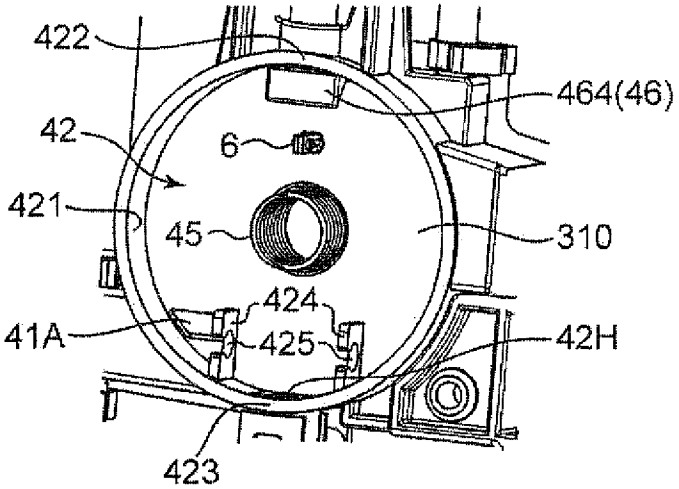
FIGS. 12A to 12C are perspective views of the liquid supply unit with an atmospheric pressure detection film on the second chamber side removed.
Figure 12C:
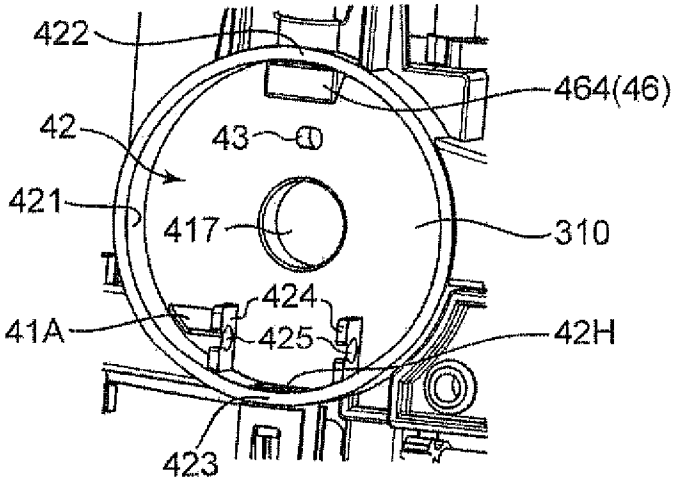
Figure 12A:
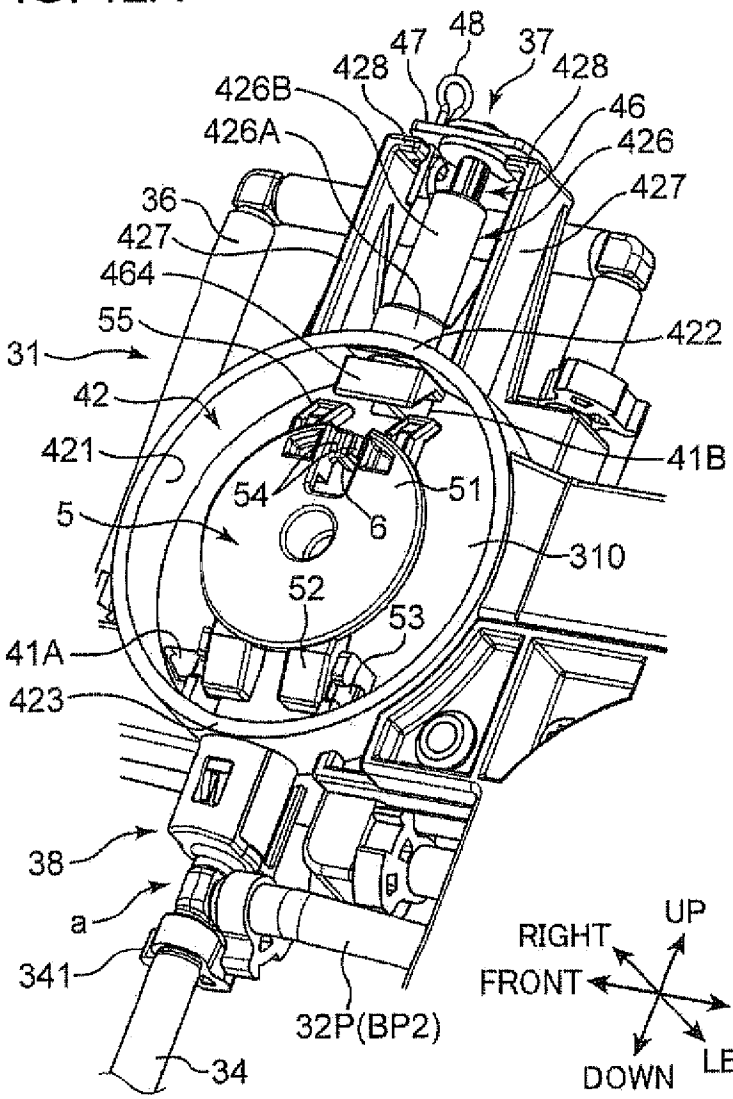
Figure 13:
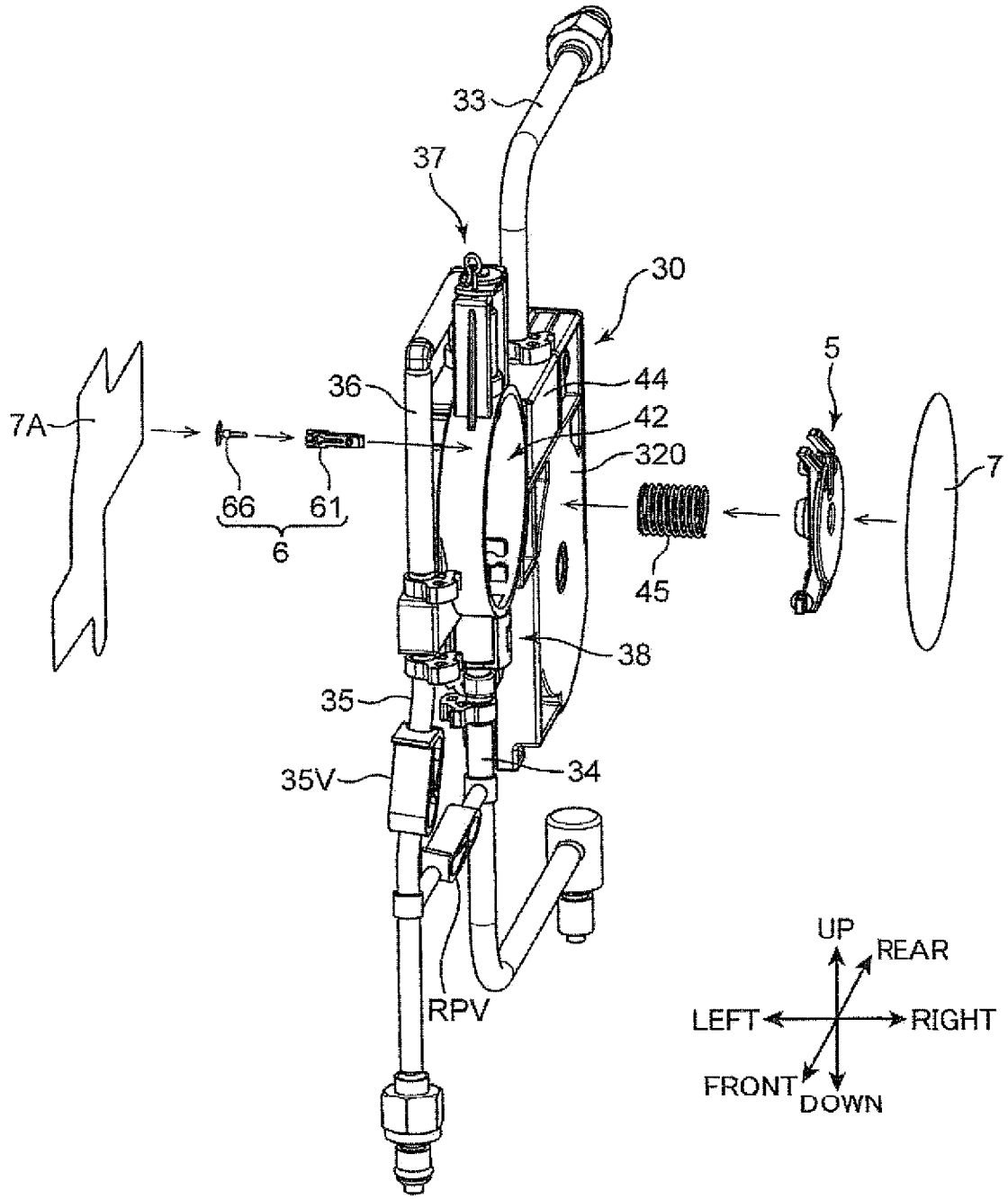
FIG. 13 is an exploded perspective view of the liquid supply unit.

Next, the structure of the liquid supply unit 3 according to the present embodiment, which enables execution of the respective modes of the liquid supply system described above, will be described in detail. FIGS. 10A and 10B are perspective views of the liquid supply unit 3, wherein FIG. 10A is a perspective view as viewed from a first chamber 41 side, and FIG. 10B is a perspective view as viewed from a second chamber 42 side. FIG. 11 is a perspective view of the liquid supply unit 3 with a sealing film 7A on the first chamber 41 side removed, and FIGS. 12A to 12C are respectively perspective views of the liquid supply unit 3 with an atmospheric pressure detection film 7 on the second chamber 42 side removed. FIG. 13 is an exploded perspective view of the liquid supply unit 3.

As preliminarily explained based on FIGS. 7 to 9B, the liquid supply unit 3 includes: the body portion 30 having the tank portion 31 and the pump portion 32, the upstream pipe 33, the downstream pipe 34, the return pipe 35, the bypass pipe 32P, the liquid drain pipe RP, the air vent mechanism portion 37, the backflow prevention mechanism portion 38, the pressing member 5, the on-off valve 6, and the atmospheric pressure detection film 7. In addition, the liquid supply unit 3 includes a monitor pipe 36 for monitoring an ink liquid level in the second chamber 42, and the sealing film 7A forming a part of the wall surface which partitions the first chamber 41.

The body portion 30 includes a base material 300 (FIG. 11) made of a flat plate extending in the front-rear direction. A front side of the base material 300 is a tank portion base plate 310 (wall portion) which forms a substrate of the tank portion 31, and the rear side is a pump portion housing 320 which forms a housing structure in the pump portion 32. The first chamber 41 is disposed on the left surface side of the tank portion base plate 310, and the second chamber 42 is disposed on the right surface side of the tank portion base plate 310. The first chamber 41 and the second chamber 42 are spaces where ink can be stored. A communication opening 43 which makes the first chamber 41 communicate with the second chamber 42 is formed in the tank portion base plate 310. The on-off valve 6 described above is disposed at the communication opening 43.

As shown in FIG. 11, the first chamber 41 is roughly formed of a space having a U-shape in a plan view from the left and having a narrow width. The first chamber 41 is partitioned by a first partition wall 411 protruding to the left from the tank portion base plate 310. The first partition wall 411 is formed of a pair of wall pieces facing each other at a predetermined distance. An inflow portion 412, which is an upstream end of the first chamber 41, communicates with a filter chamber 44, which will be described later. The ink supplied from the upstream pipe 33 to the tank portion 31 enters the first chamber 41 from an inflow portion 412 via the filter chamber 44.

The first chamber 41 has a shape where the first chamber 41 extends horizontally forward from the inflow portion 412 and then curves downward. To a downstream end of the first chamber 41, a bypass communication chamber 413 and a return communication chamber 414 are connected in a Y-branch shape. The bypass communication chamber 413 is a zone where the first chamber 41 and the upstream bypass pipe BP1 are connected with each other. The upstream end of the upstream bypass pipe BP1 is connected to the wall portion that partitions the vicinity of the lower end of the bypass communication chamber 413. The return communication chamber 414 is a zone where the first chamber 41 and the return pipe 35 are connected to each other. A downstream end 352 of the return pipe 35 is connected to a wall portion which partitions a region in the vicinity of a front end of the return communication chamber 414. In FIGS. 7 to 8B, the return communication chamber 414 is treated as a part of the return pipe 35.

A lower monitor communication chamber 415 is disposed above the return communication chamber 414, and an upper monitor communication chamber 416 is disposed above the horizontal portion of the first chamber 41. An upstream end 361 of the monitor pipe 36 is connected to the lower monitor communication chamber 415. A downstream end 362 of the monitor pipe 36 is connected to the upper monitor communication chamber 416. Also with reference to FIG. 12, a lower communication hole 41A and an upper communication hole 41B disposed above the lower communication hole 41A are formed in the tank portion base plate 310. The lower monitor communication chamber 415 communicates with the second chamber 42 through the lower communication hole 41A, and the upper monitor communication chamber 416 communicates with the second chamber 42 through the upper communication hole 41B. That is, the monitor pipe 36 communicates with the upper end side and the lower end side of the second chamber 42, and an ink liquid level in the monitor pipe 36 is linked to an ink liquid level in the second chamber 42.

In this embodiment, the monitor pipe 36 is made of a transparent resin tube. Therefore, the user knows the ink liquid level in the second chamber 42 by visually recognizing the monitor pipe 36. In the present embodiment, as shown in FIG. 4, a plurality of liquid supply units 3 are disposed on the carriage 2 in parallel in the lateral direction. Therefore, even when a transparent film is used as the atmospheric pressure detection film 7 positioned on the right side surface, the ink liquid level in the second chamber 42 cannot be visually recognized except for the ink liquid level in the liquid supply unit 3 on the rightmost side. However, in the present embodiment, the monitor pipe 36 is disposed upright on the front side of the liquid supply unit 3. Therefore, the user can know the ink liquid level in each of the second chambers 42 by visually recognizing the monitor pipe 36 of each liquid supply unit 3 from a front side of the carriage 2.

A spring seat 417 formed of a cylindrical cavity projects to the left, near the center of the first chamber 41 in the vertical direction. The spring seat 417 is a cavity for accommodating a biasing spring 45 described later, and is open to the second chamber 42 side. The first chamber 41 is formed so as to surround approximately half of an outer peripheral wall of the spring seat 417. A spacer chamber 418 is disposed on a rear side of the spring seat 417. The spacer chamber 418 is formed so as to reduce a volume of the first chamber 41 as much as possible. When the volume of the first chamber 41 increases, an amount of ink stored in the first chamber 41 increases. A swinging force is applied to the liquid supply unit 3 when the carriage 2 moves. In this case, when a weight of the ink increases, there is a concern that the atmospheric pressure detection film 7 and the sealing film 7A may be peeled off or damaged due to an inertial force. If such a concern does not occur, the spacer chamber 418 may be omitted, and, for example, the first chamber 41 may be formed in a mode where the first chamber 41 surrounds the spring seat 417.

The communication opening 43 is disposed in the first chamber 41 at a position above the spring seat 417. A cylindrical boss portion 419 projects to the left from the tank portion base plate 310 in the first chamber 41. The communication opening 43 is formed in the boss portion 419 in a penetrating manner in the lateral direction. The first chamber 41 is a chamber where decompression processing or the like is not performed and pressure $P=\rho gh$ due to water head difference is applied in addition to an atmospheric pressure. When ink flows into the first chamber 41 from the inflow portion 412, ink begins to accumulate in order from the bypass communication chamber 413 and the return communication chamber 414. When the liquid level of the ink exceeds the communication opening 43, a state is brought about where the ink can be supplied to the second chamber 42 through the communication opening 43. When the pump 9 is operated, the ink stored in the first chamber 41 is sucked through the upstream bypass pipe BP1, and the high-pressure ink is supplied to the head unit 21 through the downstream bypass pipe BP2 and the downstream pipe 34.

Mainly with reference to FIGS. 12A to 12C and FIG. 13, the second chamber 42 has a circular shape as viewed in a plan view from the right side. The pressing member 5 and the on-off valve 6 described above, and a biasing spring 45 and a lever member 46 described later are assembled to the second chamber 42. FIG. 12A shows a state where these four members are assembled to the second chamber 42. FIG. 12B shows a state where the pressing member 5 is removed from the second chamber 42. FIG. 12C further shows a state where the on-off valve 6 and the biasing spring 45 are removed from the second chamber 42.

The second chamber 42 is partitioned by a second partition wall 421 protruding to the right from the tank portion base plate 310. The second partition wall 421 is a wall having a cylindrical shape. The second chamber 42 is in a positional relationship with the first chamber 41 positioned on a left side such that the second chamber 42 faces the first chamber 41 with the tank portion base plate 310 interposed therebetween. The above-mentioned spring seat 417 is recessed in the tank portion base plate 310 at the central position of the region surrounded by the cylindrical second partition wall 421, that is, at a position concentric with the second partition wall 421. The biasing spring 45 is accommodated in a recess formed in the spring seat 417. The communication opening 43 is disposed above the spring seat 417 on a vertical line which passes a center point of the spring seat 417.

A lever member 46 for venting air from the second chamber 42 is disposed on an upper end portion 422 side of the second chamber 42. The supply hole 42H is formed in a second partition wall 421 at a lower end portion 423 (a lowermost portion of the second chamber 42). The upstream end 341 of the downstream pipe 34 communicates with the supply hole 42H via the backflow prevention mechanism portion 38. The second chamber 42, the backflow prevention mechanism portion 38, and the downstream pipe 34 are disposed in the vertical direction such that the backflow prevention mechanism portion 38 is positioned below the second chamber 42 corresponding to the supply hole 42H, and the joint part a between the downstream pipe 34 and the downstream end of the bypass pipe 32P (downstream bypass pipe BP2) is positioned below the backflow prevention mechanism portion 38. The ink stored in the second chamber 42 is supplied to the downstream pipe 34 through the supply hole 42H and the backflow prevention mechanism portion 38 in a mode where the ink is sucked into the ink ejecting portion 22. The backflow prevention mechanism portion 38 will be described in detail later.

In the vicinity of the lower end portion 423, a pair of front and rear support plates 424 are mounted on the tank portion base plate 310 in a protruding manner to the right from the tank portion base plate 310. Each of the pair of support plates 424 includes a shaft support portion 425 which pivotally supports the pressing member 5 described later. The above-mentioned lower communication hole 41A is formed in the tank portion base plate 310 at a position adjacent to the front of the front support plate 424. The upper communication hole 41B is formed in the tank portion base plate 310 near the upper end portion 422.

A boss portion 426 and a holding frame 427 protrude upward from the upper end portion 422 of the second chamber 42. The boss portion 426 is a tubular body extending vertically upward. The boss portion 426 includes a boss hole 42A (FIG. 22) which is an opening and through which the second chamber 42 communicates with the atmosphere. The holding frame 427 is formed of a pair of frame pieces which are disposed so as to sandwich the boss portion 426 therebetween in the front-rear direction. Locking claws 428, which are bent in directions in which the locking claws 428 face each other, are formed on the upper ends of the respective holding frames 427. The boss portion 426 and the holding frames 427 form a part of the air vent mechanism portion 37. The lever member 46 (FIG. 20) described in detail later is assembled to the boss portion 426 and the holding frames 427.

With reference to FIG. 11, the filter chamber 44 is disposed on the upstream side of the first chamber 41 in the ink supply direction. The filter chamber 44, together with the upstream pipe 33, forms a path for supplying ink from the ink cartridge IC to the first chamber 41. The filter chamber 44 has inner wall surfaces 441. The inner wall surfaces 441 define a space having a rectangular cross-sectional shape in the lateral direction and extend in an angular sleeve shape in the ink supply direction. As will be described in detail later (FIG. 19), the filter chamber 44 is a space which accommodates: a filter member 442 for removing foreign substances in the ink; a holding member 443 for holding the filter member 442; a coil spring 446 for fixing the filter member 442; and the like. An ink inlet 44H (FIG. 19B) is formed in a ceiling wall of the filter chamber 44. An inflow port 447 (FIG. 25) which is formed of a receiving plug is formed in the ceiling wall corresponding to this inlet 44H. A downstream end 332 of the upstream pipe 33 is inserted and connected to the inflow port 447.

With reference to FIGS. 10 and 13, an opening formed on a left surface side of the first chamber 41 is sealed by the resin sealing film 7A. The sealing film 7A has an outer shape which allows the sealing film 7A to conceal not only the first chamber 41 but also the bypass communication chamber 413, the return communication chamber 414, the lower monitor communication chamber 415, the upper monitor communication chamber 416, and the filter chamber 44. The sealing film 7A seals the openings of the respective chambers by welding or adhering a peripheral edge portion of the sealing film 7A to opening end faces of a first partition wall 411 and other walls.

The opening of the second chamber 42 on a right surface side is sealed by an atmospheric pressure detection film 7 made of a flexible resin film member. The atmospheric pressure detection film 7 has a circular outer shape that matches a wall shape of the second partition wall 421 of the second chamber 42 as viewed in a plan view from a right side. A peripheral edge portion of the atmospheric pressure detection film 7 is welded or adhered to the opening end face of the second partition wall 421 to seal the opening of the second chamber 42. The atmospheric pressure detection film 7 is welded or adhered without applying any special tension to the atmospheric pressure detection film 7.

The pump portion 32 is disposed adjacently to the tank portion 31 in an oblique rearward and downward direction. The pump portion 32 includes: a pump cavity 321 which accommodates the pump 9; and a camshaft insertion hole 322 through which a cam shaft 93 (FIG. 4) which pivotally supports an eccentric cam 91 (FIG. 25) of the pump 9 passes. The pump cavity 321 is a cylindrical cavity disposed in the pump portion housing 320. The camshaft insertion hole 322 is a boss hole provided at a position concentric with the pump cavity 321. The opening on the right surface side of the pump cavity 321 is sealed by the pump cover 323 (FIG. 10). Two positioning pins 391 are disposed on a rear side surface of the pump portion housing 320 in a protruding manner. Ribs 392 are formed on a lower side surface of the pump portion housing 320 in a protruding manner. These positioning pins 391 and ribs 392 function as positioning members when the liquid supply unit 3 is mounted on the carriage 2.

In the liquid supply unit 3 of the present embodiment, the tank portion 31 and the pump portion 32 are integrally formed. That is, the tank portion base plate 310 which forms the substrate of the tank portion 31, and the pump portion housing 320 which has the pump cavity 321 are integrated, and the pump 9 for pressurized purging is mounted on the liquid supply unit 3 itself. With such a configuration, the device configuration of the carriage 2 becomes compact and simplified.

[Details of Negative Pressure Supply Mechanism]

Subsequently, a negative pressure supply mechanism where ink is supplied from the first chamber 41 to the second chamber 42 corresponding to the decrease in ink in the second chamber 42 will be described in detail. The negative pressure supply mechanism includes: the pressing member 5; the on-off valve 6; and the atmospheric pressure detection film 7, the operations of which are outlined above with reference to FIG. 7. The negative pressure supply mechanism further includes the biasing spring 45 (the biasing member). The on-off valve 6 is disposed at the communication opening 43, and changes its posture between the closed posture where the on-off valve 6 closes the communication opening 43 and the open posture where the on-off valve 6 opens the communication opening 43. The biasing spring 45 biases the on-off valve 6 in the direction toward the closed posture. The pressing member 5 can press the on-off valve 6 in the direction toward the open posture. The atmospheric pressure detection film 7 is displaced based on the negative pressure generated as the ink in the second chamber 42 decreases, and the displacement force is transmitted to the pressing member 5.

<Pressing Member>

Figure 14A:
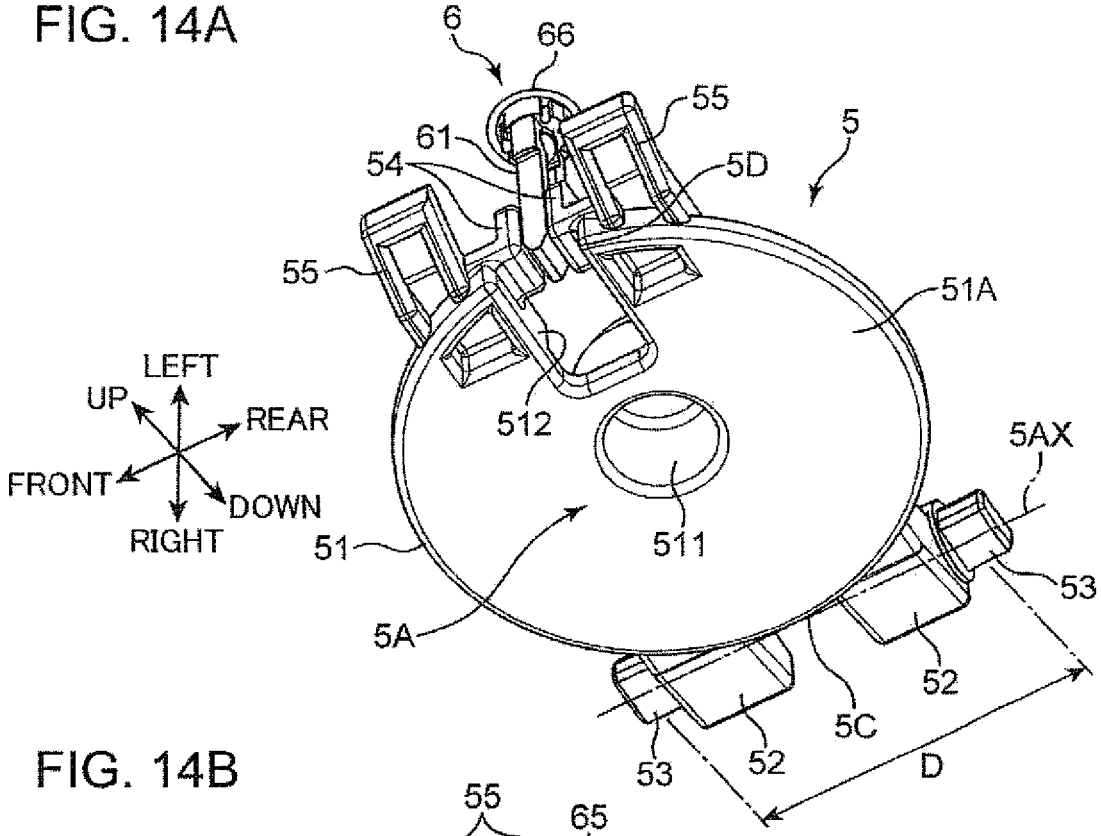
FIG. 14A is a perspective view of a pressing member.
Figure 14B:
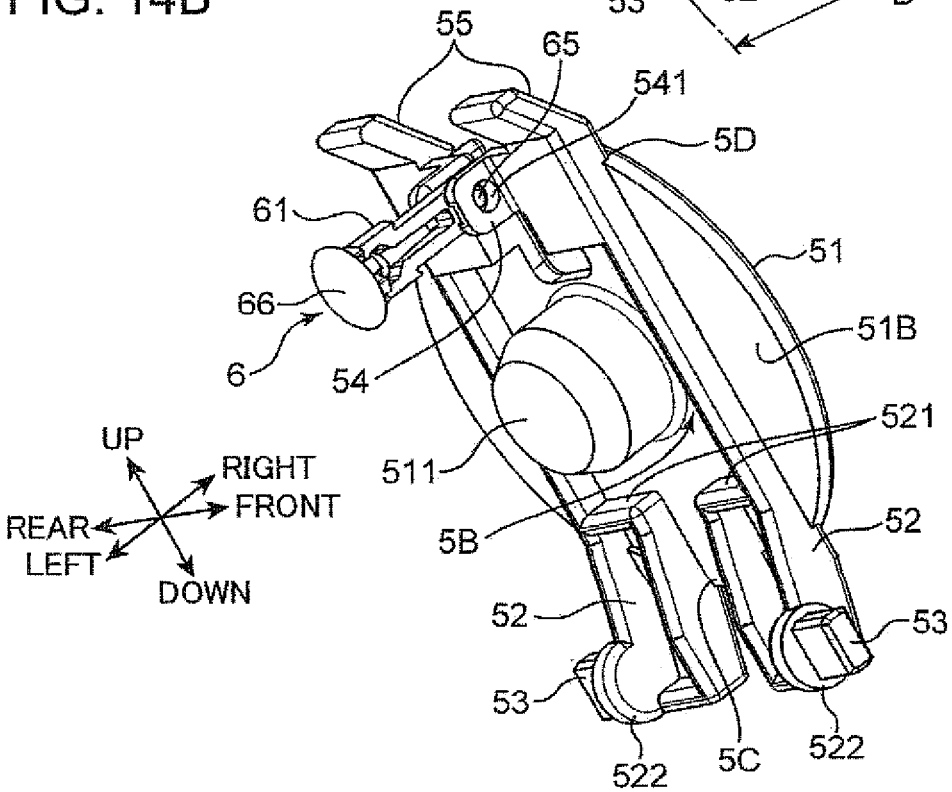
FIG. 14B is a perspective view of the pressing member as viewed in a different perspective direction.

FIGS. 14A and 14B are perspective views of the pressing member 5 as viewed from different perspective directions from each other. The on-off valve 6 is also additionally described. The pressing member 5 is a member rotatably disposed in the second chamber 42. The pressing member 5 includes: a disk portion 51 formed of a circular flat plate; a pair of arm portions 52 extending downward from a lower end side 5C of the disk portion 51; fulcrum portions 53 formed on extending distal end portions (lower end portions) of the respective arm portions 52; a pair of link bosses 54 (pressing portions) disposed on an upper end side 5D of the disk portion 51; and receiving slanted surfaces 55 which interfere with the lever member 46. The pair of fulcrum portions 53 are pivotally supported by the shaft support portions 425 (FIG. 12) of the pair of support plates 424 disposed in the second chamber 42. With such a configuration, the disk portion 51 can rotate about the axis of the fulcrum portions 53.

The disk portion 51 is a disk having a diameter of about ½ of an inner diameter of a cylindrical second partition wall 421 which partitions the second chamber 42. The arrangement relationship between the second partition wall 421 and the disk portion 51 in a state of being pivotally supported by the shaft support portion 425 is substantially concentric. The disk portion 51 includes: a first surface 51A facing the atmospheric pressure detection film 7; and a second surface 51B facing the on-off valve 6 (facing the tank portion base plate 310). A spring fitting projection 511 is disposed at the center of the disk portion 51 in the radial direction so as to protrude from a second surface 51B side. A right end portion of the biasing spring 45 formed of a coil spring is fitted to a second surface 51B side of the spring fitting projection 511. On a first surface 51A side, a region of the spring fitting projection 511 is formed into a columnar recess.

The disk portion 51 includes: a pressure receiving portion 5A which receives a displacement force from the atmospheric pressure detection film 7; and a biased portion 5B which receives a biasing force from the biasing spring 45. The pressure receiving portion 5A is set at a predetermined position on the first surface 51A of the disk portion 51. In the present embodiment, the pressure receiving portion 5A is a region of a peripheral edge portion of the spring fitting projection 511 on the first surface 51A. The biased portion 5B is a region disposed on a second surface 51B side and is a region of the spring fitting projection 511 into which the biasing spring 45 is fitted. That is, the biased portion 5B is set at the position corresponding to the pressure receiving portion 5A.

When the pressure receiving portion 5A does not receive a displacement force from the atmospheric pressure detection film 7, the disk portion 51 is in a state close to an upright position. However, a right end of the biasing spring 45 is in contact with the biased portion 5B, and a biasing force of the biasing spring 45 brings the first surface 51A into contact with the inner surface of the atmospheric pressure detection film 7. On the other hand, when the pressure receiving portion 5A receives a displacement force equal to or greater than the biasing force of the biasing spring 45 from the atmospheric pressure detection film 7, the disk portion 51 rotates to the left about the axis of the fulcrum portion 53 and is brought into a state tilted to the left from an upright state.

The pair of arm portions 52 are disposed on the lower end side 5C of the disk portion 51 in a spaced apart manner from each other in the front-rear direction. Respective upper end portions 521 of the pair of arm portions 52 extend upward with respect to the lower end side 5C of the disk portion 51, and are positioned below both side portions of the spring fitting projection 511. Distal end portions 522 of the pair of arm portions 52 extend linearly downward from the lower end side 5C respectively. A fulcrum portion 53 protrudes from each of the distal end portions 522 in the front-rear direction. More specifically, the fulcrum portions 53 protrude in directions such that the fulcrum portions 53 are spaced apart from each other. That is, one fulcrum portion 53 protrudes forward from a front side surface of the distal end portion 522 on a front side, and the other fulcrum portion 53 protrudes rearward from a rear side surface of the distal end portion 523 on a rear side. The fulcrum portion 53 is fitted into the shaft support portion 425 of the support plate 424. Providing the fulcrum portion 53 at the distal end portion 522 of the arm portion 52 contributes to the increase of a swing width of the upper end side 5D of the disk portion 51 when the pressing member 5 rotates around the fulcrum portion 53.

The pair of fulcrum portions 53 are arranged in a spaced-apart manner on a rotation axis 5AX extending in the front-rear direction. The front fulcrum portion 53 and the rear fulcrum portion 53 are disposed at a predetermined interval D. That is, the pair of fulcrum portions 53 are disposed in a spaced apart manner from each other with a portion corresponding to a central region in a plane direction of the disk portion 51 interposed therebetween. The interval D can be set to a size of, for example, about 40% to 90% of a diameter of the disk portion 51. As a result, the pivot fulcrum formed by the pair of fulcrum portions 53 becomes a wide pivot fulcrum where the fulcrum portions 53 are spaced apart from each other so as to substantially sandwich the central region of the disk portion 51. Therefore, the disk portion 51 which rotates around the pivot fulcrum is hardly twisted around an axis orthogonal to the rotation axis 5AX. Therefore, the rotational operation of the disk portion 51 can be stabilized.

A pair of link bosses 54 protrude from the second surface 51B toward the left near the upper end side 5D of the disk portion 51. Specifically, a notch portion 512, which extend inward in the radial direction and has an opening edge at the upper end side 5D, is formed in the disk portion 51. The link bosses 54 respectively formed of a rectangular flat plate are raised upright from front and rear side edges of the disk portion 51 which face a space defined by the notch portion 512. Each link boss 54 includes a link hole 541. The link holes 541 are used for connecting the pressing member 5 and the on-off valve 6 to each other by link connection. By this link connection, the opening/closing operation of the on-off valve 6 is interlocked with the rotation operation of the pressing member 5.

In other words, the link bosses 54 form a pressing portion which presses and moves the on-off valve 6 in the lateral direction in response to the rotational operation of the pressing member 5 which rotates about the axis of the fulcrum portions 53. The pair of link bosses 54 are disposed on the upper end side 5D spaced apart by a predetermined distance from the pair of fulcrum portions 53 which are disposed on the lower end side 5C. That is, on the disk portion 51, the link bosses 54 which form the pressing portion are disposed at the position opposite to the fulcrum portions 53 which form the pivot fulcrum. Therefore, when the pressing member 5 is rotated, a movement amount of the link boss 54 and a movement amount of the on-off valve 6 connected to the link boss 54 by link connection can be increased.

In the relationship between the pressure receiving portion 5A or the biased portion 5B (force point) and the fulcrum portions 53 (fulcrum), the link bosses 54 (action point) are disposed at the position further away with respect to the fulcrum portion 53 than the pressure receiving portion 5A and the biased portion 5B. In other words, the link bosses 54 are disposed on the upper end side 5D of the disk portion 51 such that the link bosses 54 face the fulcrum portions 53 with the pressure receiving portion 5A and the biased portion 5B interposed therebetween. With such an arrangement, it is possible to give a moving force received by the pressure receiving portion 5A or the biased portion 5B to the link boss 54 in a state where the moving force is amplified corresponding to the distance between the link bosses 54 and the fulcrum portions 53.

<On-Off Valve>

Subsequently, the on-off valve 6 will be described. The on-off valve 6 is disposed at the communication opening 43 which makes the first chamber 41 communicate with the second chamber 42. The on-off valve 6 opens and closes the communication opening 43 by moving in the communication opening 43 in the lateral direction following the rotational operation of the pressing member 5 around the fulcrum portion 53. The on-off valve 6 is connected to the link boss 54 of the disk portion 51 by link connection in order to follow the rotational operation.

Figure 15A:
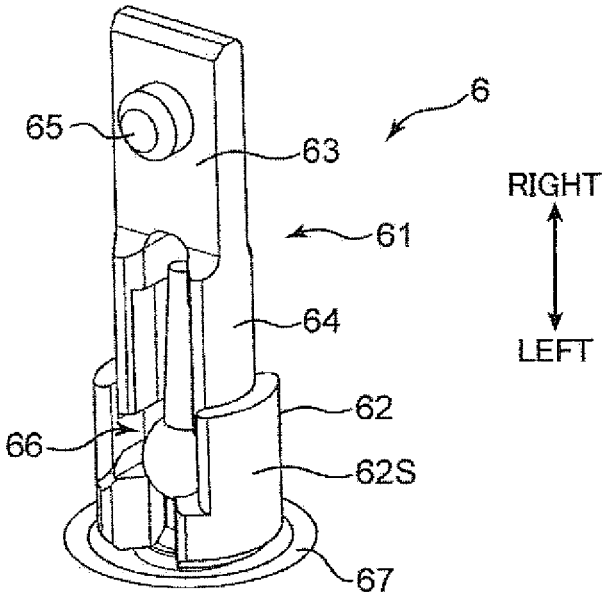
FIG. 15A is a perspective view of an on-off valve.
Figure 15B:
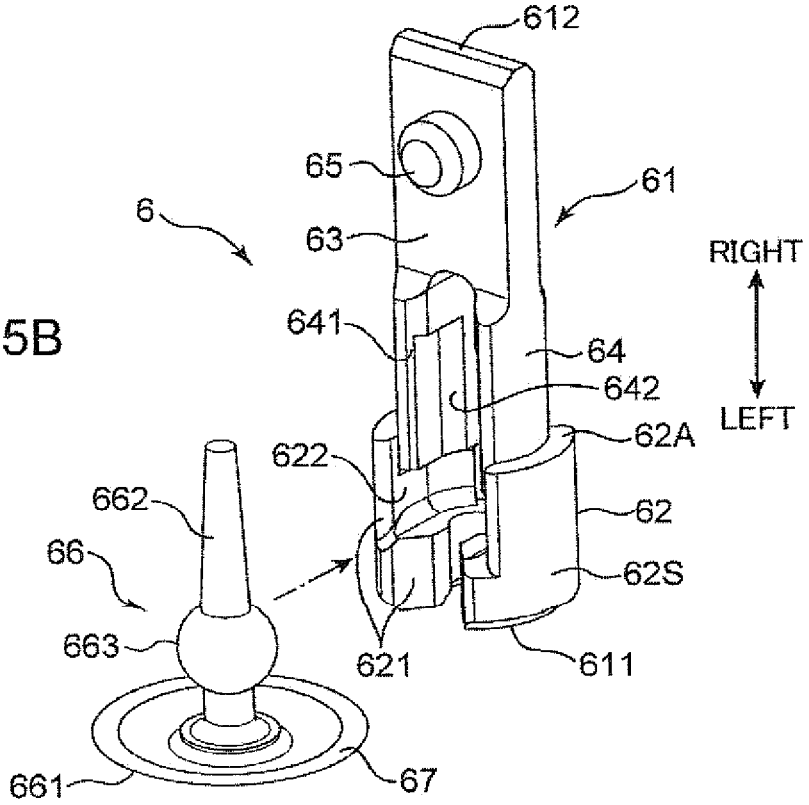
FIG. 15B is an exploded perspective view of the on-off valve.
Figure 16A:
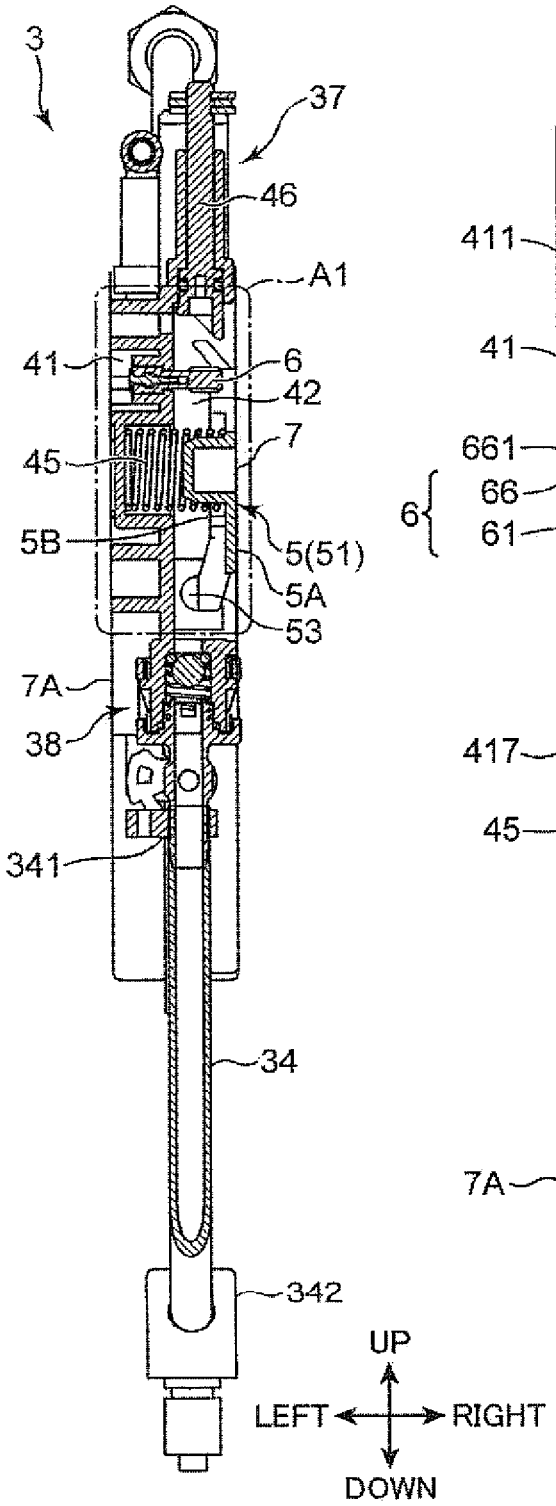
FIG. 16A is a cross-sectional view taken along line XVI-XVI in FIG. 10A, and is a cross-sectional view showing a state where the on-off valve is in a closed posture.
Figure 16B:
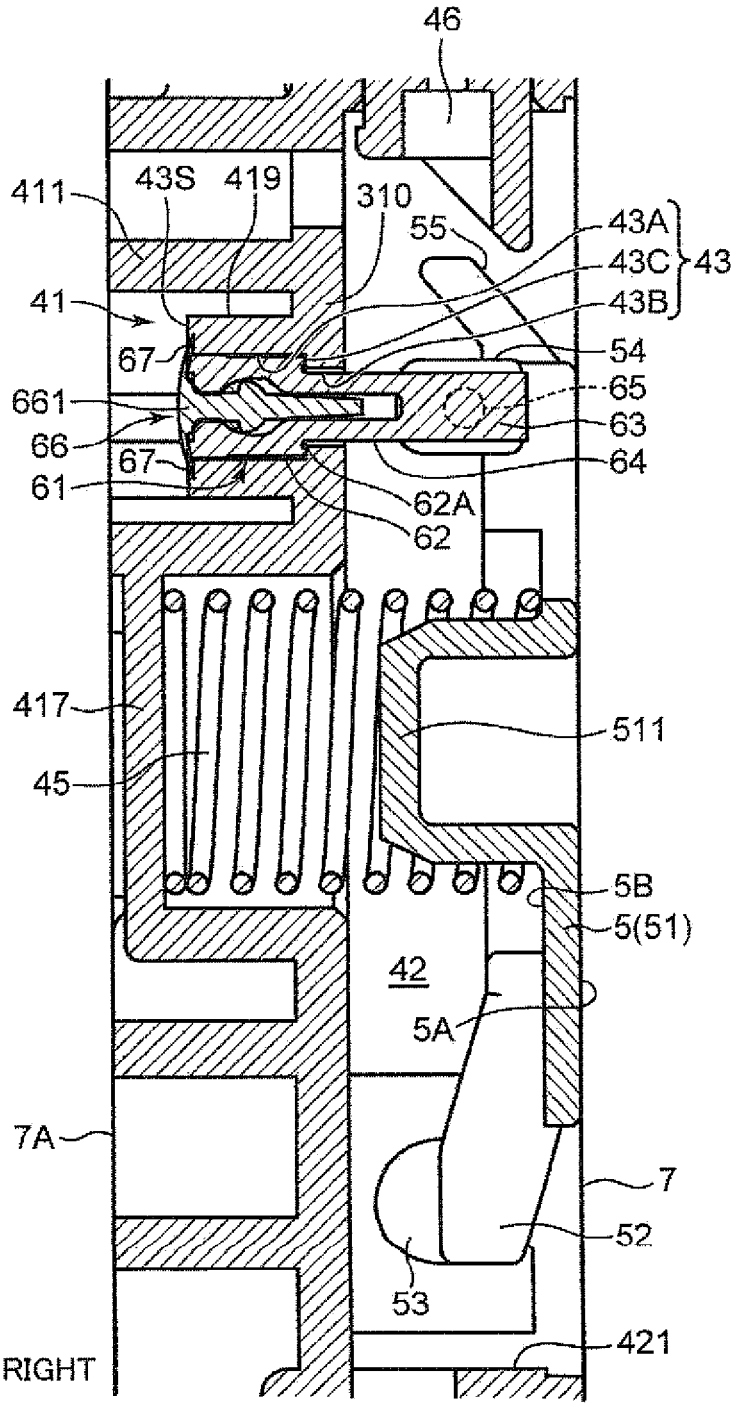
FIG. 16B is an enlarged view of an A1 part in FIG. 16A.

FIG. 15A is a perspective view of the on-off valve 6, and FIG. 15B is an exploded perspective view of the on-off valve 6. FIG. 16A is a cross-sectional view taken along line XIV-XIV in FIG. 10A, and FIG. 16B is an enlarged view of a part A1 in FIG. 16A. The on-off valve 6 is an assembly formed of: a valve holder 61; and an umbrella valve 66 which is held by the valve holder 61. The communication opening 43 is a cylindrical hole which penetrates the tank portion base plate 310 and the boss portion 419. The communication opening 43 has: a large diameter portion 43A; a small diameter portion 43B having an inner diameter smaller than that of the large diameter portion 43A; and a stepped portion 43C formed because of difference in diameter between the large diameter portion 43A and the small diameter portion 43B.

The valve holder 61 is a semi-cylindrical member including a first end portion 611 and a second end portion 612. In a state where the valve holder 61 is assembled to the communication opening 43, the first end portion 611 is positioned on a first chamber 41 side (a left side), and the second end portion 612 is positioned on a second chamber 42 side (a right side). The valve holder 61 includes: a tubular portion 62 disposed on a first end portion 611 side; a flat plate portion 63 disposed on a second end portion 612 side; an intermediate portion 64 positioned between the tubular portion 62 and the flat plate portion 63, and a link pin 65 disposed on the flat plate portion 63. The umbrella valve 66 is held on the first end portion 611 side of the valve holder 61.

The tubular portion 62 is a tubular portion having the largest outer diameter in the valve holder 61. The tubular portion 62 includes: a guide surface 62S which is an outer peripheral surface of the tubular portion 62; a flow path notch 621 formed by cutting away a part of the tubular portion 62 in a circumferential direction; and a holding groove 622 which is formed on an inner peripheral side of the tubular portion 62 in an annularly recessed manner. The tubular portion 62 is accommodated in the large diameter portion 43A of the communication opening 43. When the on-off valve 6 moves in the lateral direction, a guide surface 62S is guided by an inner surface of the large diameter portion 43A. The flow path notch 621 serves as a flow path through which ink flows when the on-off valve 6 is in an open posture. The holding groove 622 is a groove for locking a locking ball portion 663 of the umbrella valve 66.

The intermediate portion 64 is a tubular portion having an outer diameter smaller than an outer diameter of the tubular portion 62. The intermediate portion 64 includes: an opening portion 641 which is an opening part communicably connected with the flow path notch 621; and a pin accommodating portion 642 for accommodating a pin portion 662 of the umbrella valve 66. The intermediate portion 64 is accommodated in the small diameter portion 43B of the communication opening 43. An outer peripheral surface of the intermediate portion 64 is also guided by the inner surface of the small diameter portion 43B. At a boundary between the tubular portion 62 and the intermediate portion 64, an annular contact portion 62A exists. The annular contact portion 62A is formed of a step difference generated by difference in outer diameter between the tubular portion 62 and the intermediate portion 64. The annular contact portion 62A faces and is brought into contact with the stepped portion 43C of the communication opening 43.

The flat plate portion 63 is a portion which protrudes to the right from the communication opening 43 in a state where the on-off valve 6 is assembled to the communication opening 43. The flat plate portion 63 has a pair of front and back flat surfaces extending in the lateral direction. The link pin 65 protrudes from the pair of respective flat surfaces. As shown in FIG. 14B, the link pin 65 is fitted into link holes 541 formed in the link bosses 54 of the pressing member 5. By this fitting, the pressing member 5 and the on-off valve 6 are connected to each other by link connection. Accordingly, the rotational movement of the pressing member 5 about the fulcrum portions 53 can be converted into a linear movement of the on-off valve 6.

The umbrella valve 66 is an article made of rubber. The umbrella valve 66 includes: an umbrella portion 661; a pin portion 662 extending to the right from the umbrella portion 661; and a locking ball portion 663 integrally formed with the pin portion 662. The umbrella portion 661 has an umbrella diameter larger than an inner diameter of the large diameter portion 43A of the communication opening 43. A peripheral edge portion of the umbrella portion 661 on an inner side (right surface side) forms a sealing surface 67. The sealing surface 67 is brought into contact with a sealing wall surface 43S which is a wall surface around the communication opening 43 and is a protruding end surface of the boss portion 419. Accordingly, the sealing surface 67 can bring the communication opening 43 into a sealing state (closed posture). On the other hand, when the sealing surface 67 is separated from the sealing wall surface 43S, the sealing state is released (open posture). An umbrella shape of the umbrella portion 661 is inverted when a predetermined pressure is applied to a right surface side (FIG. 29).

The pin portion 662 is a rod-shaped portion extending in the lateral direction, and is a portion which serves as a support strut for the umbrella portion 661. The pin portion 662 enters the tubular portion 62 of the valve holder 61 and the pin accommodating portion 642 of the intermediate portion 64. That is, the umbrella portion 661 abuts on the first end portion 611 of the valve holder 61, and the pin portion 662 can be fitted into the inner tubular portion of the valve holder 61. The locking ball portion 663 is a portion formed by bulging a portion of the pin portion 662 near a left end in a spherical shape. The locking ball portion 663 is a portion fitted into the holding groove 622. By fitting the locking ball portion 663 into the holding groove 622, the umbrella valve 66 is held by the valve holder 61 in a state where the movement of the umbrella valve 66 in the lateral direction is restricted. That is, the umbrella valve 66 moves in the lateral direction integrally with the valve holder 61.

<Biasing Spring>

The biasing spring 45 is a coil spring which is interposed between a second surface 51B of the disk portion 51 and the tank portion base plate 310. The biasing spring 45 supports (biases) the second surface 51B. Specifically, as shown in FIG. 16B, a right end side of the biasing spring 45 is fitted into a spring fitting projection 511 of the disk portion 51, and a left end side of the biasing spring 45 is accommodated in the spring seat 417 which is formed on the tank portion base plate 310 in a recessed manner. When the pressure receiving portion 5A of the disk portion 51 receives a displacement force in a leftward direction which resists a biasing force of the biasing spring 45 in a rightward direction, the disk portion 51 rotates to the left about an axis of the fulcrum portions 53. When the pressure receiving portion 5A of the disk portion 51 does not receive a displacement force, the disk portion 51 maintains an upright posture by the biasing force.

<Operation of On-Off Valve>

Subsequently, the opening/closing operation of the on-off valve 6 will be described. FIG. 16 shows the on-off valve 6 in a closed posture. This state is a state where the atmospheric pressure detection film 7 does not generate a displacement force enough to rotate the pressing member 5 (disk portion 51), that is, a state where a sum of a spring pressure (a biasing force) of the biasing spring 45 and an internal pressure of the second chamber 42 is greater than an atmospheric pressure. Although the second chamber 42 has a negative pressure, the biasing spring 45 biases the biased portion 5B of the disk portion 51 to the right with a biasing force which overcomes a displacement force of the atmospheric pressure detection film 7 generated by the negative pressure. Therefore, the disk portion 51 does not rotate about the axis of the fulcrum portion 53, and maintains the above-mentioned upright posture.

In this case, the on-off valve 6 which is connected to the pressing member 5 by link connection at the link bosses 54 takes a closed posture positioned on a rightmost side. That is, a state is brought about where the valve holder 61 is towed to the right via the link bosses 54 by a biasing force of the biasing spring 45. Therefore, the annular contact portion 62A of the valve holder 61 abuts on the stepped portion 43C of the communication opening 43, and the sealing surface 67 of the umbrella valve 66 abuts on the sealing wall surface 43S. Therefore, the communication opening 43 is sealed by the umbrella valve 66. It can be said that the biasing spring 45 indirectly biases the on-off valve 6 toward the closed posture by biasing the disk portion 51 to the right.

Figure 17A:
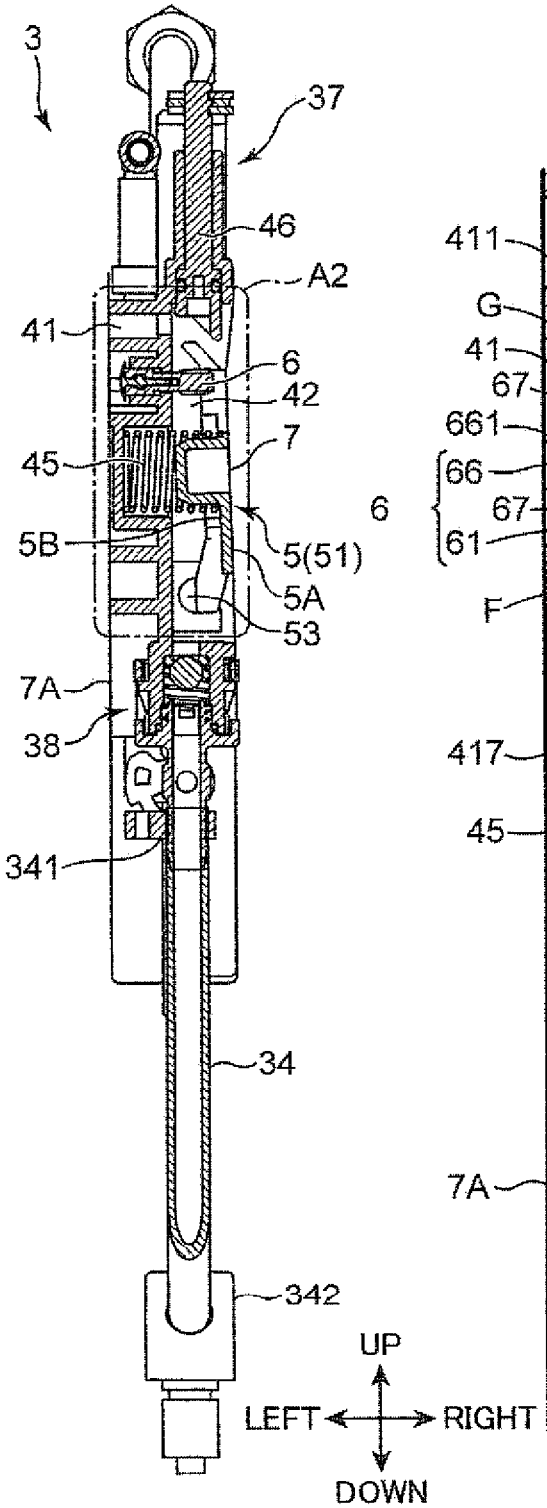
FIG. 17A is a view corresponding to FIG. 16A, and is a cross-sectional view showing a state where the on-off valve is in an open posture.
Figure 17B:
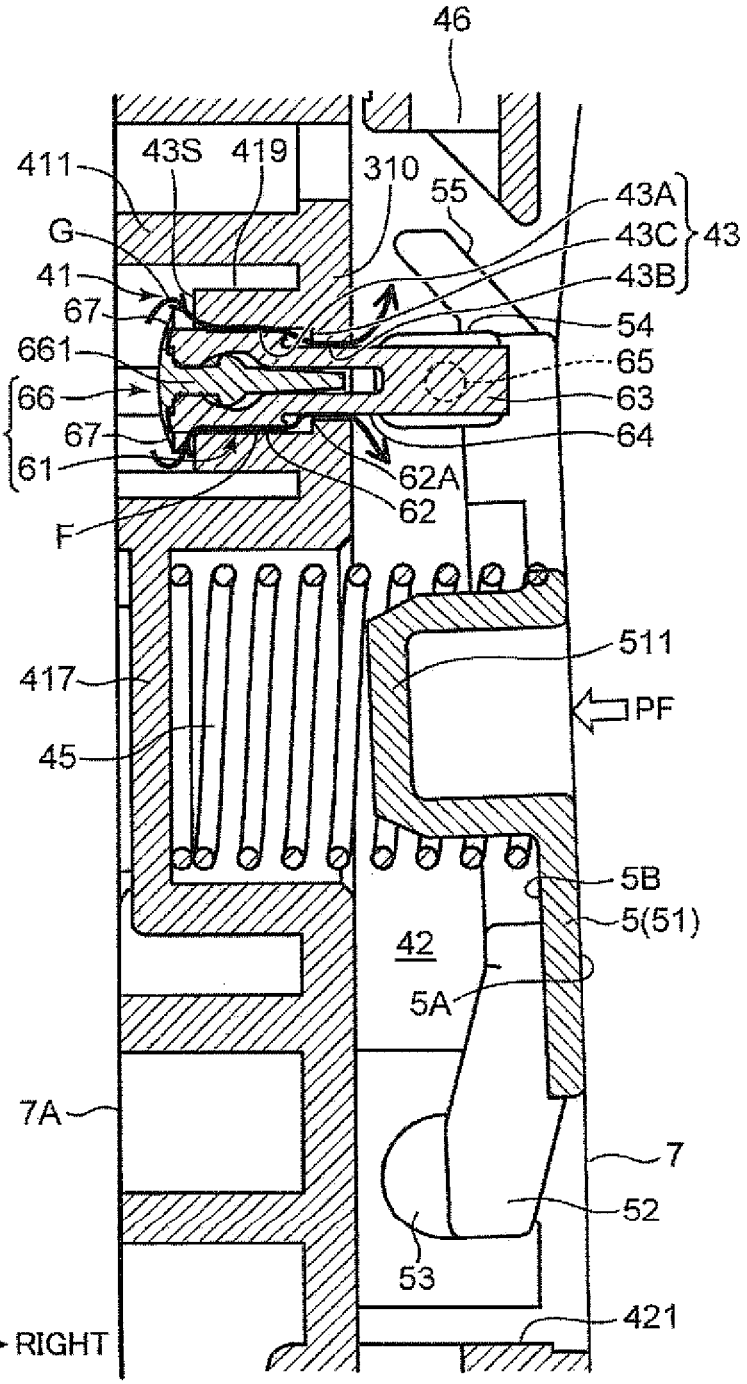
FIG. 17B is an enlarged view of a part A2 in FIG. 17A.

FIG. 17A is a view corresponding to FIG. 16A. That is, FIG. 17A is a cross-sectional view showing a state where the on-off valve 6 is in an open posture. FIG. 17B is an enlarged view of an A2 portion in FIG. 17A. When the ink ejecting portion 22 continues an ink ejection operation of ink droplets from the state shown in FIG. 16, a degree of negative pressure in the second chamber 42 which is a closed space is gradually increased as the ink decreases. Eventually, when the pressure in the second chamber 42 becomes a negative pressure which exceeds a predetermined threshold value, the atmospheric pressure detection film 7 applies a pressing force which resists a biasing force of the biasing spring 45 to the pressure receiving portion 5A of the disk portion 51. That is, a state is brought about where the sum of the spring pressure of the biasing spring 45 and the internal pressure of the second chamber 42 is lower than an atmospheric pressure.

In this case, the disk portion 51 rotates to the left about the axis of the fulcrum portions 53 against the biasing force of the biasing spring 45. With such rotation, the link bosses 54 generate a pressing force PF which moves the on-off valve 6 to the left, thus changing the posture of the on-off valve 6 to the open posture. That is, a pressing force is transmitted from the link holes 541 of the link bosses 54 to the link pin 65 of the valve holder 61, and the valve holder 61 moves linearly to the left in a state where the guide surfaces 62S are guided by the inner surface of the communication opening 43. Along with the movement of the valve holder 61, the umbrella valve 66 also moves to the left, and the sealing surface 67 of the umbrella valve 66 separates from the sealing wall surface 43S. That is, a state is brought about where a gap G is formed between the sealing surface 67 and the sealing wall surface 43S. Therefore, the sealing of the communication opening 43 by the umbrella valve 66 is released.

When the on-off valve 6 takes the open posture, as indicated by an arrow F in FIG. 17B, due to the pressure difference between the first chamber 41 where the pressure is an atmospheric pressure+ρgh and the second chamber 42 where a degree of negative pressure is increased, ink flows from the first chamber 41 to the second chamber 42. Specifically, ink flows into the second chamber 42 through a flow path formed of the gap G between the sealing surface 67 of the umbrella valve 66 and the sealing wall surface 43S, the flow path notch 621 formed in the tubular portion 62 of the valve holder 61, and the opening portion 641 formed in the intermediate portion 64.

As the inflow of the ink to the second chamber 42 progresses, the degree of negative pressure in the second chamber 42 is gradually alleviated. Eventually, when the sum of the spring pressure of the biasing spring 45 and the internal pressure of the second chamber 42 becomes greater than the atmospheric pressure, the disk portion 51 is pushed back to the right by a biasing force of the biasing spring 45. That is, when the pressure in the second chamber 42 becomes a negative pressure below a predetermined threshold value, the disk portion 51 is pressed by a biasing force of the biasing spring 45 and rotates to the right about the axis of the fulcrum portion 53. As a result, the on-off valve 6 is also towed by the link bosses 54 and moves linearly to the right. Eventually, the annular contact portion 62A of the valve holder 61 abuts on the stepped portion 43C of the communication opening 43, and the sealing surface 67 of the umbrella valve 66 is brought into contact with the sealing wall surface 43S. Therefore, the on-off valve 6 returns to the closed posture.

<Operation and Effects of Negative Pressure Supply Mechanism>

Figure 18A:
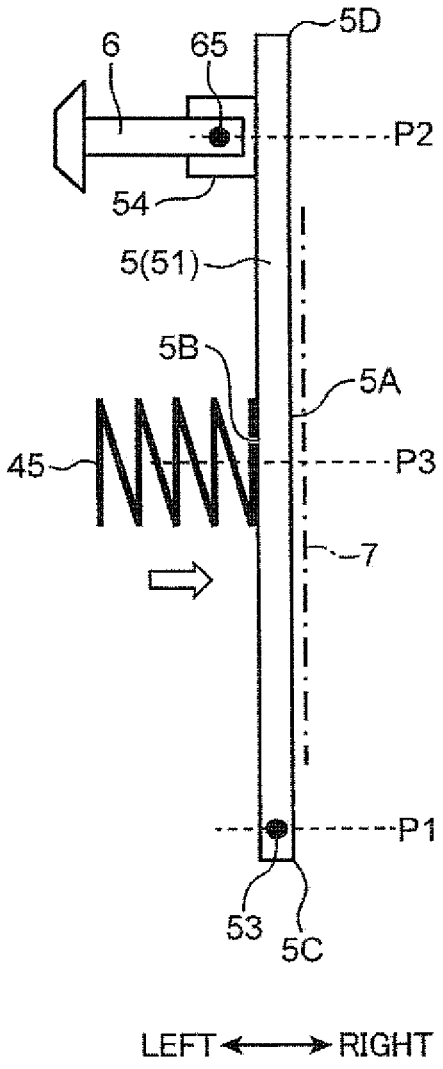
FIGS. 18A and 18B are schematic views for explaining a positional relationship between a pivot fulcrum and a pressing portion in a pressing member, and an operation of the pressing member.
Figure 18B:
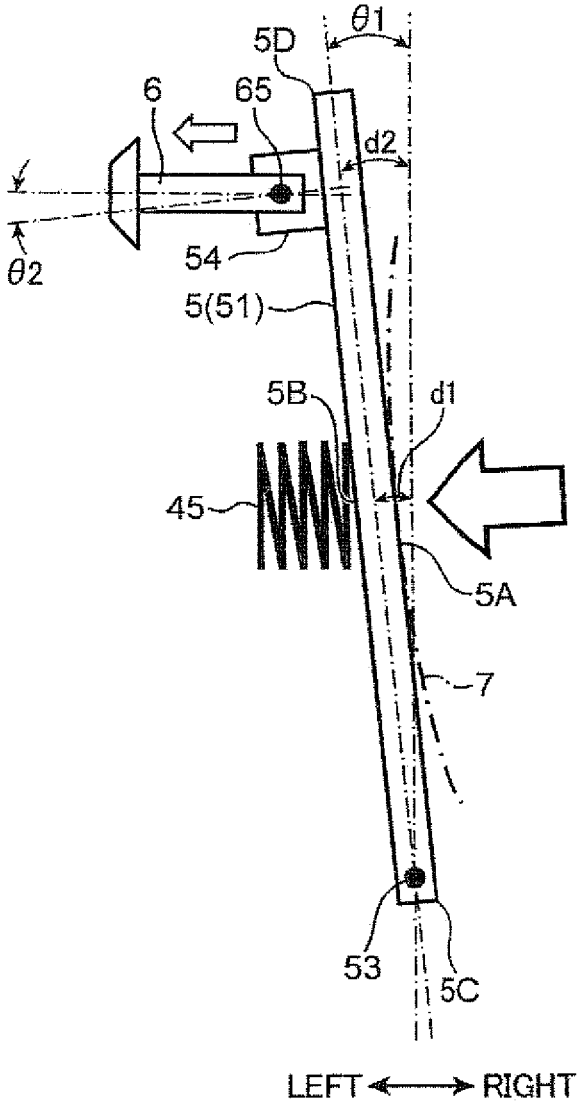

The operation and effects of the negative pressure supply mechanism of the present embodiment having the above configuration will be described with reference to the schematic views of FIGS. 18A and 18B. FIG. 18A shows a state where the pressing member 5 (disk portion 51) is in an upright posture and the on-off valve 6 is in a closed posture. FIG. 18B shows a state where the pressing member 5 is rotated and is in a tilted posture and the on-off valve 6 is in an open posture.

First, the pressing member 5 has a pivot fulcrum referred to as a fulcrum portion 53. The fulcrum portion 53 is pivotally supported by a support plate 424 disposed in the second chamber 42. Therefore, when the pressure receiving portion 5A receives a displacement force of the atmospheric pressure detection film 7, the pressure receiving portion 5A rotates about an axis of the fulcrum portion 53. That is, a displacement of the atmospheric pressure detection film 7 which is an unstable moving force can be converted into the rotation of the fulcrum portion 53 about the axis which is a stable moving force. Therefore, a displacement force of the atmospheric pressure detection film 7 can be efficiently transmitted to the on-off valve 6 via the link bosses 54 (the pressing portion). For example, in a case where the pressing member of the on-off valve 6 does not have a pivot fulcrum such as a case where the pressing member of the on-off valve 6 is laminated to the atmospheric pressure detection film 7, the behavior of the pressing member becomes unstable. Accordingly, the transmission of the pressing force to the on-off valve 6 becomes unstable. However, according to the present embodiment, the pressing member 5 can generate a stable pressing force. Accordingly, the on-off valve 6 can be changed in posture between the closed posture and the open posture at a desired timing and hence, it is possible to provide a stable ink supply to the head unit 21.

Further, the fulcrum portion 53 is disposed on the lower end side 5C of the pressing member 5. On the other hand, the link bosses 54 are disposed on the upper end side 5D of the pressing member 5 so that the link bosses 54 are spaced apart from the fulcrum portion 53 by a predetermined distance. That is, as shown in FIG. 18A, assuming an axial fulcrum formed by the fulcrum portion 53 as a fulcrum P1 and the link bosses 54 which input a moving force to the on-off valve 6 as an action point P2, the action point P2 is disposed at the position opposite to the fulcrum P1 on the pressing member 5. A force point P3 which gives a rotational force to the pressing member 5 is the arrangement position of the pressure receiving portion 5A and the biased portion 5B in the present embodiment, and this force point P3 is positioned between the fulcrum P1 and the action point P2.

Therefore, the movement amount of the link bosses 54 when the pressing member 5 is rotated can be increased, and eventually, an amount of linear movement of the on-off valve 6 in the lateral direction can be increased. As shown in FIG. 18B, it is assumed that a pressing force of the atmospheric pressure detection film 7 is applied to the action point P2 (pressure receiving portion 5A), and the pressing member 5 rotates about the axis of the fulcrum portion 53 by a rotation angle θ1. In this case, the actual movement amount of the pressing member 5 at the position of the pressure receiving portion 5A is d1. On the other hand, the movement amount at the position of the link bosses 54 (link pin 65) becomes a movement amount d2 which is increased from the movement amount d1 by an amount brought about by difference in distance between the action point P2 and the fulcrum P1 and the distance between the force point P3 and the fulcrum P1.

As described with reference to FIGS. 16 and 17, the on-off valve 6 is not a member which opens and closes the communication opening 43 depending on the pressing force, but is a member which opens and closes the communication opening 43 by moving in the communication opening 43 in the lateral direction. Further, as the movement amount of the on-off valve 6 to the left increases, the gap G increases and the ink inflow resistance decreases. When the ink in the second chamber 42 is rapidly consumed, a large pressing force is applied from the atmospheric pressure detection film 7. Accordingly, the movement amount d1 also becomes relatively large. Then, the on-off valve 6 can be moved to the left by the movement amount d2 which is amplified with respect to the movement amount d1. Therefore, when the ink is consumed rapidly, the on-off valve 6 can be largely moved to allow a relatively large amount of ink to flow into the second chamber 42.

On the other hand, when the ink in the second chamber 42 is slowly consumed, a pressing force applied from the atmospheric pressure detection film 7 becomes small and hence, the movement amount d1 becomes relatively small. Even with such a small movement amount d1, the movement amount d2 is amplified at the position of the link bosses 54 and hence, the on-off valve 6 can be moved to the left correspondingly. Therefore, even when the ink is consumed slowly, the on-off valve 6 can be moved in a timely manner with high sensitivity. In this way, stable ink supply from the liquid supply unit 3 to the head unit 21 can be ensured both when a large amount of ink is ejected from the head unit 21 and when a small amount of ink is ejected from the head unit 21.

Further, as an advantage from another viewpoint, the on-off valve 6 can be connected to the pressing member 5 by link connection. Specifically, a link connection is formed between the link pin 65 disposed near the right end of the on-off valve 6 and the link holes 541 of the link bosses 54. Then, the biasing spring 45 biases the on-off valve 6 in the direction toward the closed posture by pressing the biased portion 5B of the disk portion 51. Therefore, the pressing member 5 (disk portion 51) rotates about the axis of the fulcrum portion 53 and hence, the pressing member 5 tilts to the left by the rotation angle θ1 as shown in FIG. 18B. However, due to the link connection, the on-off valve 6 is not tilted following the tilting operation of the disk portion 51. That is, the on-off valve 6 can rotate about the link pin 65 by the rotation angle θ2 corresponding to the rotation angle θ1, and can maintain the horizontal posture. Therefore, the on-off valve 6 can be linearly moved in the lateral direction in the communication opening 43, and the on-off valve 6 can be stably operated between the closed posture and the open posture.

[Details of Filter Chamber]

Figure 19A:
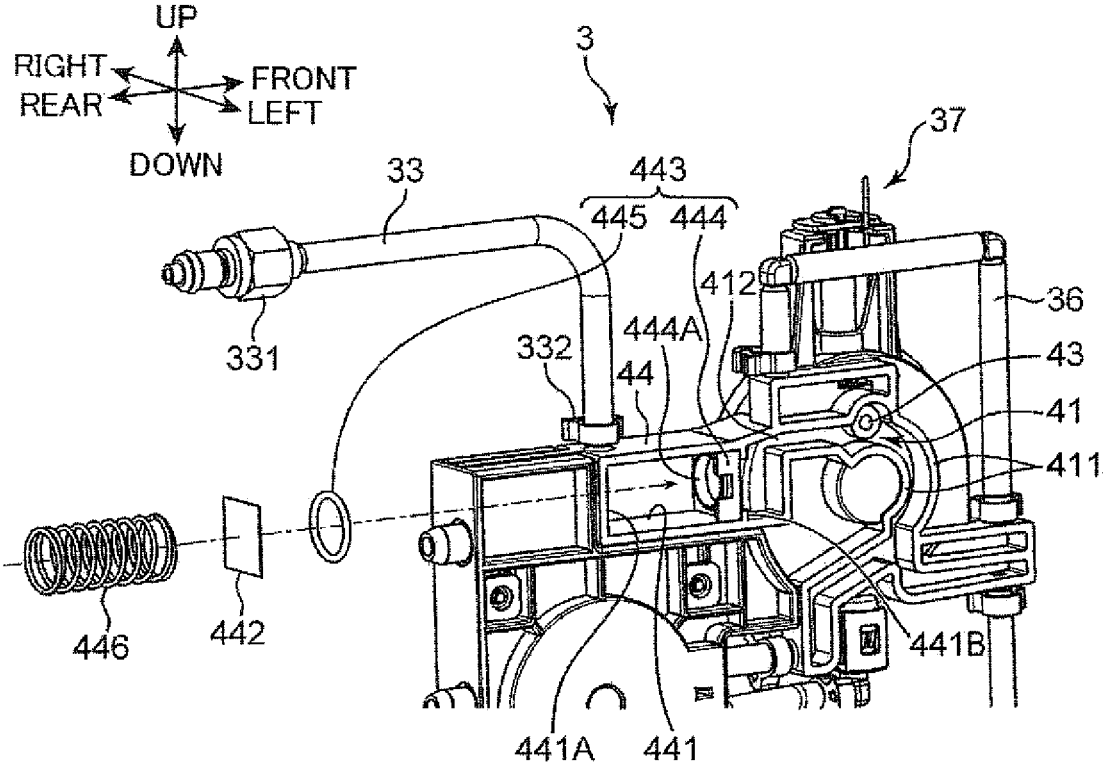
FIG. 19A is an exploded perspective view of a filter chamber.
Figure 19B:
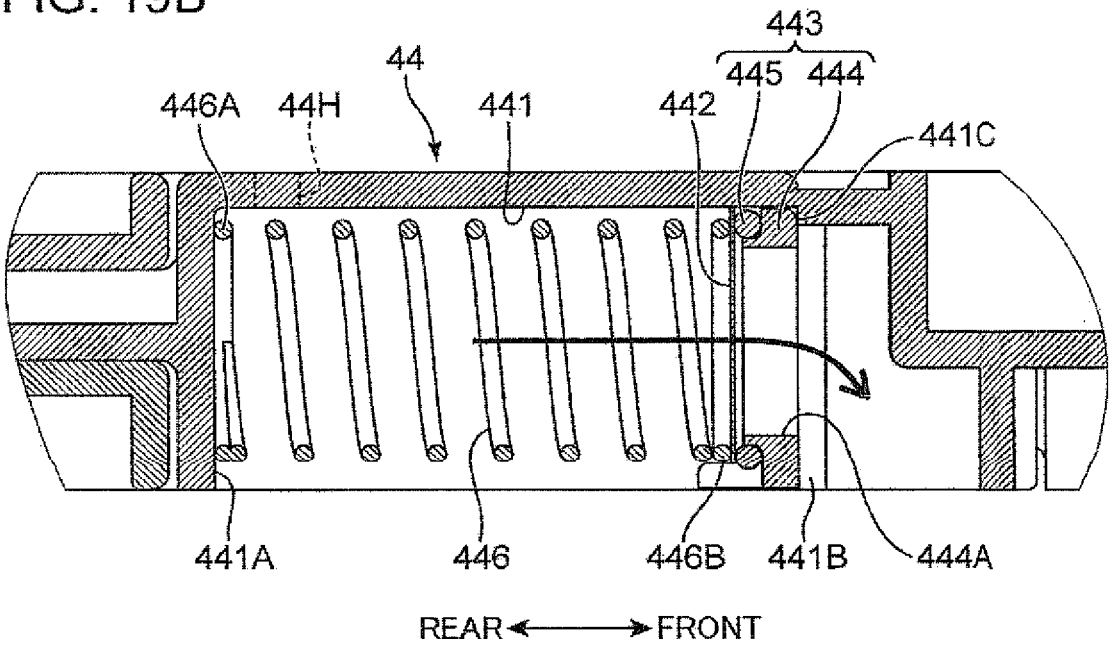
FIG. 19B is a cross-sectional view of the filter chamber in the front-rear direction.

Subsequently, the configuration of the filter chamber 44 will be described in detail. FIG. 19A is an exploded perspective view of the filter chamber 44, and FIG. 19B is a cross-sectional view of the filter chamber 44 in the front-rear direction. As described above, the filter chamber 44 has an inner wall surface 441 which divides a square tubular space. A filter member 442, a holding member 443, and a coil spring 446 are accommodated in this space.

The filter member 442 is a filtration member which removes foreign substances contained in the ink. The foreign substances herein are, for example, fluff or an agglomerate of ink liquid. In the present embodiment, the ink flows from the first chamber 41 into the second chamber 42 through the communication opening 43 where the on-off valve 6 is disposed. Then, when the on-off valve 6 seals the communication opening 43, a negative pressure operation of the pressing member 5 in the second chamber 42 is realized. When ink containing foreign substances is supplied to such an environment, the negative pressure operation can be hindered. In particular, if foreign substances are caught in the on-off valve 6, the movement of the on-off valve 6 in the lateral direction is hindered. Accordingly, there arises a drawback that the second chamber 42 cannot be maintained at a negative pressure. Further, when the foreign substances enter the head unit 21 on the downstream side of the second chamber 42, it is difficult to remove the foreign substances, and the ink ejection operation is hindered. The filter member 442 is disposed so as to prevent a malfunction caused by the inclusion of such foreign substances.

As the filter member 442, various filtration members can be used provided that the filter member 442 can trap the above-mentioned foreign substances and allows the ink liquid to pass through the filter member 442. For example, a woven cloth, a non-woven fabric filter, a sponge filter, a mesh filter and the like can be used as the filter member 442. In this embodiment, a filter member 442 formed of a sheet-like member having a quadrangular shape in a plan view is used. The size of the filter member 442 is set to be substantially the same as the size of a cross section of the inner wall surface 441 of the filter chamber 44 in the lateral direction.

The filter chamber 44 includes: an upstream end 441A disposed on the upstream side in the ink supply direction; and a downstream end 441B disposed on the downstream side in the ink supply direction. The inlet 44H is formed in the ceiling wall of the filter chamber 44 on an upstream end 441A side. An inflow port 447 (FIG. 25) is disposed upright just above the inlet 44H, and a downstream end 332 of the upstream pipe 33 is inserted into and connected to the inflow port 447. Therefore, the ink supplied from the ink cartridge IC flows from the inlet 44H to an upstream end 441A side of the filter chamber 44. A downstream end 441B of the filter chamber 44 communicates with the inflow portion 412, which is an upstream end of the first chamber 41.

In this embodiment, the filter member 442 is disposed near the downstream end 441B. As described above, there is a problem that foreign substances are caught in the on-off valve 6. Accordingly, the filter member 442 only needs to be disposed on an upstream side of the on-off valve 6. That is, the filter member 442 only needs to be disposed at any position of the ink supply passage between the ink cartridge IC and the first chamber 41, or at a position upstream of the on-off valve 6 in the first chamber 41. With such an arrangement, the foreign substances are trapped by the filter member 442 before reaching the communication opening 43 or the second chamber 42. Therefore, it is possible to prevent a problem that foreign substances are caught in the on-off valve 6 or a problem that foreign substances reach the head unit 21 from the second chamber 42. Accordingly, it is possible to prevent the occurrence of a malfunction of the liquid supply unit 3 caused by the inclusion of foreign substances.

The holding structure of the filter member 442 will be described. As shown in FIG. 19B, the filter member 442 is held (fixed) in such a manner that the filter member 442 is pressed against the holding member 443 by the coil spring 446. A peripheral edge portion of the filter member 442 is fixed to the holding member 443. Ink passes through a central region of the filter member 442 excluding the peripheral edge portion. During such an operation, the filter member 442 traps foreign substances (see an arrow in the figure).

The holding member 443 is disposed in the filter chamber 44 in the vicinity of the downstream end 441B. The holding member 443 includes: a frame member 444 having an opening 444A which serves as an ink flow path; and a ring-shaped seal member 445 supported by the frame member 444. The frame member 444 may be a molded product made of a hard resin. The seal member 445 may be a molded product made of a soft resin or rubber. The seal member 445 is fitted into a seat portion formed on a rear side surface of the frame member 444. The filter member 442 is brought into contact with a rear surface side of the seal member 445. A front surface of the frame member 444 engages with a stepped portion 441C formed at a downstream end 441B of the inner wall surface 441.

The coil spring 446 presses the peripheral edge portion of the filter member 442 against the rear surface side of the seal member 445. The coil spring 446 is accommodated in the filter chamber 44 so that a coil axis extends in the ink supply direction (front-rear direction). Specifically, the coil spring 446 is assembled in the filter chamber 44 such that the rear end 446A of the coil spring 446 is locked at an upstream end 441A of the inner wall surface 441 and the front end 446B of the coil spring 446 presses the peripheral edge portion of the filter member 442 toward the seal member 445.

According to the structure of the filter chamber 44 described above, the filter member 442 closes the opening 444A of the frame member 444 which holds the ring-shaped seal member 445. Therefore, foreign substances in the ink can be reliably trapped by the filter member 442. Further, the fixing of the filter member 442 and the holding member 443 can be achieved by a pressing force of the coil spring 446 without using an adhesive or the like. During the operation of the liquid supply unit 3, the filter member 442 is exposed in the liquid, and the peripheral portion serving as the fixing portion which fixes the filter member 442 to the holding member 443 is also immersed in the ink. There is a possibility that the ink becomes a solvent for the adhesive or the like. Therefore, when the filter member 442 is fixed using the adhesive or the like, the filter member 442 may be peeled off from the holding member 443, or the adhesive or the like may dissolve into the ink and become a foreign substance. Such a problem can be solved by the present embodiment which uses a pressing force of the coil spring 446. Further, by providing the filter chamber 44 as a dedicated chamber for filtering ink, the assembling property of assembling the filter member 442 to the liquid supply unit 3 is improved. Further, the provision of the filter chamber 44 enables the filter member 442 to reliably perform the filter function.

[Air Vent Mechanism Portion in Second Chamber]

Figure 20A:
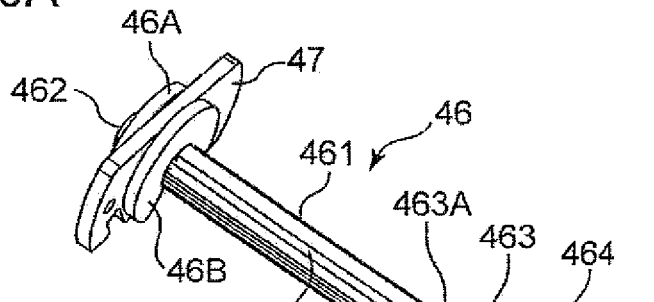
FIGS. 20A and 20B are perspective views of a lever member.
Figure 20B:
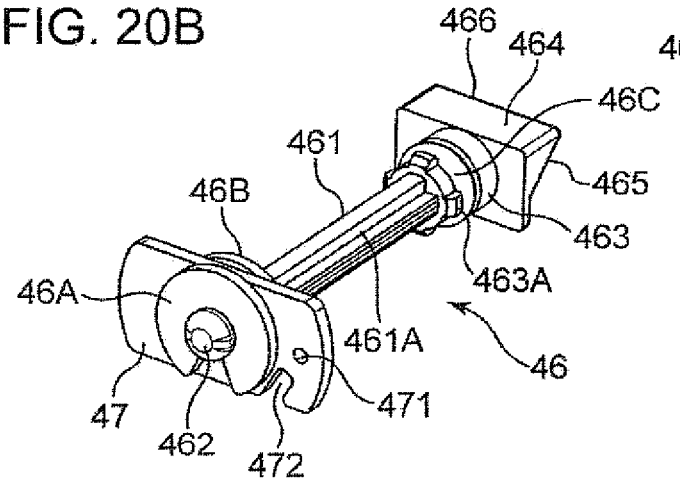
Figure 20C:
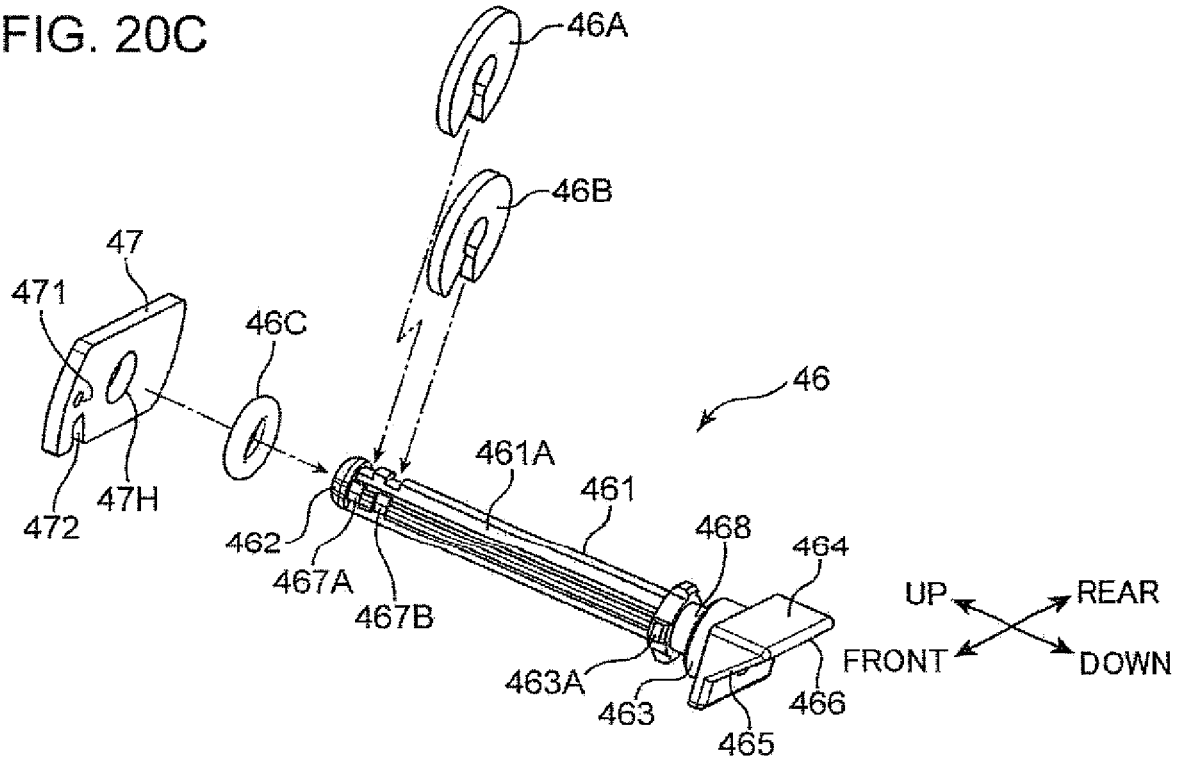
FIG. 20C is an exploded perspective view of the lever member.
Figure 21A:
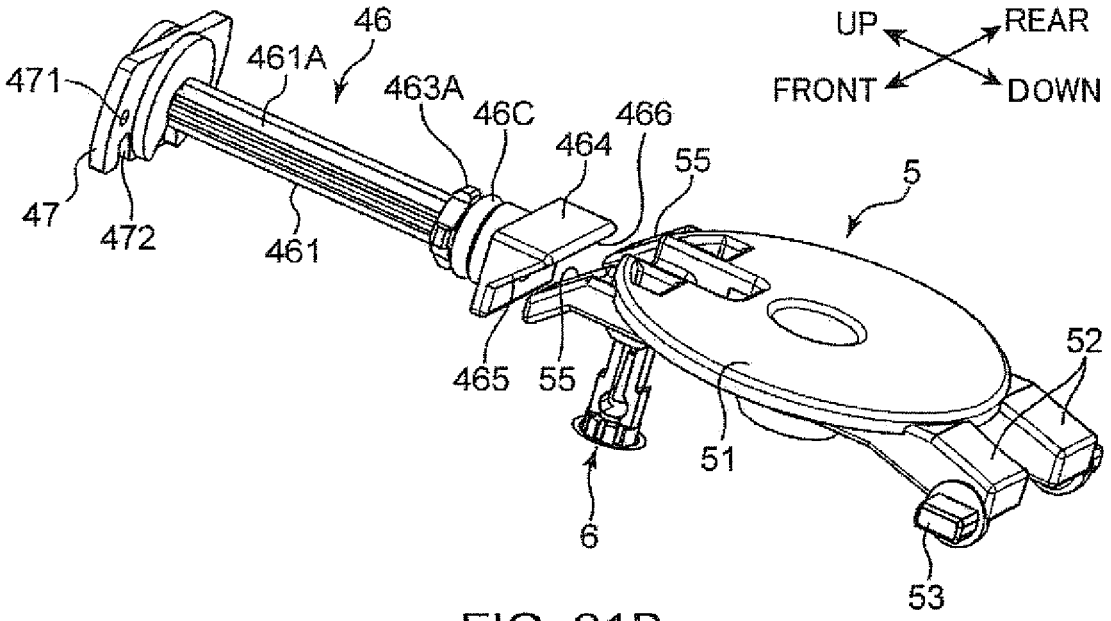
FIGS. 21A and 21B are perspective views of the pressing member, the on-off valve, and the lever member.
Figure 21B:
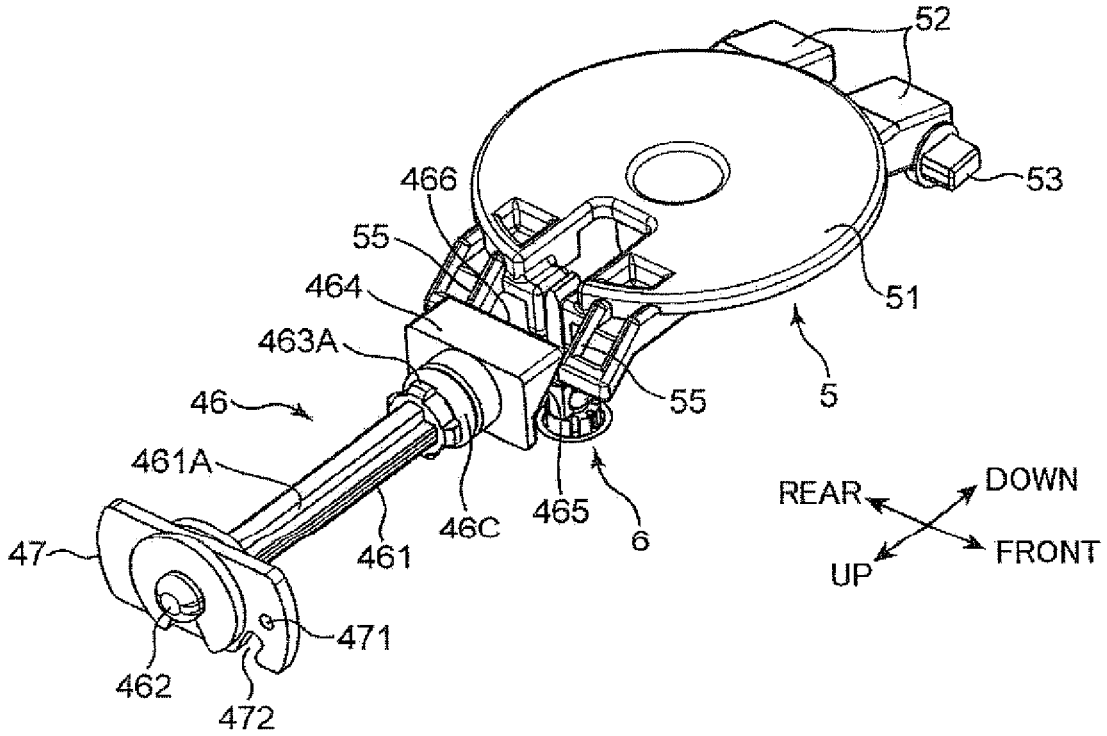
Figure 22A:
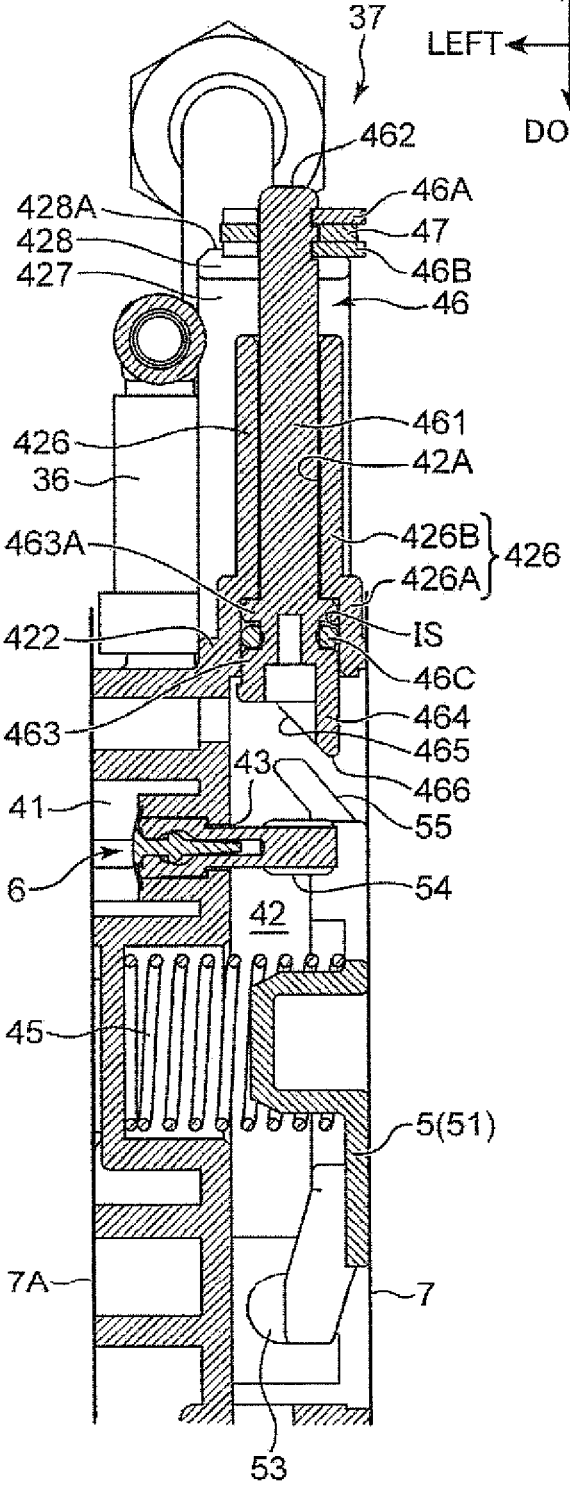
FIG. 22A is a cross-sectional view showing a state where the lever member is in a state before the lever member is operated.
Figure 22A:
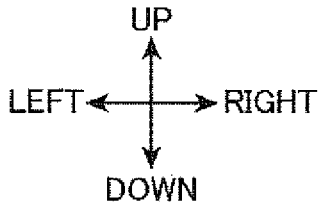
Figure 22B:
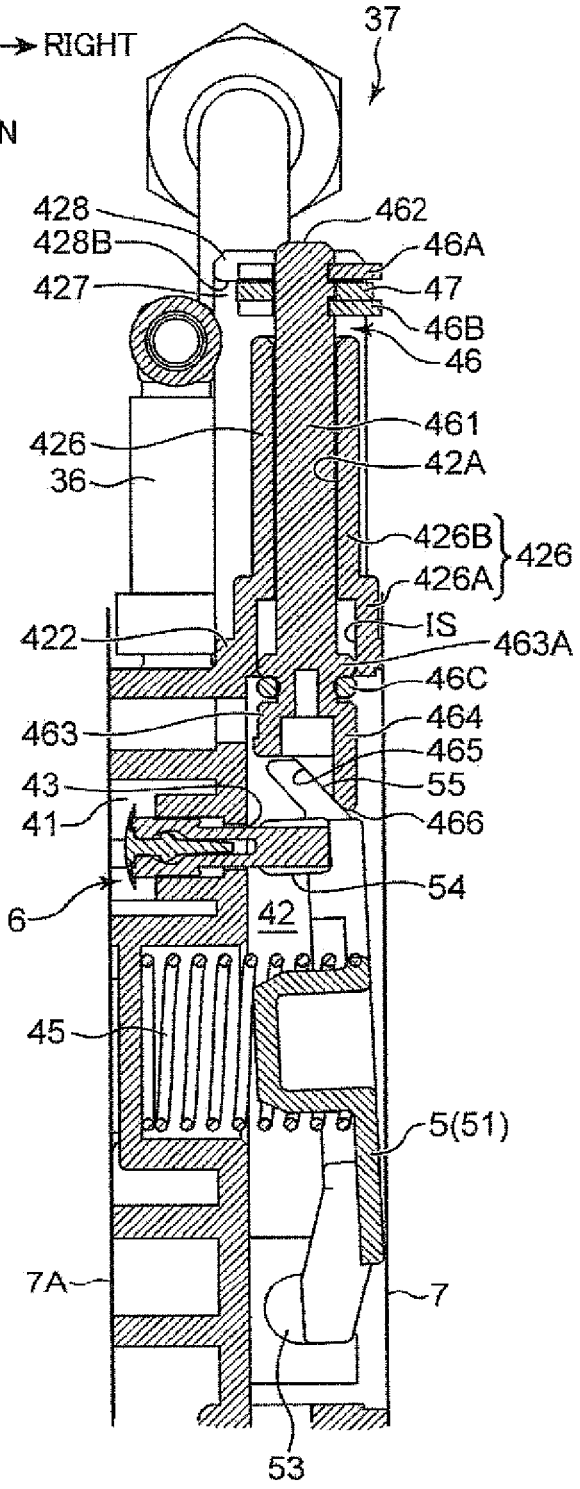
FIG. 22B is a cross-sectional view showing a state where air is vented by the operation of the lever member.

Next, the air vent mechanism portion 37 attached to the second chamber 42 will be described with reference to FIGS. 20 to 22 in addition to FIG. 12A described above. FIGS. 20A and 20B are perspective views of the lever member 46 which is a constituent member of the air vent mechanism portion 37, and FIG. 20C is an exploded perspective view of the lever member 46. FIGS. 21A and 21B are perspective views showing the positional relationship between the pressing member 5, the on-off valve 6, and the lever member 46. FIGS. 22A and 22B show the same cross section as FIG. 16A, and are cross-sectional views for explaining an air vent operation of the lever member 46. As described above, the air vent mechanism portion 37 is used for operations performed at an initial use time or after maintenance, such as: venting air when ink is initially filled in the second chamber 42; and degassing air bubbles generated from the ink.

The air vent mechanism portion 37 includes a lever member 46, a seal ring 46C, and a stopper 47 in addition to the above-mentioned boss portion 426 which is formed on the upper end portion 422 of the second chamber 42 in a protruding manner. As shown in FIG. 12A, the boss portion 426 protrudes from an uppermost end of the second partition wall 421 which defines the second chamber 42. The boss portion 426 includes an opening which makes the second chamber 42 communicate with the atmosphere. That is, the boss portion 426 includes a boss hole 42A, having a circular cross section, which functions as an air vent hole. By providing the boss hole 42A at the uppermost position of the second chamber 42, the degassing of the second chamber 42 can be reliably performed. The boss portion 426 has: a large diameter portion 426A positioned just above the upper end portion 422; and a small diameter portion 426B continuously connected to an upper side of the large diameter portion 426A. With respect to an inner diameter of the boss hole 42A, the inner diameter of the large diameter portion 426A is larger than the inner diameter of the small diameter portion 426B.

As shown in FIG. 20C, the lever member 46 has an excavator-like shape. The lever member 46 includes: a rod-shaped member 461 in which a part of the member 461 is inserted into the boss hole 42A; and a pressing piece 464 continuously connected to a lower side of the rod-shaped member 461. The lever member 46 is a kind of valve member which changes its posture between a sealing posture for sealing the boss hole 42A and a releasing posture for releasing the boss hole 42A. In the present embodiment, the posture changing operation of the lever member 46 and the posture changing operation of the on-off valve 6 are interlocked with each other via the pressing member 5. Specifically, when the lever member 46 is in the sealing posture state, the on-off valve 6 is allowed to assume the closed posture, and when the lever member 46 is in the releasing posture state, the posture of the on-off valve 6 is changed from the closed posture to the open posture.

The rod-shaped member 461 of the lever member 46 is a cylindrical body having an outer diameter smaller than a hole diameter of the boss hole 42A. The rod-shaped member 461 has an upper end portion 462 and a lower end portion 463. The upper end portion 462 forms an input portion which receives, from a user, an operating pressing force for pressing the lever member 46 downward. The lower end portion 463 is connected to the pressing piece 464. As shown in FIGS. 21A and 21B, the pressing piece 464 functions as a transmitting unit which transmits an operating pressing force applied to the upper end portion 462 to a receiving slanted surface 55 of the pressing member 5. An intermittent projection portion 463A is formed on the rod-shaped member 461 at a position slightly above the lower end portion 463. The intermittent projection portion 463A is formed of a plurality of small projections which are disposed annularly in a circumferential direction.

The pressing piece 464 has: a pressing slanted surface 465 tilted with respect to an axis of the rod-shaped member 461; and a lower end edge 466 extending in the front-rear direction at the lowermost end. The pressing slanted surface 465 is a slanted surface extending upward from the lower end edge 466 as a starting point. The pressing slanted surface 465 and the lower end edge 466 are portions which interfere with the pair of front and rear receiving slanted surfaces 55 of the pressing member 5 when the lever member 46 receives the operating pressing force. A front-rear width of the pressing slanted surface 465 is set to a size longer than a distance between the pair of receiving slanted surfaces 55. The pressing slanted surface 465 and the lower end edge 466 abut on the receiving slanted surface 55, and by transmitting the operating pressing force to the pressing member 5, the pressing member 5 rotates counterclockwise about the axis of the fulcrum portion 53, and causes the on-off valve 6 to change the posture from the closed posture to the open posture.

In the vicinity of the upper end portion 462 of the rod-shaped member 461, an upper engaging groove 467A and a lower engaging groove 467B are formed which are disposed in a spaced apart manner from each other in the vertical direction. An upper washer 46A is fitted into the upper engaging groove 467A, and a lower washer 46B is fitted into the lower engaging groove 467B. A seal groove 468 is disposed in the vicinity of the lower end portion 463. An outer diameter of the lower end portion 463 is set larger than outer diameters of other portions of the rod-shaped member 461, and the seal groove 468 is formed between the lower end portion 463 and the intermittent projection portions 463A. Further, air vent longitudinal grooves 461A are formed on the rod-shaped member 461 over the entire length of the rod-shaped member 461 in the front-rear direction. Each of the air vent longitudinal groove 461A is formed of a recessed groove. The circumferential positions of the air vent longitudinal grooves 461A and valley portions of the intermittent projection portion 463A are aligned with each other.

A seal ring 46C and a stopper 47 are mounted on the rod-shaped member 461. The seal ring 46C is an O-ring having an inner diameter slightly larger than an outer diameter of the rod-shaped member 461. The seal ring 46C allows the rod-shaped member 461 to pass therethrough, and is fitted into the seal groove 468. An outer peripheral surface of the seal ring 46C is brought into slide contact with an inner peripheral surface IS of the large diameter portion 426A of the boss portion 426 in a state where the seal ring 46C is mounted in the seal groove 468. The stopper 47 is a substantially rectangular plate member, and has a rotation hole 47H through which a rod-shaped member 461 is inserted. The mounting position of the stopper 47 is near the upper end portion 462, and is between the upper engaging groove 467A and the lower engaging groove 467B. The upper and lower washers 46A and 46B are fitted into the upper and lower engaging grooves 467A and 467B, respectively, so as to sandwich the stopper 47 thus restricting the axial movement of the stopper 47.

The stopper 47 can rotate about the axis of the rod-shaped member 461 in a state where the stopper 47 is interposed between the upper and lower washers 46A and 46B. The stopper 47 is a member which is scheduled to be brought into contact with the upper surface 428A or the lower surface 428B (FIG. 22) of the pair of locking claws 428 of the holding frame 427, corresponding to the vertical movement of the lever member 46. During the vertical movement described above, the stopper 47 is rotated so that the longitudinal direction becomes the lateral direction, and the stopper 47 passes through the gap between the pair of locking claws 428. A pin hole 471 and a locking recessed portion 472 are formed in the stopper 47. At least, when the stopper 47 comes into contact with the upper surfaces 428A, as shown in FIG. 12A, a split-pin-type pin member 48 is fitted into the pin hole 471 and the locking recessed portion 472 to prevent the rotation of the stopper 47 and the removal of the stopper 47. That is, the stopper 47 is fixed. The stopper 47, the pin member 48, and the pair of locking claws 428 function as a fixing mechanism for fixing the posture of the lever member 46.

Subsequently, the operation of the lever member 46 will be described. FIG. 22A is a cross-sectional view showing a state where the lever member 46 is before operation. FIG. 22B is a cross-sectional view showing a state where air vent of the second chamber 42 is performed by the operation of the lever member 46. FIG. 22A shows a state where an operating pressing force is not applied to the upper end portion 462 of the lever member 46. That is, FIG. 22A shows the sealing posture where the lever member 46 seals the boss hole 42A. On the other hand, FIG. 22B shows a state where the upper end portion 462 is pressed downward so that an operating pressing force is applied. That is, FIG. 22B shows a releasing posture where the lever member 46 releases the boss hole 42A.

The sealing posture is formed by making the pin members 48 fix both of the stopper 47 and the upper surface 428A of the locking claw 428 to each other in a state where the stopper 47 is brought into contact with the upper surface 428A of the locking claw 428. By this fixing, the lever member 46 is brought into a state where the lever member 46 is lifted upward. This state forms a state where the intermittent projection portions 463A and the lower end portion 463 of the rod-shaped member 461 are accommodated in the large diameter portion 426A of the boss portion 426. That is, a state is brought about where an outer peripheral surface of the seal ring 46C is in contact with an inner peripheral surface IS of the large diameter portion 426A. Therefore, the boss hole 42A is brought into a sealed state. The pressing piece 464 (the pressing slanted surface 465 and the lower end edge 466) of the lever member 46 is in a state where the pressing piece 464 is separated from the receiving slanted surface 55 of the pressing member 5 and hence, no force is applied to the pressing member 5. Therefore, the on-off valve 6 maintains the closed posture.

On the other hand, when the lever member 46 is lowered by receiving an operating pressing force and takes the releasing posture, the intermittent projection portions 463A and the lower end portion 463 are also lowered. Accordingly, the seal ring 46C separates from the inner peripheral surface IS. As a result, a state is brought about where an air passage formed of valley portions of the intermittent projection portions 463A and the air vent longitudinal grooves 461A of the rod-shaped member 461, and the space in the second chamber 42 communicate with each other. That is, the boss hole 42A is in a released state, and the second chamber 42 and the outside air communicate with each other. Therefore, a state is formed where air staying in the second chamber 42 can be discharged to the outside through the boss hole 42A.

Further, when the lever member 46 takes the releasing posture, the operating pressing force is transmitted to the pressing member 5. As shown in FIG. 22B, the pressing slanted surface 465 and the lower end edge 466 press the receiving slanted surface 55. When the receiving slanted surface 55 is pressed, the pressing member 5 (disk portion 51) rotates to the left about the axis of the fulcrum portion 53. As described above, when the pressing member 5 rotates to the left, the on-off valve 6 is pressed to the left via the link bosses 54, and the on-off valve 6 is changed from the closed posture to the open posture. As a result, the sealing of the communication opening 43 is released, and a state is brought about where the first chamber 41 and the second chamber 42 communicate with each other.

The releasing posture described above is formed by pressing the stopper 47 against the lower surface 428B of the locking claw 428. That is, when the releasing posture is taken, a state is brought about where the stopper 47 is pushed down and slips under the locking claw 428. Then, the receiving slanted surface 55 of the pressing piece 464 is pressed, and the pressing member 5 is rotated against the biasing force of the biasing spring 45 by such pressing. Accordingly, a biasing force of the biasing spring 45 is applied to the pressing piece 464. That is, a biasing force which lifts the lever member 46 upward acts on the lever member 46. By such a biasing force, the stopper 47 is pressed against the lower surface 428B of the locking claw 428, and the releasing posture is maintained.

In this way, when the lever member 46 takes the releasing posture, a state is brought about where the fluid inlet (communication opening 43) and the fluid outlet (boss hole 42A) are secured with respect to the second chamber 42. Therefore, at an initial use time, it is possible to smoothly perform an operation of filling ink from the first chamber 41 to the second chamber 42 through the communication opening 43 while venting air from the second chamber 42 through the boss hole 42A by making use of a water head difference supply. Further, there is a case where an amount of air in the second chamber 42 is increased due to the generation of air bubbles from ink (this phenomenon being checked by a monitor pipe 36 since an ink liquid level in the second chamber 42 is lowered). In such a case, by setting the lever member 46 at the releasing posture, venting of the air in the second chamber 42 can be easily performed.

In the above embodiment, by making use of the pressing member 5 which includes: the pressure receiving portion 5A which receives a displacement force from the atmospheric pressure detection film 7; and the link boss 54 which presses the on-off valve 6 by the displacement force received by the pressure receiving portion 5A, the posture of the on-off valve 6 is changed to the releasing posture in an interlocking manner with the operation of the lever member 46 which takes the open posture. That is, the structure is provided in which the fluid inlet and outlet with respect to the second chamber 42 can be secured by a one-touch operation of the lever member 46. Therefore, a user can easily perform an air vent operation of the second chamber 42. Further, the air vent mechanism portion 37 is disposed on an upper surface of the tank portion 31. Accordingly, as shown in FIG. 4, even in a state where a plurality of liquid supply units 3 are kept being mounted on the carriage 2, a user can get access to the air vent mechanism portion 37 from a front side of the carriage 2, and can perform an air vent operation for each liquid supply unit 3.

[Procedure for Air Vent Operation]

Figure 23B:
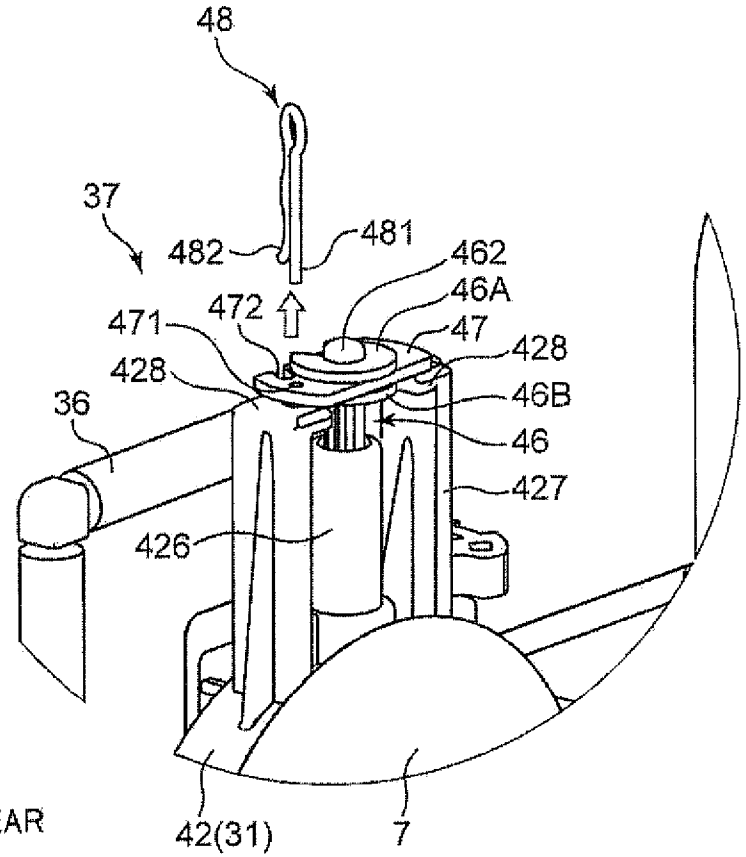
FIG. 23B is a perspective view showing the operation of the lever member.
Figure 23A:
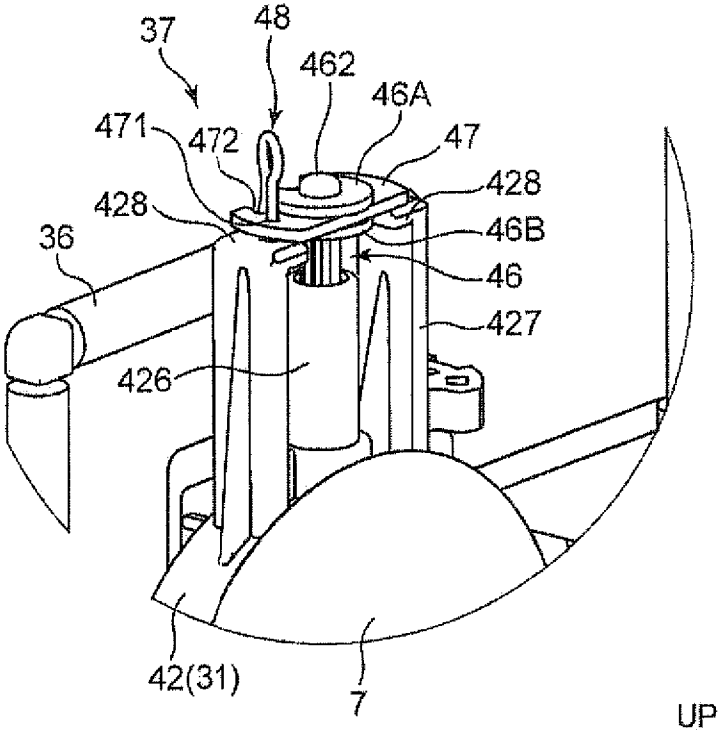
FIG. 23A is a perspective view of an air vent mechanism portion corresponding to the state shown in FIG. 22A.
Figure 23A:
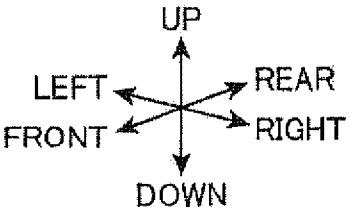
Figure 24B:
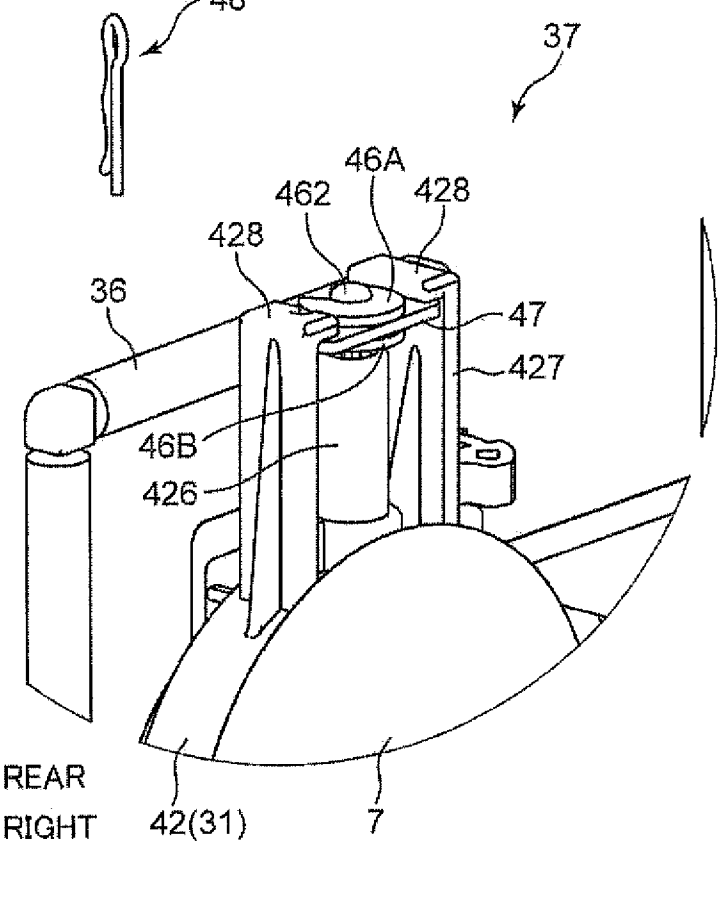
FIG. 24B is a perspective view of the air vent mechanism portion corresponding to the state in FIG. 22B.
Figure 24A:
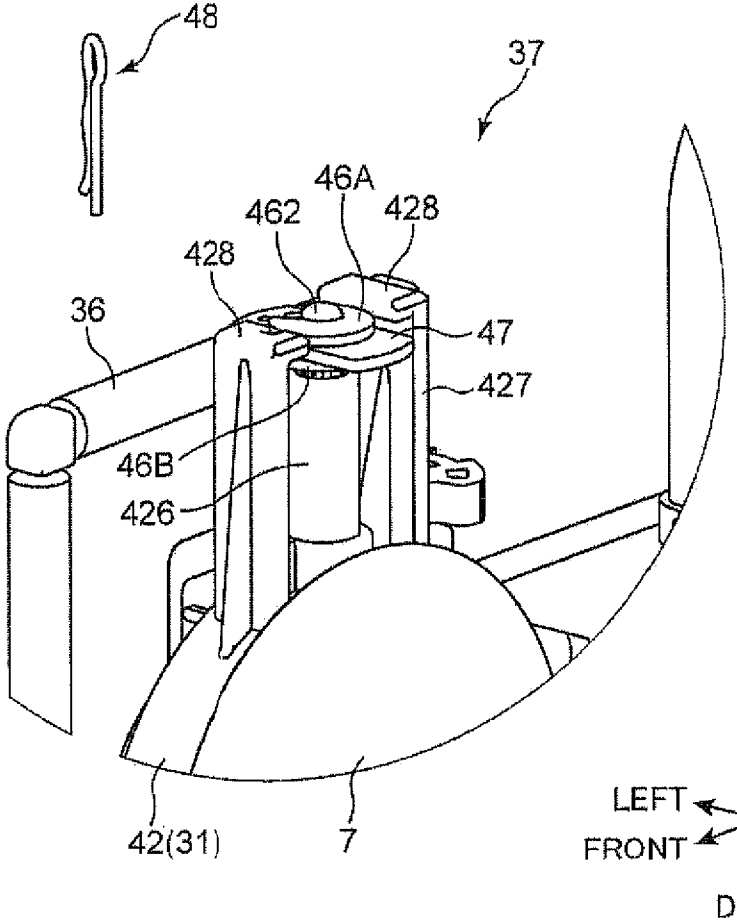
FIG. 24A is a perspective view showing the operation of the lever member.
Figure 24A:
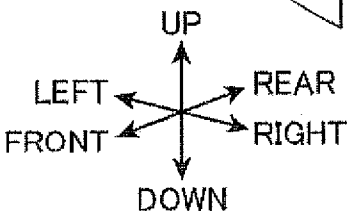

Subsequently, an example of the air vent operation in the air vent mechanism portion 37 will be described with reference to FIGS. 23A to 24B. FIG. 23A is a perspective view of the air vent mechanism portion 37 corresponding to a state shown in FIG. 22A. FIGS. 23B and 24A are perspective views showing the operation of the lever member 46. FIG. 24B is a perspective view of the air vent mechanism portion 37 corresponding to a state shown in FIG. 22B.

In the sealing postures shown in FIGS. 22A and 23A, as described above, in a state where the stopper 47 is in contact with the upper surface 428A of the locking claw 428, both the stopper 47 and the locking claw 428 are fixed to each other by the pin member 48. The stopper 47 is rotated so that its longitudinal direction is directed in the front-rear direction, and the front end side of the stopper 47 overlaps with the front locking claw 428 and the rear end side of the stopper 47 overlaps with the rear locking claw 428. The pin hole 471 and the locking recessed portion 472 of the stopper 47 are positioned on a front end side by the rotation. A notch portion is formed in the locking claw 428 on the front side at a position corresponding to the pin hole 471. A vertical portion 481 of the split pin type pin member 48 is inserted into the pin hole 471, and the engaging portion 482 whose lower end side is curved outward is fitted into the locking recessed portion 472, whereby the stopper 47 is fixed to the locking claw 428. In this state, the lever member 46 is brought into an upwardly suspended state, and the seal ring 46C abuts on an inner peripheral surface IS of the boss hole 42A to exert a sealing effect, and the pressing slanted surface 465 and the receiving slanted surface 55 are separated from each other.

In performing the air vent operation of the second chamber 42, as shown in FIG. 23B, the operator first pulls out the pin member 48 from the stopper 47. As a result, the stopper 47 is brought into a state where the stopper 47 is rotatable about the axis of the rod-shaped member 461. Subsequently, as shown in FIG. 24A, the operator rotates the stopper 47 by 90° so that its longitudinal direction is directed to the lateral direction. By this rotation, the stopper 47 is brought into a state where the stopper 47 can pass through the gap between the pair of front and rear locking claws 428 in the vertical direction. In this state, the operator pushes the upper end portion 462 and pushes down the lever member 46. This pushing-down operation is performed until the upper surface of the stopper 47 reaches a position below the lower surface 428B of the locking claw 428.

Then, as shown in FIG. 24B, the operator rotates the stopper 47 by 90° so that its longitudinal direction is directed in the above-mentioned direction. As a result, the front end side of the stopper 47 overlaps with the locking claw 428 on the front side from below, and the rear end side of the stopper 47 overlaps with the locking claw 428 on the rear side from below. In this state, as shown in FIG. 22B, the lever member 46 is brought into a state where the lever member 46 is pushed downward, and takes a releasing posture where the seal ring 46C is separated from the inner peripheral surface IS of the boss hole 42A and the sealing effect disappears. Further, an operating pressing force applied to the upper end portion 462 is transmitted from the pressing piece 464 to the receiving slanted surface 55, and the operating pressing force rotates the pressing member 5 against a biasing force of the biasing spring 45. A repulsive force of the biasing spring 45 generated at this time brings the stopper 47 into pressure contact with the lower surface 428B of the locking claw 428, thereby bringing the lever member 46 for the releasing posture into a fixed state.

In this way, regardless of whether the lever member 46 is in a sealing posture or in a releasing posture, those postures can be easily maintained by making use of the locking claws 428. For example, when the second chamber 42 is filled with the liquid at an initial use time, it is necessary to vent the air from the second chamber 42. Accordingly, it is necessary to maintain the lever member 46 in the releasing posture. In this case, an operator may press down the upper end portion 462 of the lever member 46 and may perform an operation of slipping the stopper 47 under the lower surface 428B of the locking claw 428. Therefore, the operator does not have to keep pressing the upper end portion 462 and hence, the operability can be improved. Further, during a normal use of the liquid supply unit 3, it is necessary to bring the lever member 46 into a sealing posture. In this case, it is sufficient to make the stopper 47 overlap with the upper surface 428A of the locking claw 428 and to fix the stopper 47 to the upper surface 428A by the pin member 48. Accordingly, the fixing operation can be performed with a simple operation.

[Backflow Prevention Mechanism]

Figure 25:
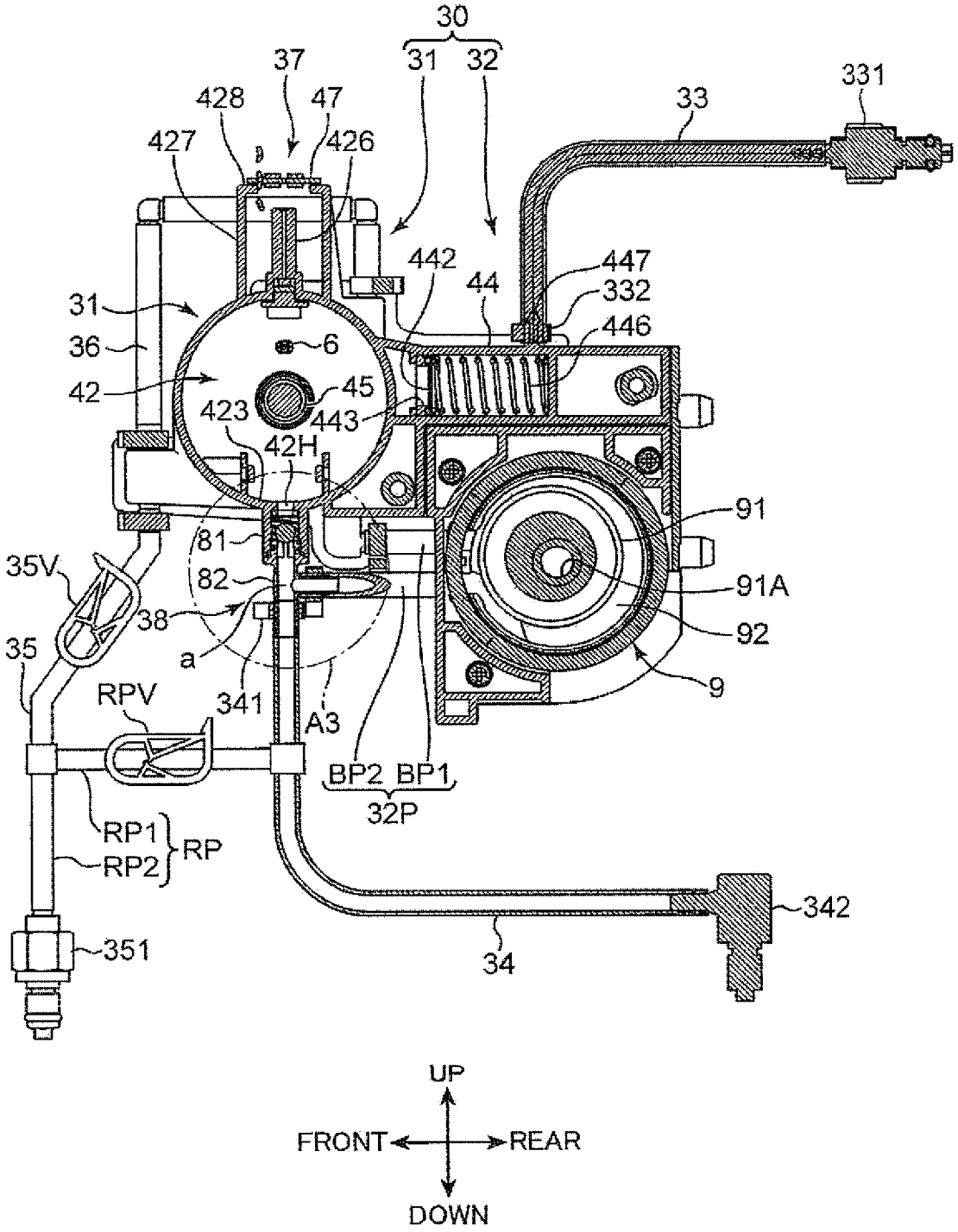
FIG. 25 is a cross-sectional view of the liquid supply unit in the front-rear direction.
Figure 26:
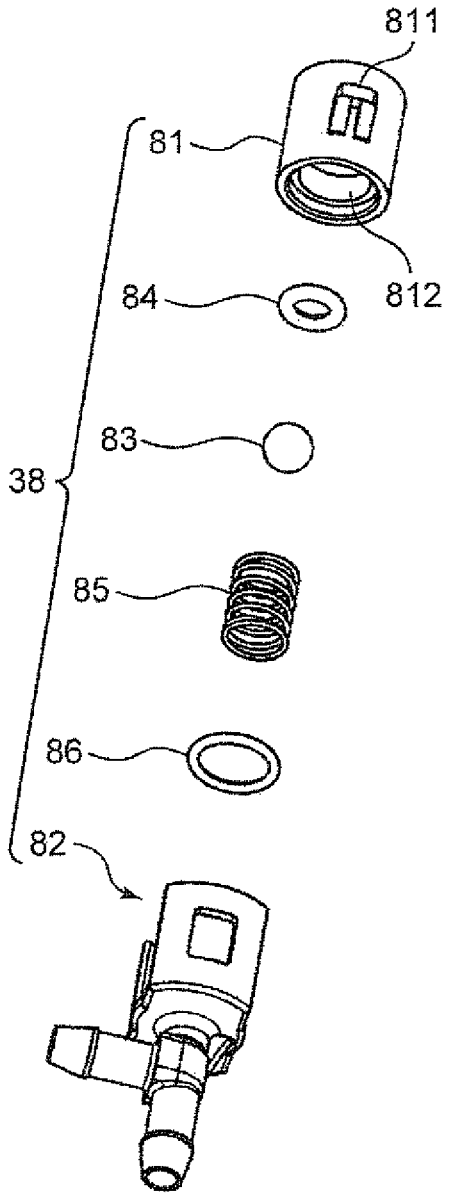
FIG. 26 is an exploded perspective view of a backflow prevention mechanism.
Figure 27C:
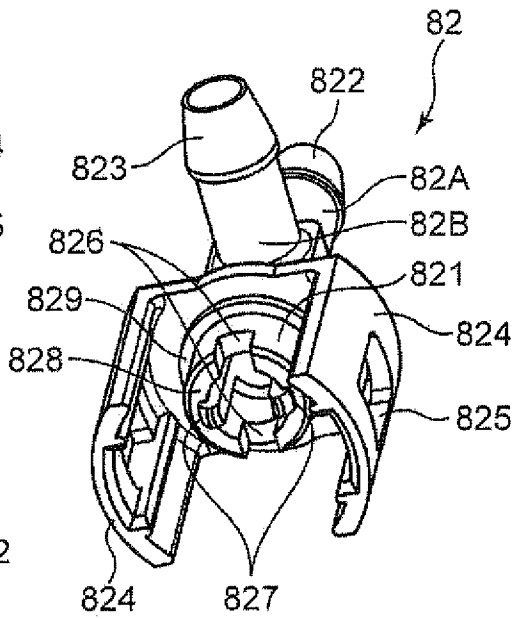
FIG. 27C is a perspective view of a branched head portion.
Figure 27B:
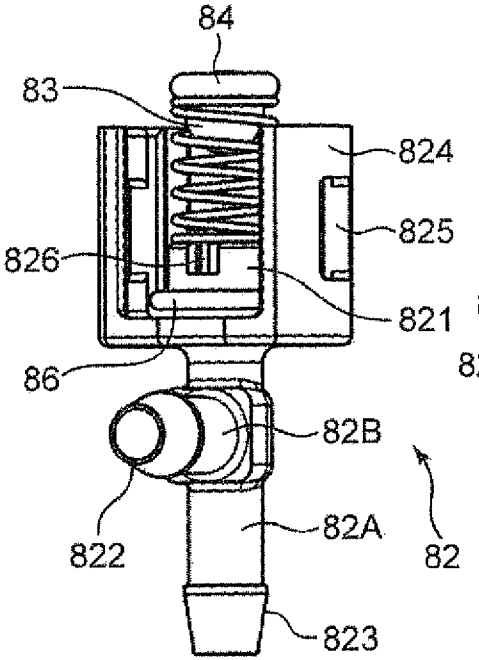
FIG. 27B shows a state where the spherical body closes the valve conduit.
Figure 27A:
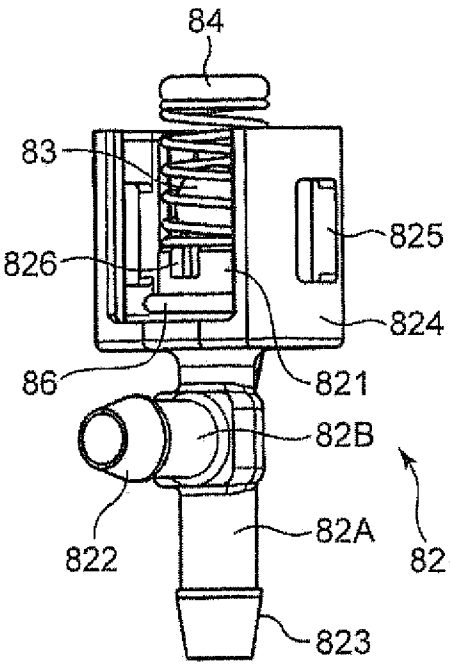
FIG. 27A is a perspective view of the backflow prevention mechanism showing a state where a spherical body opens a valve conduit.
Figure 28B:
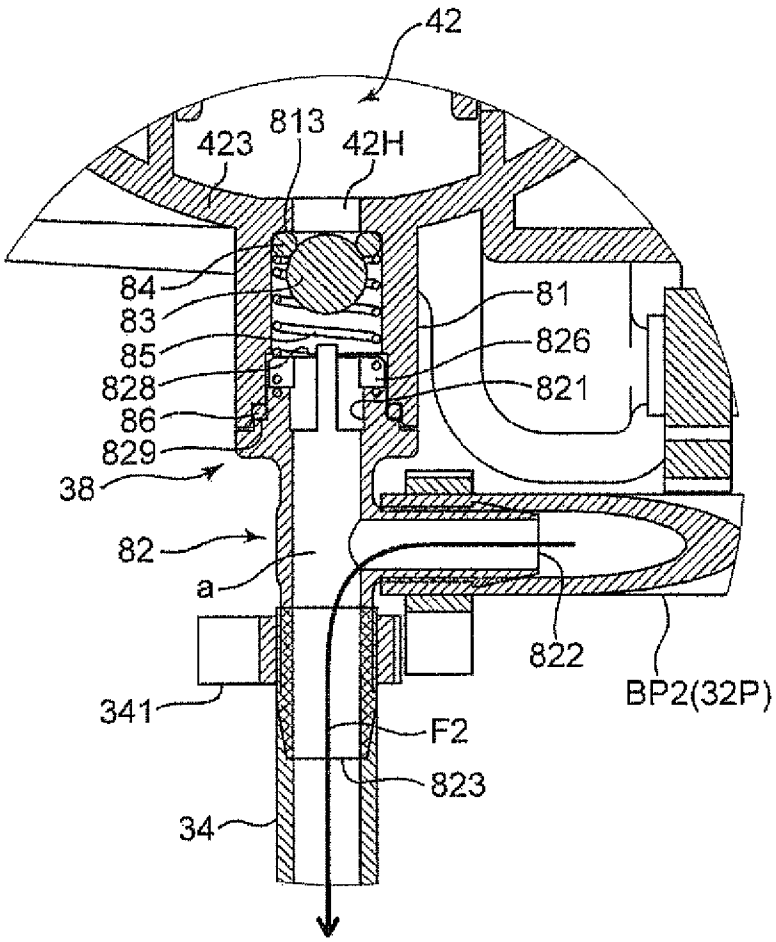
FIG. 28B is a cross-sectional view showing a state of the backflow prevention mechanism in the pressurized purge mode.
Figure 28A:
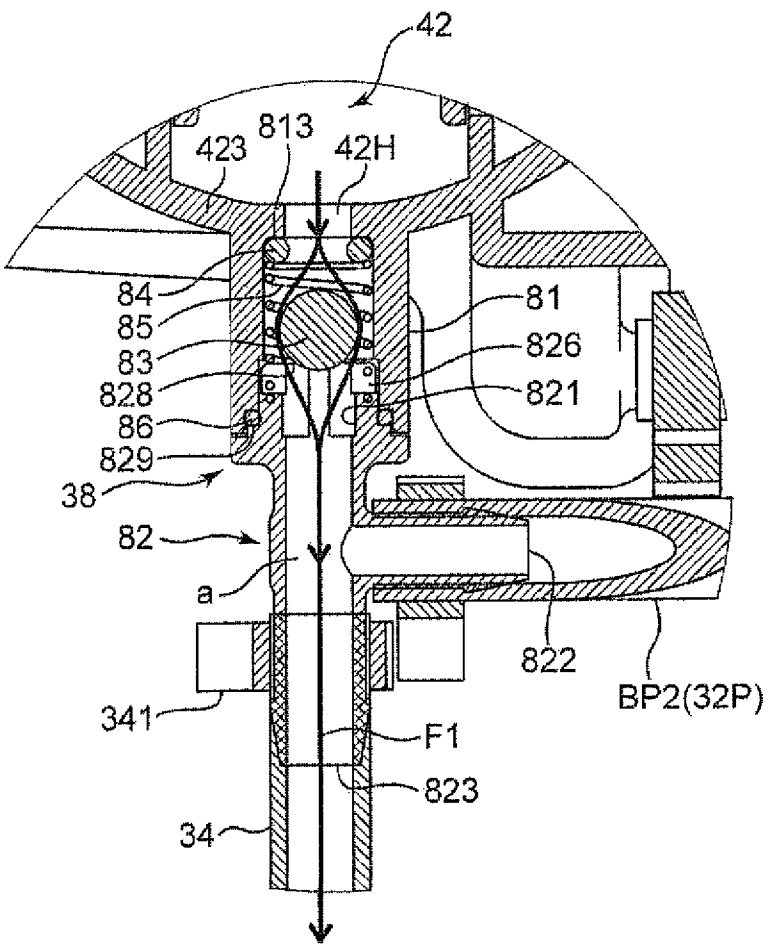
FIG. 28A is a cross-sectional view showing a state of the backflow prevention mechanism in the print mode.

Next, the configuration of the backflow prevention mechanism portion 38 is described. The backflow prevention mechanism portion 38 prevents ink pressurized by the pump 9 from flowing back to the second chamber 42 when the pressurized purge mode described with reference to FIG. 9A is performed. FIG. 25 is a cross-sectional view of the liquid supply unit 3 in the front-rear direction including a cross section of the backflow prevention mechanism portion 38. FIG. 26 is an exploded perspective view of the backflow prevention mechanism portion 38. FIGS. 27A to 27C are perspective views of the backflow prevention mechanism portion 38. FIGS. 28A and 28B are enlarged views of an A3 portion in FIG. 25. FIG. 28A is a cross-sectional view showing a state of the backflow prevention mechanism portion 38 in a print mode, and FIG. 28B is a cross-sectional view showing the state of the backflow prevention mechanism portion 38 in a pressurized purge mode.

The backflow prevention mechanism portion 38 includes a valve conduit 81, a branched head portion 82, a spherical body 83, a seal member 84, a coil spring 85, and an O-ring 86. The valve conduit 81 is a member which forms an integral body with the lower end portion 423 of the second chamber 42. Other parts are assembled to the valve conduit 81. FIG. 27A and FIG. 27B are perspective views of the backflow prevention mechanism portion 38 excluding the valve conduit 81. FIG. 27C is a perspective view of the branched head portion 82 as viewed from below.

The valve conduit 81 is a conduit extending vertically downward from the supply hole 42H formed in the lower end portion 423 (lowermost end portion) of the second chamber 42. The valve conduit 81 is a portion integrally formed with the second partition wall 421. The valve conduit 81 provides an ink flow path connecting the second chamber 42 and the downstream pipe 34 to each other. The valve conduit 81 forms a part of an ink supply passage from the second chamber 42 to the ink ejecting portion 22. In order to lock the branched head portion 82, locking pieces 811 are formed on an outer peripheral surface of the valve conduit 81, and fitting annular projections 812 are formed on an inner peripheral surface.

The branched head portion 82 is a member which forms the joint part a described above with reference to FIGS. 7 to 9B. The branched head portion 82 includes a first inlet port 821, a second inlet port 822, an outlet port 823, a body portion 824, locking windows 825, notch portions 826, and fitting claws 827. The first inlet port 821 is a port connected to the second chamber 42. In the present embodiment, the first inlet port 821 communicates with the second chamber 42 via the valve conduit 81. The second inlet port 822 is a port to which a downstream end of the bypass pipe 32P (downstream bypass pipe BP2) is connected. The outlet port 823 is a port to which the upstream end 341 of the downstream pipe 34 is connected.

The branched head portion 82 is a T-shaped pipe which includes a vertical portion 82A and a horizontal portion 82B. The vertical portion 82A extends vertically downward from a lower end side of the valve conduit 81. The horizontal portion 82B is configured to join with an intermediate portion of the vertical portion 82A from the horizontal direction. An upper end of the vertical portion 82A forms the first inlet port 821, and a lower end side forms the outlet port 823. A distal end of the horizontal portion 82B forms the second inlet port 822. In the print mode described above, ink is supplied to the downstream pipe 34 through the first inlet port 821. On the other hand, in the pressurized purge mode, the ink is supplied to the downstream pipe 34 through the second inlet port 822.

The body portion 824 is formed of a pair of arc pieces disposed so as to face each other on the outside of the first inlet port 821 which faces downward. The valve conduit 81 enters a gap formed between the pair of body portions 824 and the first inlet port 821. The locking windows 825 are openings formed in the pair of body portions 824. The locking windows 825 are openings with which the locking pieces 811 of the valve conduit 81 engage. The notch portions 826 are portions formed by cutting away portions of a peripheral wall of the tubular first inlet port 821. The notch portions 826 are portions for securing an ink flow path. The fitting claws 827 are hook-shaped portions protruding upward from an upper end of the first inlet port 821. The fitting claws 827 engage with the fitting annular projections 812 of the valve conduit 81. That is, the branched head portion 82 is fixed to the valve conduit 81 by the engagement between the locking piece 811 and the locking window 825 on an inner periphery of the valve conduit 81, and by the engagement between the fitting annular projection 812 and the fitting claw 827 on an outer periphery of the valve conduit 81. An upper end edge 828 of the first inlet port 821 forms a ball receiving portion for receiving the spherical body 83 described below.

The spherical body 83 is movably accommodated in the valve conduit 81 in the ink supply direction and acts as a valve. An outer diameter of the spherical body 83 is smaller than an inner diameter of the valve conduit 81, and is also smaller than an inner diameter of the coil spring 85. Various materials can be used as a material for forming the spherical body 83. However, it is preferable to form the spherical body 83 using a material having a specific gravity twice or less as large as a specific gravity of ink. Particularly desirable is a material having a specific gravity which falls within a range of 1.1 to 1.5 times as large as the specific gravity of the ink. In the case where the specific gravity of the material falls within this range, the specific gravity of the spherical body 83 is larger than the specific gravity of the ink. Accordingly, the spherical body 83 can be easily lowered by its own weight in the valve conduit 81. On the other hand, the relationship exists between the spherical body 83 and the ink such that the specific gravity of the spherical body 83 is close to the specific gravity of the ink. Accordingly, the spherical body 83 can be quickly lifted in the valve conduit 81 during a pressurized purge operation.

Generally, ink used in an inkjet printer is a water-soluble liquid, and has a specific gravity of 1 or a specific gravity near 1. Therefore, it is desirable to select a material having a specific gravity smaller than 2 as the material of the spherical body 83. Further, it is desirable that the material have both chemical resistance property and abrasion resistance property so that the spherical body 83 does not deteriorate even when the spherical body 83 is constantly in contact with ink. From these viewpoints, as a material of the spherical body 83, it is particularly preferable to use polyacetal (specific gravity=1.42), polybutylene terephthalate (specific gravity=1.31 to 1.38), polyvinyl chloride (specific gravity=1.35 to 1.45), or polyethylene terephthalate (specific gravity=1.34 to 1.39).

As shown in FIGS. 28A and 28B, the seal member 84 is a seal part having a ring shape, which is disposed above the spherical body 83 and is seated on a seat portion 813 formed on an upper end side of the valve conduit 81. A ring inner diameter (a through hole) of the seal member 84 is set to be smaller than an outer diameter of the spherical body 83. As shown in FIG. 28A, when the spherical body 83 is separated downward from the seal member 84, the valve conduit 81 is opened. On the other hand, as shown in FIG. 28B, when the spherical body 83 is brought into contact with the seal member 84, the valve conduit 81 is closed.

The coil spring 85 is a compression spring which is disposed in the valve conduit 81 such that an upper end portion of the coil spring 85 abuts on the seal member 84 and a lower end portion of the coil spring 85 abuts on an upper end edge 828 of the first inlet port 821 of the branched head portion 82. The coil spring 85 biases the seal member 84 toward the seat portion 813 and hence, the seal member 84 is constantly brought into pressure contact with the seat portion 813. The spherical body 83 is accommodated in the coil spring 85, and the coil spring 85 also serves to guide the movement of the spherical body 83 in the ink supply direction. Therefore, the free movement of the spherical body 83 in the valve conduit 81 is restricted. Accordingly, the valve structure which is realized by making the spherical body 83 separated from and contacting with the seal member 84 can be operated in a stable manner.

The O-ring 86 seals an abutting portion between the valve conduit 81 and the branched head portion 82. The O-ring 86 is fitted on an outer peripheral surface of the first inlet port 821 and is in contact with a protruding proximal portion 829 of the first inlet port 821.

FIG. 25 shows the pump 9 accommodated in the pump portion 32. The pump 9 is disposed in the bypass pipe 32P, and pressurizes ink flowing through the bypass pipe 32P. The pump 9 can deliver ink from the ink cartridge IC to the head unit 21 through the upstream pipe 33 and the downstream pipe 34. In the present embodiment, as the pump 9, the tube pump which includes the eccentric cam 91 and the squeeze tube 92 is exemplified. The cam shaft 93 (FIG. 4) which forms a rotary shaft of the eccentric cam 91 is inserted into a shaft hole 91A formed in the eccentric cam 91. A rotational drive force is given to the eccentric cam 91 from a drive gear (not illustrated). The squeeze tube 92 is disposed on a peripheral surface of the eccentric cam 91. The squeeze tube 92 is squeezed by the rotation of the eccentric cam 91 around the cam shaft 93 and delivers the ink in the tube from one end side toward the other end side of the squeeze tube 92. In this embodiment, the squeeze tube 92 is a tube formed integrally with the bypass pipe 32P. That is, one end side of the squeeze tube 92 forms the upstream bypass pipe BP1 communicating with the bypass communication chamber 413 of the first chamber 41. The other end side of the squeeze tube 92 forms the downstream bypass pipe BP2 communicating with the second inlet port 822 of the branched head portion 82. A central portion of the squeeze tube 92 forms a squeezing portion disposed on the peripheral surface of the eccentric cam 91.

As described above, the pump 9 is brought into a stopped state in the print mode shown in FIG. 7. In this case, the eccentric cam 91 collapses the squeeze tube 92 and stops the supply of ink and hence, the ink supply passage passing through the bypass pipe 32P is closed. On the other hand, in the circulation mode shown in FIG. 8A, in the liquid drain mode shown in FIG. 8B, and in the pressurized purge mode shown in FIG. 9A, the pump 9 is driven in the forward rotation direction. In FIG. 25, the forward rotation direction of the eccentric cam 91 is a counterclockwise direction. By this forward rotation driving of the pump 9, the ink is sucked from the first chamber 41 through the upstream bypass pipe BP1, and flows toward the backflow prevention mechanism portion 38, which is the joint part a, from the downstream bypass pipe BP2. When the pump 9 is driven in the reverse rotation direction, as shown in FIG. 9B, a negative pressure is generated in the second chamber 42 and the downstream pipe 34 through the bypass pipe 32P and the branched head portion 82.

Subsequently, the operation of the backflow prevention mechanism portion 38 will be described. In the print mode, ink is supplied from the second chamber 42 to the head unit 21 via a supply route which passes through the backflow prevention mechanism portion 38 and the downstream pipe 34. In such a print mode, as shown in FIG. 28A, the spherical body 83 is separated downward from the seal member 84 and a state is brought about where the spherical body 83 lands on an upper end edge 828 (ball receiving portion) of the branched head portion 82. This is because the specific gravity of the spherical body 83 is larger than the specific gravity of the ink, and the spherical body 83 is lowered by its own weight. Further, the supply route of the ink from the second chamber 42 to the downstream pipe 34 is maintained at a negative pressure in the print mode and hence, each time the ink ejecting portion 22 of the head unit 21 ejects ink droplets, the ink existing in the supply route is sucked. This sucking operation also contributes to maintaining the landing state of the spherical body 83 on the upper end edge 828.

Since the state is brought about where the spherical body 83 is separated from the seal member 84, the supply hole 42H is brought into an opened state. Further, since the notch portion 826 is formed at the upper end edge 828 of the first inlet port 821 on which the spherical body 83 lands, an ink passage is secured. Therefore, the ink in the second chamber 42 can pass through from the second chamber 42 to the branched head portion 82 and can advance to the downstream pipe 34 as indicated by an arrow F1 in the figure.

FIG. 28B is a cross-sectional view showing a state of the backflow prevention mechanism portion 38 in a pressurized purge mode (and a liquid drain mode). In the pressurized purge mode, by the forward rotation driving of the pump 9, the pressurized ink is supplied to the second inlet port 822 (joint part a) of the branched head portion 82 through the bypass pipe 32P. Therefore, the pressurized ink exists in the bypass pipe 32P and the downstream pipe 34 positioned on the downstream side of the joint part a. In this case, the ink is pressurized to a high pressure exceeding 100 kPa. If such a high pressure is applied to the second chamber 42, the atmospheric pressure detection film 7 which partitions a part of the second chamber 42 may be broken or a mounting portion of the atmospheric pressure detection film 7 to the second partition wall 421 may be peeled off.

However, in the present embodiment, the spherical body 83 is pressed and is lifted (is moved to the upstream side in the ink supply direction) by a pressing force applied to the joint part a, and the spherical body 83 is brought into contact with the seal member 84. That is, the spherical body 83 is brought into an upwardly lifted state by the pressing described above and is fitted into the ring of the seal member 84. When the spherical body 83 is brought into contact with the seal member 84 which is pressed against the seat portion 813 by the coil spring 85, the supply hole 42H is brought into a closed state. That is, with respect to the ink supply passage in the print mode, the ink supply passage and the second chamber 42 positioned on the upstream side of the joint part a are blocked from being pressurized by the pressurized ink. Therefore, it is possible to prevent the atmospheric pressure detection film 7 from being damaged.

Further, the present embodiment has an advantage that the ink in which air is trapped is hardly supplied to the head unit 21. There is a case where air dissolved in ink or air mixed in an ink liquid at the time of filling the liquid supply unit 3 with the ink liquid advances to the head unit 21 in a state where the air is trapped by the ink, and enters the individual passages 26 and the common passage 27 (FIG. 6). Once such a phenomenon occurs, the air is hardly removed and may not be easily eliminated even when pressurized purge is performed. In this case, the ejection of the ink from the ink discharge hole 22H is hindered. However, in the present embodiment, the second chamber 42, the backflow prevention mechanism portion 38, and the downstream pipe 34 are disposed in this order from the upper side to the lower side. Therefore, there is no possibility that the air generated from the ink stored in the second chamber 42 or the air mixed in the second chamber 42 advances downward to the backflow prevention mechanism portion 38 and the downstream pipe 34 disposed on the lower side. Therefore, it is possible to prevent the ink in which air is trapped from advancing to the head unit 21. Accordingly, it is possible to prevent the ejection failure of the head unit 21 in advance.

Further, even when air is mixed in the branched head portion 82 or the downstream pipe 34, the air can be made to escape into the second chamber 42 from the vertical portion 82A through the valve conduit 81 and the supply hole 42H by a floating action of the air bubbles. The air described above can be discharged from the second chamber 42 by the air vent mechanism portion 37. Therefore, it is possible to prevent the volume in the second chamber 42 from being excessively occupied by the air described above.

[Double Protection Mechanism by Umbrella Valve]

As described above, in the present embodiment, the backflow prevention mechanism portion 38 is provided to prevent the ink pressurized in the pressurized purge mode from flowing back to the second chamber 42. However, due to some malfunction of the backflow prevention mechanism portion 38, for example, due to a malfunction of the spherical body 83, a pressing force may act on the second chamber 42. In view of this point, in the present embodiment, a double protection mechanism is adopted. That is, a mechanism for releasing a pressure to the on-off valve 6 is provided. In other words, the on-off valve 6 includes a pressure release mechanism. The pressure release mechanism releases the pressure from the second chamber 42 to the first chamber 41 when the pressure relationship that the second chamber 42 is at a negative pressure and the first chamber 41 is at an atmospheric pressure+ρgh under a normal condition is reversed so that the pressure in the second chamber 42 becomes higher than the pressure in the first chamber 41.

The umbrella valve 66 of the on-off valve 6 plays the role of such a pressure release mechanism. As described with reference to FIGS. 16 and 17, in the umbrella valve 66, when the second chamber 42 is at a negative pressure below a predetermined threshold value, the sealing surface 67 abuts on the sealing wall surface 43S so as to seal the communication opening 43. As a result, the inflow of ink from the first chamber 41 to the second chamber 42 is prohibited. On the other hand, when the second chamber 42 becomes a negative pressure exceeding a predetermined threshold value, the umbrella valve 66 moves to the left together with the valve holder 61 which is connected to the pressing member 5 by link connection. Accordingly, the sealing surface 67 separates from the sealing wall surface 43S, and the communication opening 43 is opened (sealing being released). As a result, the inflow of ink from the first chamber 41 to the second chamber 42 is allowed.

In addition, when the pressure relationship between the second chamber 42 and the first chamber 41 is reversed due to factors such as the pressure of the pressurized ink is being applied to the second chamber 42 in a pressurized purge mode, the umbrella valve 66 alone releases the communication opening 43. That is, the umbrella valve 66 releases a sealed state of the communication opening 43 and releases the pressure in the second chamber 42 to the first chamber 41 without receiving the pressing assist from the pressing member 5. That is, an umbrella shape of the umbrella portion 661 (sealing surface 67) of the umbrella valve 66 is inverted when a predetermined pressure is applied to the right surface side of the umbrella portion 661.

Figure 29B:
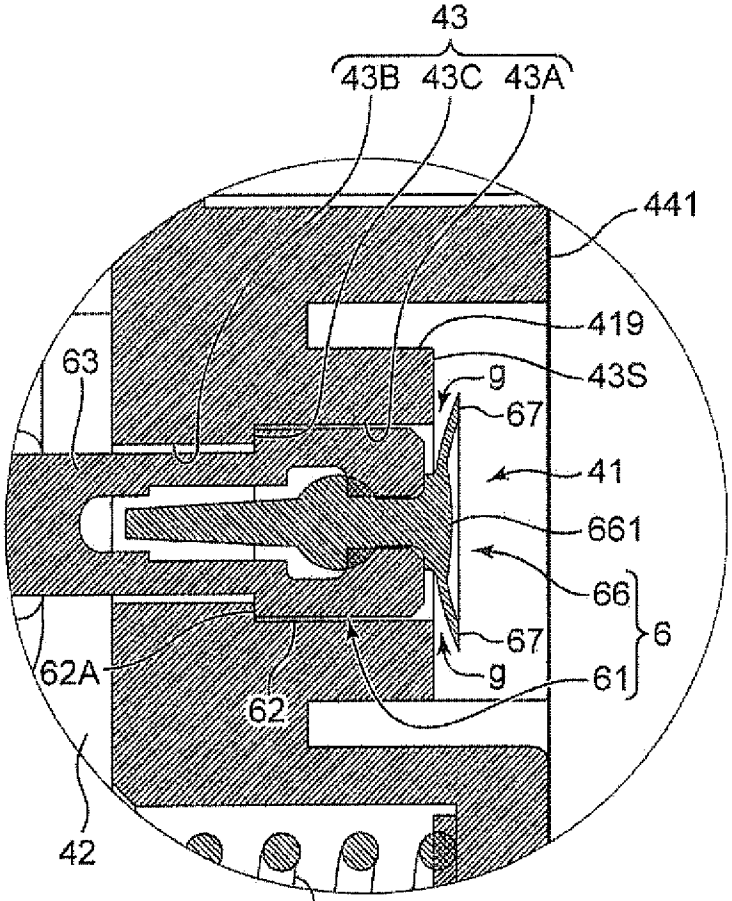
FIG. 29B is a cross-sectional view showing a state where the umbrella valve releases the communication opening.
Figure 29A:
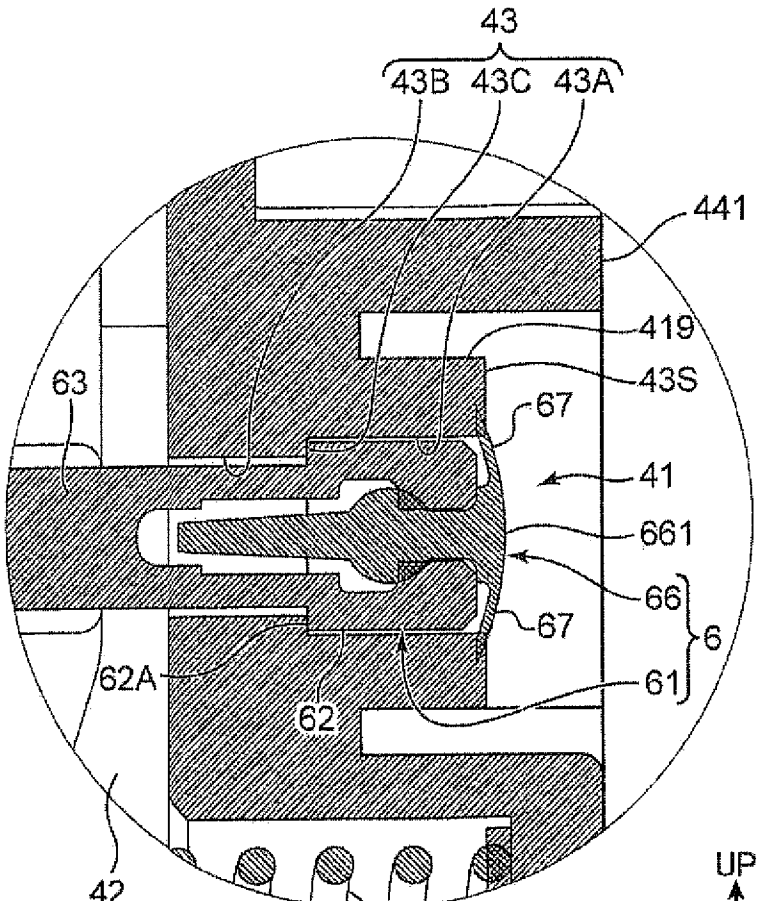
FIG. 29A is a cross-sectional view showing a state where an umbrella valve seals a communication opening.
Figure 29A:
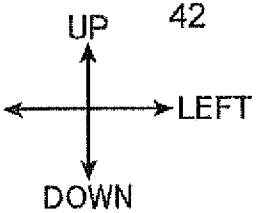

FIG. 29A is a cross-sectional view showing a state where the umbrella valve 66 seals the communication opening 43, and FIG. 29B is a cross-sectional view showing a state where the umbrella valve 66 releases the communication opening 43. The state shown in FIG. 29A is equivalent to the state of FIG. 16B described above. The umbrella portion 661 has an umbrella shape which is convex toward the left. Further, the valve holder 61 is positioned on the rightmost side by a biasing force of the biasing spring 45, and the annular contact portion 62A is brought into contact with and stopped by the stepped portion 43C of the communication opening 43. Therefore, a state is brought about where the sealing surface 67 is in contact with the sealing wall surface 43S.

The state shown in FIG. 29B is a state where the umbrella shape of the umbrella portion 661 of the umbrella valve 66 is reversed by a pressure applied from the second chamber 42 side. That is, the umbrella portion 661 is deformed into an umbrella shape which is convex toward the right. This inverted state is formed when the pressure in the second chamber 42 is higher than the pressure in the first chamber 41 by a predetermined value. In the present embodiment, the case is considered where a high positive pressure generated by the pressure purge is applied to the second chamber 42, and as a result, the pressure in the second chamber 42 becomes higher than the atmospheric pressure+ρgh in the first chamber 41. The predetermined value described above depends on the reversing pressure of the umbrella portion 661. This reversing pressure is set to a value lower than a breaking strength of the atmospheric pressure detection film 7 or a mounting strength of the atmospheric pressure detection film 7 to the second partition wall 421.

When the second chamber 42 is pressurized, the pressing member 5 does not rotate to the left. That is, the pressing member 5 does not generate a pressing force which presses the on-off valve 6 to the left. This is because the atmospheric pressure detection film 7 is displaced to the side that bulges to the right due to the increase in pressure in the second chamber 4, and does not give a displacement force to the pressure receiving portion 5A. Therefore, a biasing force of the biasing spring 45 maintains a state where the valve holder 61 is positioned at the rightmost position.

However, even when the valve holder 61 does not move, the umbrella shape of the umbrella portion 661 is reversed. Accordingly, the sealing surface 67 is separated from the sealing wall surface 43S, and a gap g is generated between the sealing surface 67 and the sealing wall surface 43S. Therefore, the communication opening 43 is brought into an open state. As a result, the pressurized ink (pressure) in the second chamber 42 is made to escape (released) to the first chamber 41 side through the communication opening 43. Therefore, it is possible to prevent an excessive force from acting on the atmospheric pressure detection film 7 itself or the mounting portion of the atmospheric pressure detection film 7. Accordingly, it is possible to prevent breaking of the atmospheric pressure detection film 7.

[Flow of Ink in Each Mode]

Figure 30:
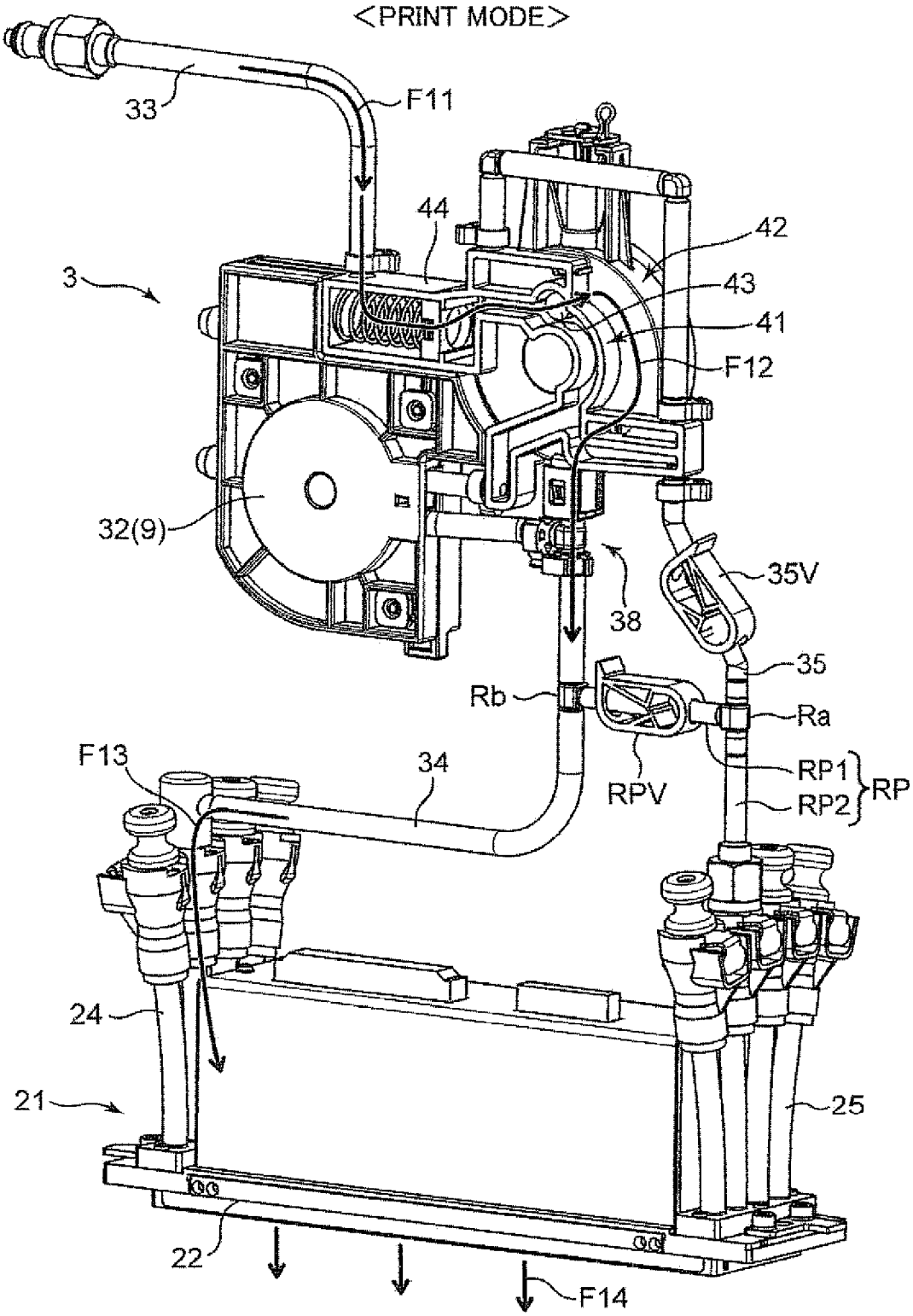
FIG. 30 is a perspective view showing a flow of ink in the print mode.
Figure 31:
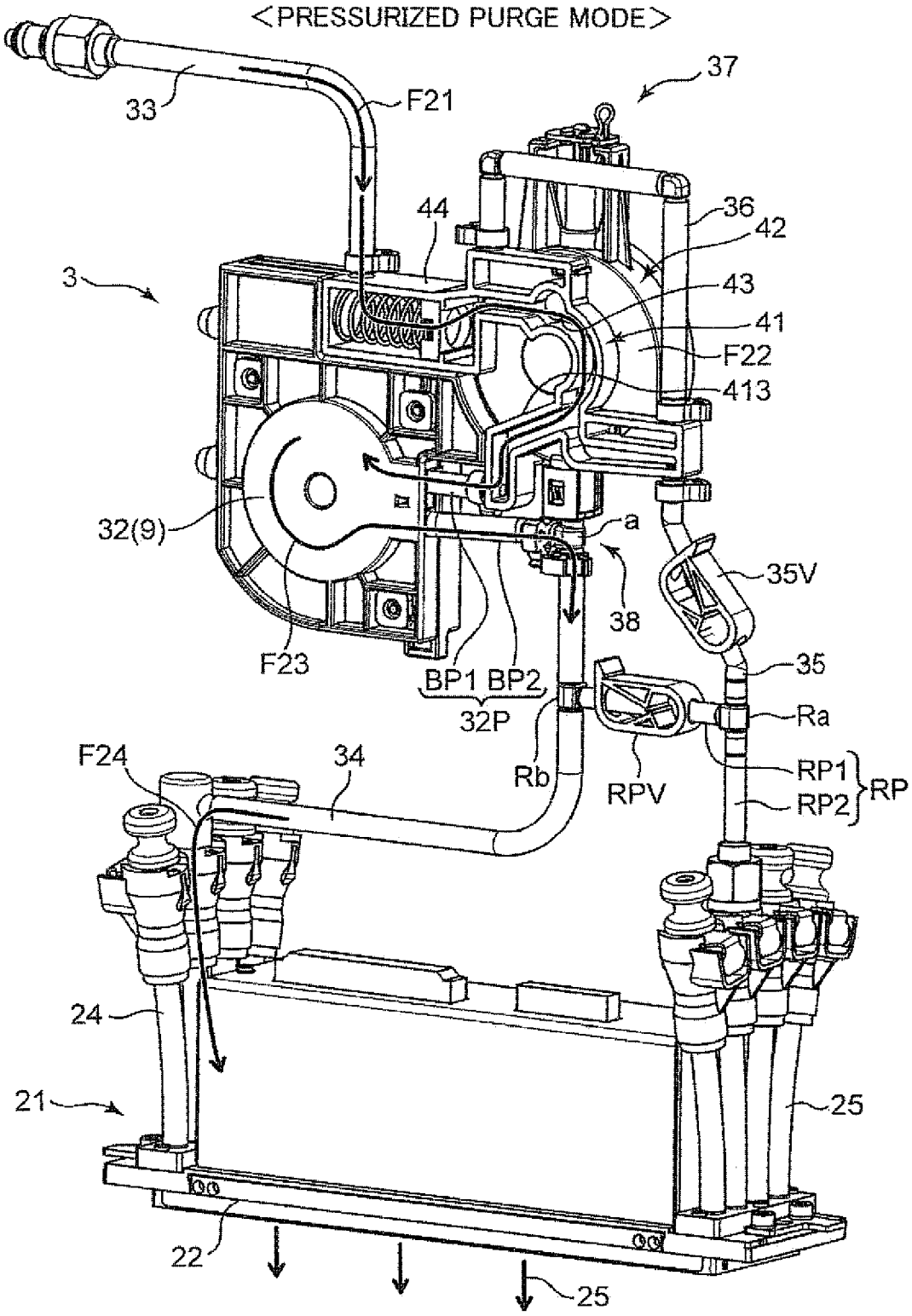
FIG. 31 is a perspective view showing the flow of ink in the pressurized purge mode.
Figure 32:
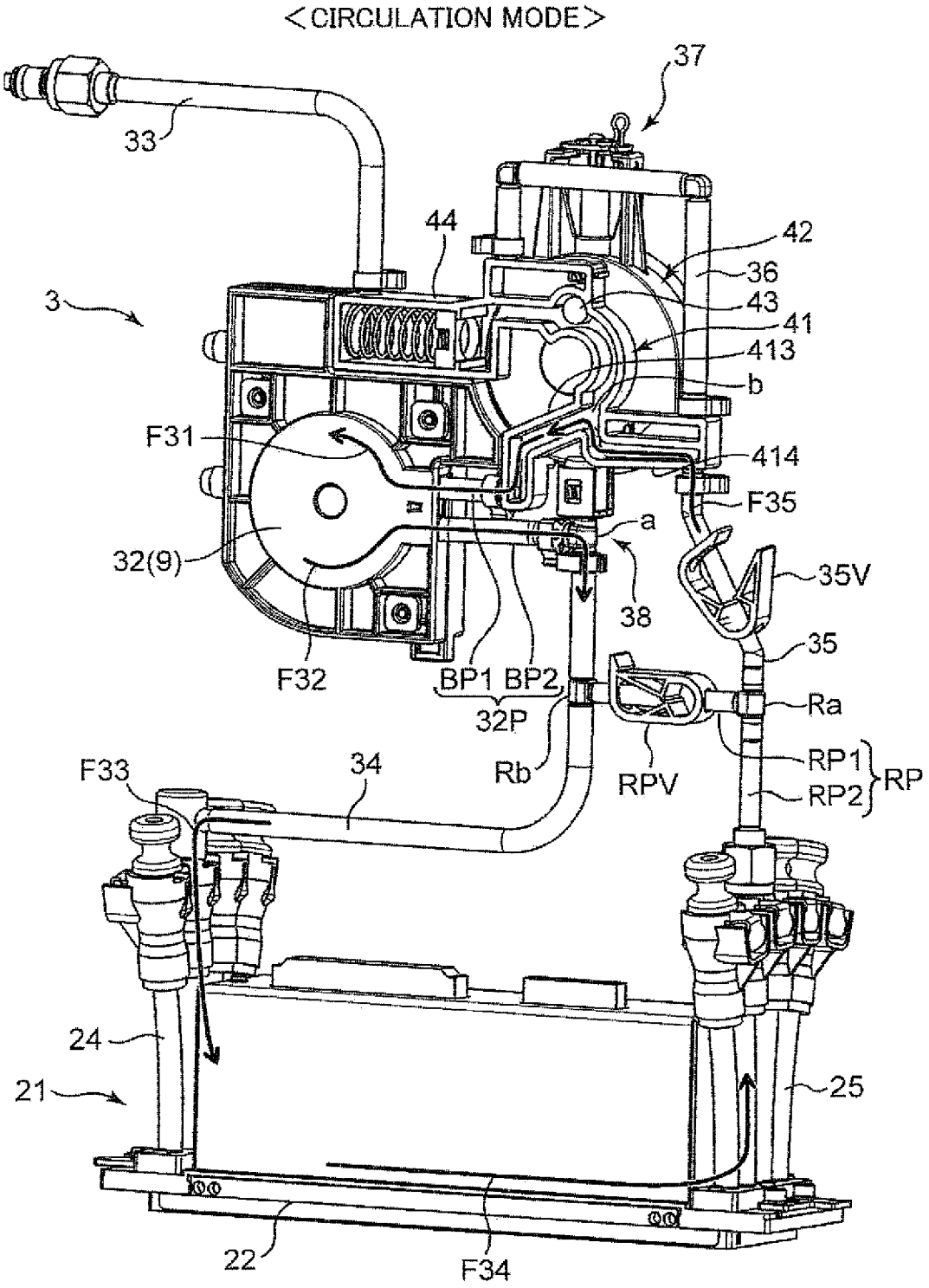
FIG. 32 is a perspective view showing the flow of ink in the circulation mode.
Figure 33:
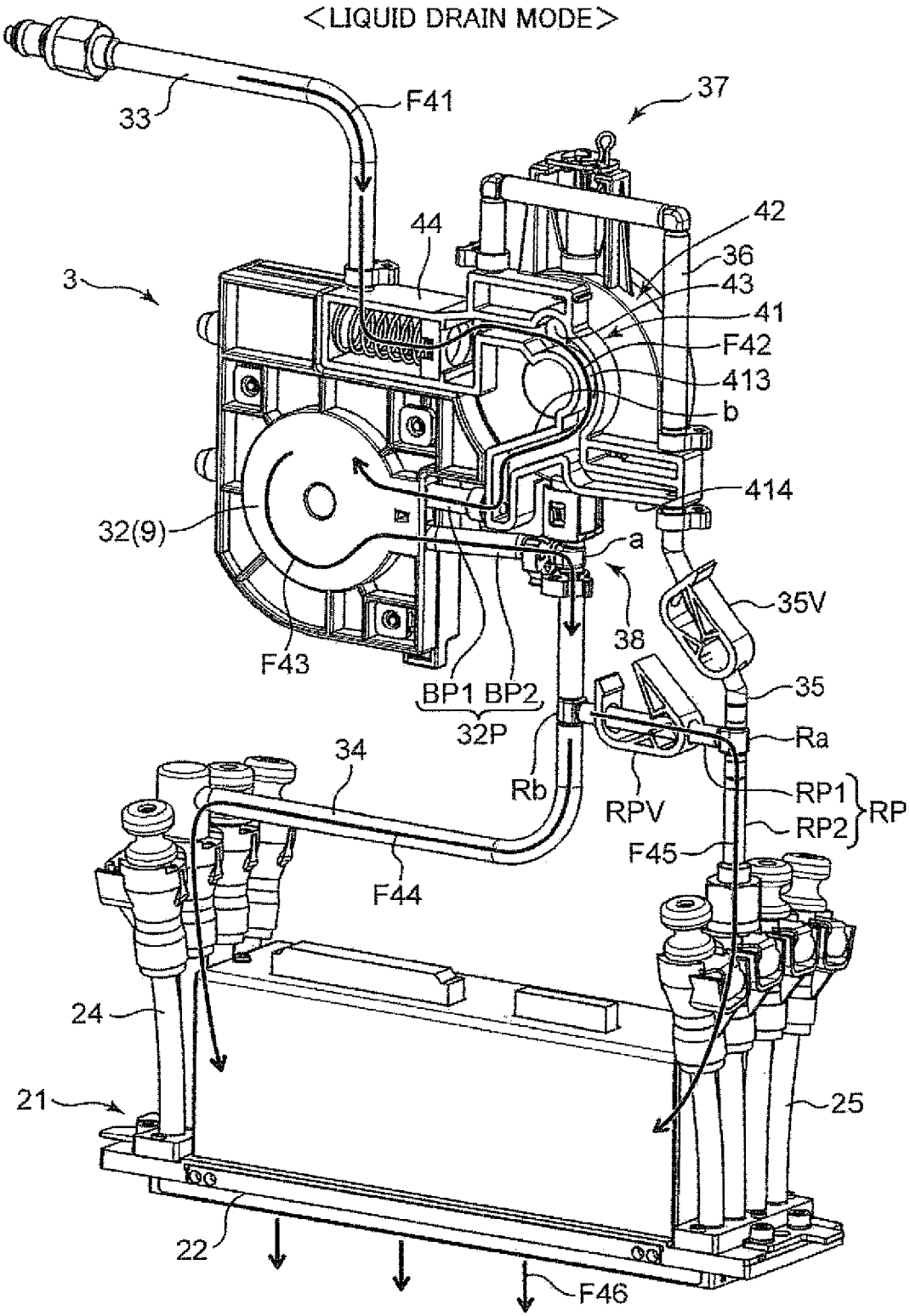
FIG. 33 is a perspective view showing the flow of ink in the liquid drain mode.

Subsequently, the flow of ink in each mode of the liquid supply unit 3 will be described. FIG. 30 is a perspective view showing the flow of ink in a print mode, FIG. 31 is a perspective view showing the flow of ink in a pressurized purge mode, FIG. 32 is a perspective view showing the flow of ink in a circulation mode, and FIG. 33 is a perspective view showing the flow of ink in a liquid drain mode.

In the print mode (FIG. 30), ink is not distributed using the return pipe 35 and the liquid drain pipe RP. Accordingly, the return pipe 35 and the liquid drain pipe RP are respectively brought into a closed state by the first clip 35V and the second clip RPV. It is needless to say that the supply valve 33V (FIG. 5) is in an open state. The ink discharged from the ink cartridge IC enters the filter chamber 44 through the upstream pipe 33 due to the water head difference as indicated by an arrow F11 in FIG. 30. When the ink passes through the filter member 442 in the filter chamber 44, solid foreign substances contained in the ink are removed. Then, the ink enters the first chamber 41.

When the on-off valve 6 is opened by the operation of the pressing member 5, as indicated by an arrow F12, ink from the first chamber 41 passes through the communication opening 43 and is stored in the second chamber 42. By the ink ejection operation in the ink ejecting portion 22, the ink in the second chamber 42 is sucked, sequentially passes through the supply hole 42H and the backflow prevention mechanism portion 38, and enters the downstream pipe 34. Then, as indicated by an arrow F13, the ink enters the common passage 27 (FIG. 6) of the head unit 21 via the end tube 24. Then, the ink is ejected from the respective ink discharge holes 22H through the individual passages 26 (arrow F14).

Also in the pressurized purge mode (FIG. 31), ink is not distributed using the return pipe 35 and the liquid drain pipe RP. Accordingly, the return pipe 35 and the liquid drain pipe RP are respectively brought into a closed state by the first and second clips 35V and RPV. The supply valve 33V is in an open state. In this pressurized purge mode, the pump 9 is operated in the forward direction, and ink is forcibly supplied to the head unit 21 regardless of the water head difference. When the pump 9 operates, as indicated by an arrow F21, the ink enters the filter chamber 44 through the upstream pipe 33, and further enters the first chamber 41. Then, as indicated by an arrow F22, the ink enters the upstream bypass pipe BP1 via the bypass communication chamber 413 without advancing to the second chamber 42.

The squeezing operation of the pump 9 increases a pressure of the ink and delivers the pressurized ink to the downstream side. That is, as indicated by an arrow F23, the ink is fed from the downstream bypass pipe BP2 to the downstream pipe 34. As described above, the backflow prevention mechanism portion 38 is disposed at the joint part a of the downstream bypass pipe BP2 with the downstream pipe 34. Accordingly, the ink does not flow back to the second chamber 42 side. Then, the ink enters the common passage 27 (FIG. 6) of the head unit 21 via the end tube 24 as indicated by an arrow F24. Then, the ink is ejected from the respective ink discharge holes 22H at high pressure through the individual passages 26 (arrow F25). As a result, foreign substances which clog the ink discharge holes 22H, air which stays in the individual passages 26, and the like are removed.

In the circulation mode (FIG. 32), the ink is distributed using the return pipe 35. Accordingly, the closed state by the first clip 35V is released so that the return pipe 35 is brought into an open state. On the other hand, the ink is circulated between the liquid supply unit 3 and the head unit 21.

Accordingly, the supply valve 33V (FIG. 5) is brought into a closed state. The second clip RPV also remains closed. As a result, a closed ink circulation path is formed which includes the bypass pipe 32P, the downstream pipe 34, the common passage 27 of the head unit 21, the return pipe 35, the return communication chamber 414, and the bypass communication chamber 413. Also in this circulation mode, the pump 9 is operated in the forward rotation as explained with reference to FIG. 8A.

When the pump 9 operates, the circulation of the ink in the ink circulation path starts. That is, by the operation of the pump 9, the ink is drawn from the bypass communication chamber 413 into the upstream bypass pipe BP1 as indicated by an arrow F31 and, then, is fed out to the downstream bypass pipe BP2 as indicated by an arrow F32. Then, the ink flows into the head unit 21 via the joint part a, the downstream pipe 34, and the end tube 24 (arrow F33), passes through the common passage 27 in the head unit 21, and enters the recovery tube 25 (arrow F34). Then, as indicated by an arrow F35, the ink returns from the recovery tube 25 to the bypass communication chamber 413 through the return pipe 35, the return communication chamber 414, and a joint part b in that order. At this stage of the operation, the supply valve 33V is closed. Accordingly, the return pipe 35 and the common passage 27 to which the ink is drawn by the pump 9 are at a negative pressure. Therefore, the ink does not leak from the ink discharge holes 22H during the ink circulation.

When the circulation mode is performed, the ink can be circulated in the ink circulation path as described above. In other words, the ink once sent to the head unit 21 side can be returned to the liquid supply unit 3 side by using the return pipe 35. Therefore, even when air enters the head unit 21 side due to the feeding of ink which contains air or the like, the air can be recovered together with the ink to the liquid supply unit 3 side by the circulation described above. The air (air bubbles) recovered to the liquid supply unit 3 side enters the first chamber 41 disposed above the return communication chamber 414 from the return communication chamber 414 by the buoyancy, and enters the second chamber 42 from the communication opening 43 disposed in near the uppermost portion of the first chamber 41. An operator can make the air escape from the second chamber 42 to the outside by operating the air vent mechanism portion 37 in a timely manner while checking a retention state of the air in the second chamber 42 with the monitor pipe 36.

As described above, by performing the circulation mode, it is possible to prevent air from staying in the individual passages 26 of the head unit 21 and in the vicinity of the ink discharge holes 22H. The air which has entered the head unit 21 side can also be removed in the pressurized purge mode. However, it is rather difficult to remove the air once entered into the head unit 21. Accordingly, there may be a case where it is necessary to perform a pressure purge to discharge a considerable amount of ink. Therefore, there arises a problem that a large amount of ink is consumed only for venting air from the head unit 21. However, according to the circulation mode, the air is collected in the liquid supply unit 3 by circulating the ink. Accordingly, the ink is not consumed. Further, in the circulation mode, it is only necessary to circulate the ink in the ink circulation path, and it is not necessary to increase the pressure of the ink unlike the pressurized purge mode. Accordingly, the pump 9 can be operated at a low speed. Therefore, it is possible to avoid a case where a large pressure load is applied to the liquid supply unit 3, and it is possible to prevent breaking of the atmospheric pressure detection film 7 and the sealing film 7A.

In the liquid drain mode (FIG. 33), the ink is distributed using the liquid drain pipe RP. Accordingly, a closed state of the second clip RPV is released and the liquid drain pipe RP is brought into an open state. A preservation solution in the head unit 21 is pushed out by the ink. Accordingly, the supply valve 33V is also brought into an open state. On the other hand, the ink is not distributed using the return pipe 35. Accordingly, the first clip 35V is brought into a closed state. By performing such valve operations, ink can be supplied to the head unit 21 from two routes, that is, the downstream pipe 34 and the liquid drain pipe RP. As described above with reference to FIG. 8B, the pump 9 is operated in the forward rotation in the liquid drain mode.

When the pump 9 operates, ink is supplied to the head unit 21 along two routes described above without passing through the second chamber 42. That is, when the pump 9 operates, the ink forcibly enters the filter chamber 44 through the upstream pipe 33 and, then, enters the first chamber 41 as indicated by an arrow F41. Then, as indicated by an arrow F42, the ink enters the upstream bypass pipe BP1 via the bypass communication chamber 413 without advancing to the second chamber 42. By the squeezing operation of the pump 9, ink is fed out from the downstream bypass pipe BP2 to the downstream pipe 34, as indicated by an arrow F43. The backflow prevention mechanism portion 38 disposed at the joint part a prevents the ink from flowing back to the second chamber 42 side.

A second T branch portion Rb is interposed near an upper end portion of the downstream pipe 34, and the liquid drain pipe RP is branched from the downstream pipe 34. The second clip RPV is released. Therefore, the ink is diverted at the second T branch portion Rb, and flows toward the head unit 21 through a portion of the downstream pipe 34 located downstream of the second T branch portion Rb (arrow F44) and flows toward a head unit 21 side through the bridge portion RP1 of the liquid drain pipe RP and the common portion RP2 (return pipe 35) (arrow F45). Then, the ink enters the upstream side of the common passage 27 (FIG. 6) from the downstream pipe 34 via the end tube 24, and enters the downstream side of the common passage 27 from the return pipe 35 via the recovery tube 25. Being pushed by the ink, the preservation solution which is filled in advance in the common passage 27 and the individual passages 26 is ejected from the respective ink discharge holes 22H (arrow F46). By continuing the ejection for a predetermined period, the preservation solution is discharged from the head unit 21, and the head unit 21 is brought into a state where the head unit 21 is filled with ink. In other words, the liquid ejection device is ready for an actual use.

In this way, in the liquid drain mode, by operating the pump 9, ink is supplied to both the upstream side and the downstream side of the common passage 27 through the downstream pipe 34 and the liquid drain pipe RP, and the preservation solution filled in the head unit 21 can be discharged from the ink discharge hole 22H in a push-out manner. Therefore, the preservation solution can be reliably expelled while preventing the preservation solution from staying in the common passage 27 and the individual passage 26. In addition, the liquid drain pipe RP is always installed. Accordingly, it is unnecessary to mount or detach a dedicated pipe for discharging a preservation solution on or from the head unit 21 (the couplings of the end tube 24 and the recovery tube 25 in this embodiment). Accordingly, the operability of discharging a preservation solution can be improved.

In this embodiment, the return pipe 35 is provided for venting air in the circulation mode described above. Therefore, in the head unit 21, as a coupling passage, in addition to the end tube 24 for connecting the downstream pipe 34 which forms the original ink supply passage in a print mode or the like, it is necessary to attach the recovery tube 25 for connecting the return pipe 35. It is necessary to also fill these end tubes 24 and recovery tubes 25 with the preservation solution. The preservation solution in the end tube 24 can be discharged by supplying ink from the downstream pipe 34. However, when the liquid drain pipe RP does not exist, there is no choice but to discharge the preservation solution filled in the recovery tube 25 by connecting another pipe to the coupling disposed at an upper end of the recovery tube 25. When other pipes are attached or detached to or from the coupling, the operability of discharging the preservation solution is deteriorated, and problems arise such as the contamination of the surrounding environment due to leakage of ink during attachment or detachment and the intrusion of air into the pipes. In the present embodiment, such a problem can be solved by always installing the liquid drain pipe RP.

[Modification]

Although the embodiment of the present invention has been described above, the present invention is not limited to such an embodiment. For example, the following modified embodiments can be adopted.

(1) In the above embodiment, the mode is exemplified where the liquid supply unit 3 according to the present invention supplies ink to the head unit 21 of the inkjet printer 1. The liquid stored in and supplied by the liquid supply unit 3 is not limited to ink, and various liquids can be considered as the liquid to be used by the liquid supply unit 3. For example, water, various solutions, chemicals, industrial chemical liquids, and the like can be stored in and supplied by the liquid supply unit 3.

(2) In the above embodiment, as the second valve element and the third valve element, the first clip 35V and the second clip RPV of a manual clip type are exemplified. The valve element may be of any type as long as the valve element can open and close the return pipe 35 and the liquid drain pipe RP. For example, a cock type valve element, an electrically operated valve element, or the like may be adopted as the second valve element and the third valve element.

d(3) In the above liquid drain mode, when the flow path in the liquid supply unit 3 is not filled with the preservation solution, the air in the liquid supply unit 3 is supplied to the head unit 21 prior to the ink. In order to avoid this air supply, after the pump 9 is operated in a liquid drain mode, the coupling of the downstream end 342 to the end tube 24 and the coupling of the upstream end 351 to the recovery tube 25 may be released until the ink reaches the downstream end 342 of the downstream pipe 34 and the upstream end 351 of the return pipe 35.

(4) Various modified configurations can be adopted as the pressing member 5 and the on-off valve 6. In the pressing member 5, a configuration may be adopted in which the on-off valve 6 is pressed by making use of a principle of leverage. That is, the link boss 54 is disposed between the fulcrum portion 53 and the pressure receiving portion 5A, the fulcrum portion 53 is used as a fulcrum, the pressure receiving portion 5A is used as a force point, and the link boss 54 is used as an action point. Further, although the on-off valve 6 which includes the umbrella valve 66 has been exemplified, various movable valves may be used as the open/close member in place of the on-off valve 6. In the above embodiment, the configuration is exemplified in which the pressing member 5 and the on-off valve 6 are connected to each other by link connection by the link boss 54 and the link pin 65. However, two members may not be connected to each other by link connection. For example, a structure may be adopted in which a part of the pressing member 5 and a part of the on-off valve 6 are always in contact with each other by a spring or the like, and the pressing member 5 presses the on-off valve 6 through the contact portion.

The invention claimed is:

1. A liquid ejection device comprising:

a liquid ejection head which ejects a predetermined first liquid; and a liquid supply unit which supplies the first liquid from a liquid storage container for storing the first liquid to the liquid ejection head, wherein the liquid ejection head includes a plurality of liquid discharge holes, individual passages for individually supplying the first liquid to each of the liquid discharge holes, and a common passage for supplying the first liquid to the individual passages, the individual passage and the common passage are filled with a second liquid different from the first liquid prior to an actual use of the liquid ejection head, the liquid supply unit includes:

a pressure chamber capable of storing the first liquid;

a first supply passage which makes the liquid storage container communicate with the pressure chamber;

a second supply passage which makes an upstream side of the common passage communicate with the pressure chamber;

a liquid drain path which makes a downstream side of the common passage communicate with the second supply passage; and a pump mechanism capable of delivering the first liquid from the liquid storage container to the liquid ejection head through the first supply passage and the second supply passage, and the pump mechanism is capable of, prior to the actual use of the liquid ejection head, supplying the first liquid to the upstream side and the downstream side of the common passage through the second supply passage and the liquid drain path, and discharging the second liquid from the liquid discharge hole.

2. The liquid ejection device according to claim 1, further comprising a return path which makes a downstream side of the common passage communicate with the pressure chamber, wherein the pump mechanism is capable of circulating the liquid through the second supply passage, the common passage, and the return path.

3. The liquid ejection device according to claim 2, wherein the liquid drain path includes:

a bridge portion which makes the second supply passage communicate with the return path; and a common portion which shares the return path from a point to which the bridge portion is connected to the downstream side of the common passage.

4. The liquid ejection device according to claim 2, wherein the liquid supply unit further includes a bypass supply passage where an upstream end of the bypass supply passage in a liquid supply direction is connected to the first supply passage, and a downstream end of the bypass supply passage in the liquid supply direction joins with the second supply passage, and the pump mechanism is disposed in the bypass supply passage.

5. The liquid ejection device according to claim 3, further comprising:

a first valve element which opens and closes the first supply passage;

a second valve element which opens and closes the return path; and a third valve element which opens and closes the liquid drain path at the bridge portion.

6. The liquid ejection device according to claim 1, further comprising an air vent mechanism for venting air from the pressure chamber.

7. The liquid ejection device according to claim 1, wherein the liquid supply unit includes:

an upstream chamber which forms a part of the first supply passage and is disposed on an upstream side in a liquid supply direction with respect to the pressure chamber;

a wall portion having a communication opening which makes the upstream chamber communicate with the pressure chamber;

an open/close member which is disposed at the communication opening and changes a posture between a closed posture where the communication opening is closed and an open posture where the communication opening is opened;

a biasing member which biases the open/close member in a direction toward the closed posture; and a pressing member capable of pressing the open/close member in a direction toward the open posture, a part of the wall portion which partitions the pressure chamber is formed of a flexible film member, the flexible film member is a member which is displaced based on a negative pressure generated with a decrease in liquid in the pressure chamber and transmits a displacement force to the pressing member, and the pressing member includes a pressure receiving portion that receives a displacement force from the flexible film member, and a pressing portion which presses the open/close member against a biasing force of the biasing member by a displacement force received by the pressure receiving portion.

8. The liquid ejection device according to claim 7, wherein the liquid storage container is disposed above the liquid ejection head, and the liquid supply unit is disposed between the liquid storage container and the liquid ejection head, and the first liquid is supplied to the liquid ejection head by a water head difference, the pressure chamber is at a negative pressure during normal supply of the first liquid, and when the pressure chamber becomes a negative pressure exceeding a predetermined threshold value as an amount of liquid in the pressure chamber decreases, the flexible film member generates a pressing force against the biasing force of the biasing member.

* * * * *